US007123857B2

(12) United States Patent
Harada et al.

(10) Patent No.: US 7,123,857 B2
(45) Date of Patent: Oct. 17, 2006

(54) IMAGE BEARING MEMBER UNIT, INCLUDING IMAGE BEARING SHUTTER

(75) Inventors: Hirohmi Harada, Kawasaki (JP); Takeshi Saitou, Hachiohji (JP)

(73) Assignee: Ricoh Company, Ltd., Tokyo (JP)

( * ) Notice: Subject to any disclaimer, the term of this patent is extended or adjusted under 35 U.S.C. 154(b) by 153 days.

(21) Appl. No.: 10/663,822

(22) Filed: Sep. 17, 2003

(65) Prior Publication Data

US 2004/0126134 A1 Jul. 1, 2004

(30) Foreign Application Priority Data

Sep. 24, 2002 (JP) ..... 2002-276427
May 23, 2003 (JP) ..... 2003-146785
Jul. 24, 2003 (JP) ..... 2003-201356
Jul. 24, 2003 (JP) ..... 2003-201357

(51) Int. Cl.
*G03G 21/18* (2006.01)

(52) U.S. Cl. ..... 399/114

(58) Field of Classification Search ..... 399/110, 399/111, 114, 116, 91
See application file for complete search history.

(56) References Cited

U.S. PATENT DOCUMENTS 4,470,689 A * 9/1984 Nomura et al. ..... 399/114
4,607,939 A 8/1986 Saito
4,708,455 A 11/1987 Kubota et al.
4,792,825 A 12/1988 Saito et al.
4,821,075 A 4/1989 Saito et al.
5,083,158 A * 1/1992 Kashima et al. ..... 399/114
5,113,220 A * 5/1992 Kwak ..... 399/114
5,150,162 A 9/1992 Saito
5,231,453 A * 7/1993 Nakai et al. ..... 399/114
5,455,662 A 10/1995 Ichikawa et al.
5,500,719 A 3/1996 Ichikawa et al.

(Continued)

FOREIGN PATENT DOCUMENTS

GB 2 101 933 1/1983

(Continued)

OTHER PUBLICATIONS

U.S. Appl. No. 06/654,779, filed Sep. 26, 1984, Unknown.

(Continued)

*Primary Examiner*—Robert Beatty
(74) *Attorney, Agent, or Firm*—Oblon, Spivak, McClelland, Maier & Neustadt, P.C.

(57) ABSTRACT

An image bearing member unit includes an image bearing member on which a toner image is formed, and a support member supporting the image bearing member such that the image bearing member protrudes through an opening formed in the support member. The image bearing member unit is drawn out of and put into a main body of an image forming apparatus. The image bearing member unit further includes a shutter for covering and uncovering the image bearing member protruding through the opening formed in the support member. The shutter is assembled with the support member to move in directions, substantially perpendicular to directions in which the image bearing member unit is drawn out of and put into the main body of the image forming apparatus, to be located, when the image bearing member unit has been drawn out of the main body of the image forming apparatus, in a closed position wherein the shutter covers the image bearing member protruding through the opening formed in the support member, and to be located, when the image bearing member unit has been set in a predetermined position inside of the main body of the image forming apparatus, in an opened position wherein the shutter does not cover the image bearing member protruding through the opening formed in the support member.

121 Claims, 27 Drawing Sheets

U.S. PATENT DOCUMENTS

| | | | | |
|---|---|---|---|---|
| 5,502,552 | A | | 3/1996 | Iwata et al. |
| 5,557,382 | A | | 9/1996 | Tatsumi et al. |
| 5,627,631 | A | | 5/1997 | Ichikawa et al. |
| 5,697,020 | A | | 12/1997 | Sato et al. |
| 5,822,663 | A | | 10/1998 | Ichikawa et al. |
| 5,918,090 | A | | 6/1999 | Ichikawa et al. |
| 6,075,956 | A | * | 6/2000 | Watanabe et al. ..... 399/92 |
| 6,075,963 | A | | 6/2000 | Ichikawa et al. |
| 6,091,916 | A | * | 7/2000 | Dycher ..... 399/114 |
| 6,141,521 | A | | 10/2000 | Yuuki et al. |
| 6,144,821 | A | * | 11/2000 | Oguma ..... 399/114 |
| 6,289,195 | B1 | | 9/2001 | Ichikawa et al. |
| 6,388,699 | B1 | | 5/2002 | Phillips |
| 6,418,293 | B1 | | 7/2002 | Ichikawa et al. |
| 6,560,414 | B1 | | 5/2003 | Suda et al. |

FOREIGN PATENT DOCUMENTS

| | | | |
|---|---|---|---|
| JP | 56-42676 | | 4/1981 |
| JP | 56-120555 | | 9/1981 |
| JP | 57-41791 | | 3/1982 |
| JP | 57-200052 | | 12/1982 |
| JP | 60-104961 | | 6/1985 |
| JP | 60-156563 | | 10/1985 |
| JP | 62-47653 | | 3/1987 |
| JP | 62-278575 | | 12/1987 |
| JP | 01-237670 | | 9/1989 |
| JP | 2-11156 | | 3/1990 |
| JP | 03140971 | A * | 6/1991 |
| JP | 4-84146 | | 3/1992 |
| JP | 4-247468 | | 9/1992 |
| JP | 5-11520 | | 1/1993 |
| JP | 5-72828 | | 3/1993 |
| JP | 6-138782 | | 5/1994 |
| JP | 06/186793 | | 7/1994 |
| JP | 6-208260 | | 7/1994 |
| JP | 07-244454 | | 9/1995 |
| JP | 09-292818 | | 11/1997 |
| JP | 10-123912 | | 5/1998 |
| JP | 2808323 | | 7/1998 |
| JP | 11-119528 | | 4/1999 |
| JP | 11-249532 | | 9/1999 |
| JP | 2000-66564 | | 3/2000 |
| JP | 2000-181326 | | 6/2000 |
| JP | 2000-276021 | | 10/2000 |
| JP | 3200139 | | 6/2001 |
| JP | 2001-337580 | | 12/2001 |
| JP | 2002-72817 | | 3/2002 |

OTHER PUBLICATIONS

U.S. Appl. No. 10/102,875, filed Mar. 22, 2002, Nagatsuna et al.
U.S. Appl. No. 10/173,981, filed Jun. 19, 2002, Ichikawa et al.
U.S. Appl. No. 10/226,148, filed Aug. 23, 2002, Suda et al.
U.S. Appl. NO. 10/351,410, filed Jan. 27, 2003, Miura et al.
U.S. Appl. No. 10/460,152, filed Jun. 13, 2003, Suzuki et al.
U.S. Appl. No. 10/612,146, filed Jul. 3, 2003, Miura et al.
U.S. Appl. No. 10/663,822, filed Sep. 17, 2003, Harada et al.
U.S. Appl. No. 10/912,117, filed Aug. 6, 2004, Harada et al.
U.S. Appl. No. 11/225,152, filed Sep. 14, 2005, Harada.

* cited by examiner

IMAGE BEARING MEMBER UNIT, INCLUDING IMAGE BEARING SHUTTER

The present application claims priority and contains subject matter related to Japanese Patent Applications No. 2002-276427, NO. 2003-146785, No. 2003-201356 and No. 2003-201357 filed in the Japanese Patent Office on Sep. 24, 2002, May 23, 2003, Jul. 24, 2003 and Jul. 24, 2003, respectively, and the entire contents of which are hereby incorporated by reference.

BACKGROUND OF THE INVENTION

1. Field of the Invention

The present invention relates to an image bearing member unit that includes an image bearing member on which a toner image is formed and a support member supporting the image bearing member and that can be taken out of and put into the main body of an image forming apparatus, a process cartridge including the image bearing member unit, and an image forming apparatus using the image bearing member unit or the process cartridge.

2. Discussion of the Background

It is known that an image bearing member unit including an image bearing member on which a toner image is formed and a support member supporting the image bearing member is used in image forming apparatuses such as a copier, a printer, a facsimile apparatus, or a multi-function apparatus having functions of at least two of these apparatuses. The image bearing member unit can be taken out of and put into main bodies of the image forming apparatuses. When the image bearing member unit has been taken out of respective main bodies of the image forming apparatuses, if the image bearing member of the image bearing member unit is directly exposed to light, the image bearing member is deteriorated. If the image bearing member is touched by a hand or a thing, the surface of the image bearing member may be soiled or damaged.

In order to avoid such problems, for example, Japanese Patent Laid-open Publication No. 2001-337580 proposes an image forming apparatus, in which a shutter is provided to an image bearing member unit. When the image bearing member unit is taken out of the main body of the image forming apparatus, the shutter is moved to a closed position wherein the shutter covers an image bearing member of the image bearing member unit. When the image bearing member unit is put into the main body of the image forming apparatus to be set therein, the shutter is moved back to an opened position wherein the shutter does not cover the image bearing member.

In a known image forming apparatus in which a shutter is provided to an image bearing member unit to cover and uncover an image bearing member of the image bearing member unit as in the image forming apparatus of the above JP Publication, the shutter is supported by a support member of the image bearing member unit to rotate, and in conjunction with an operation of attaching and detaching the image bearing member unit to and from the main body of the image forming apparatus, the shutter is rotated to move to the opened or closed position. When a shutter is configured to rotate to move to opened and closed positions, in order that the shutter is rotated without any trouble, a relatively large space is necessary inside of the main body of an image forming apparatus, so that the size of the main body of the image forming apparatus inevitably increases.

SUMMARY OF THE INVENTION

The present invention has been made in view of the above-discussed and other problems and addresses the above-discussed and other problems.

Preferred embodiments of the present invention provide a novel image bearing member unit that obviates the need for providing a relatively large space in the main body of an image forming apparatus as in background apparatuses for an operation of a shutter provided for covering and uncovering an image bearing member of the image bearing member unit. The preferred embodiments of the present invention further provide a novel process cartridge including the image bearing member unit, and an image forming apparatus using the novel image bearing member unit or the novel process cartridge.

According to a preferred embodiment of the present invention, an image bearing member unit includes an image bearing member on which a toner image is formed and a support member supporting the image bearing member such that the image bearing member protrudes through an opening formed in the support member. The image bearing member unit can be drawn out of and put into a main body of an image forming apparatus. The image bearing member unit further includes a shutter for covering and uncovering the image bearing member protruding through the opening formed in the support member. The shutter is assembled with the support member to move in directions, substantially perpendicular to directions in which the image bearing member unit is drawn out of and put into the main body of the image forming apparatus, to be located, when the image bearing member unit has been drawn out of the main body of the image forming apparatus, in a closed position wherein the shutter covers the image bearing member protruding through the opening formed in the support member, and to be located, when the image bearing member unit has been set in a predetermined position inside of the main body of the image forming apparatus, in an opened position wherein the shutter does not cover the image bearing member protruding through the opening formed in the support member.

According to another preferred embodiment of the present invention, a process cartridge including the above-described image bearing member unit is provided. The process cartridge includes at least one process device for forming a toner image on the image bearing member of the image bearing member unit.

According to another preferred embodiment of the present invention, an image forming apparatus including the above-described image bearing member unit or the above-described process cartridge is provided.

According to still another preferred embodiment of the present invention, an image bearing member unit includes an image bearing member on which a toner image is formed; a support member supporting the image bearing member such that the image bearing member protrudes through an opening formed in the support member; a shutter assembled with the support member to move between an opened position wherein the shutter does not cover the image bearing member protruding through the opening formed in the support member and a closed position wherein the shutter covers the image bearing member protruding through the opening formed in the support member; a pressing member pressing the shutter toward the closed position; and a shutter opening/closing regulation device connected with the shutter and the support member to be located, when the shutter is in the closed position, in a first position wherein the shutter opening/closing regulation device protrudes upward, and to be located, when the shutter is in the closed position, in a second position wherein a height of the shutter opening/closing regulation device is lower than that when the shutter opening/closing regulation device is located in the first position. The image bearing member unit is configured to be drawn out and put into a main body of an image forming apparatus, and after the image bearing member unit in a state that the shutter is located in the closed position has been placed inside of the main body of the image forming apparatus, by moving the image bearing member unit upward relative to a member of the main body other than the image bearing member unit, the shutter opening/closing regulation device is pressed by the member of the main body other than the image bearing member unit downward to be located in the second position, and thereby the shutter is operated to move to the opened position.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompany drawings, wherein.

DETAILED DESCRIPTION OF THE PREFERRED EMBODIMENTS

Figure 1:
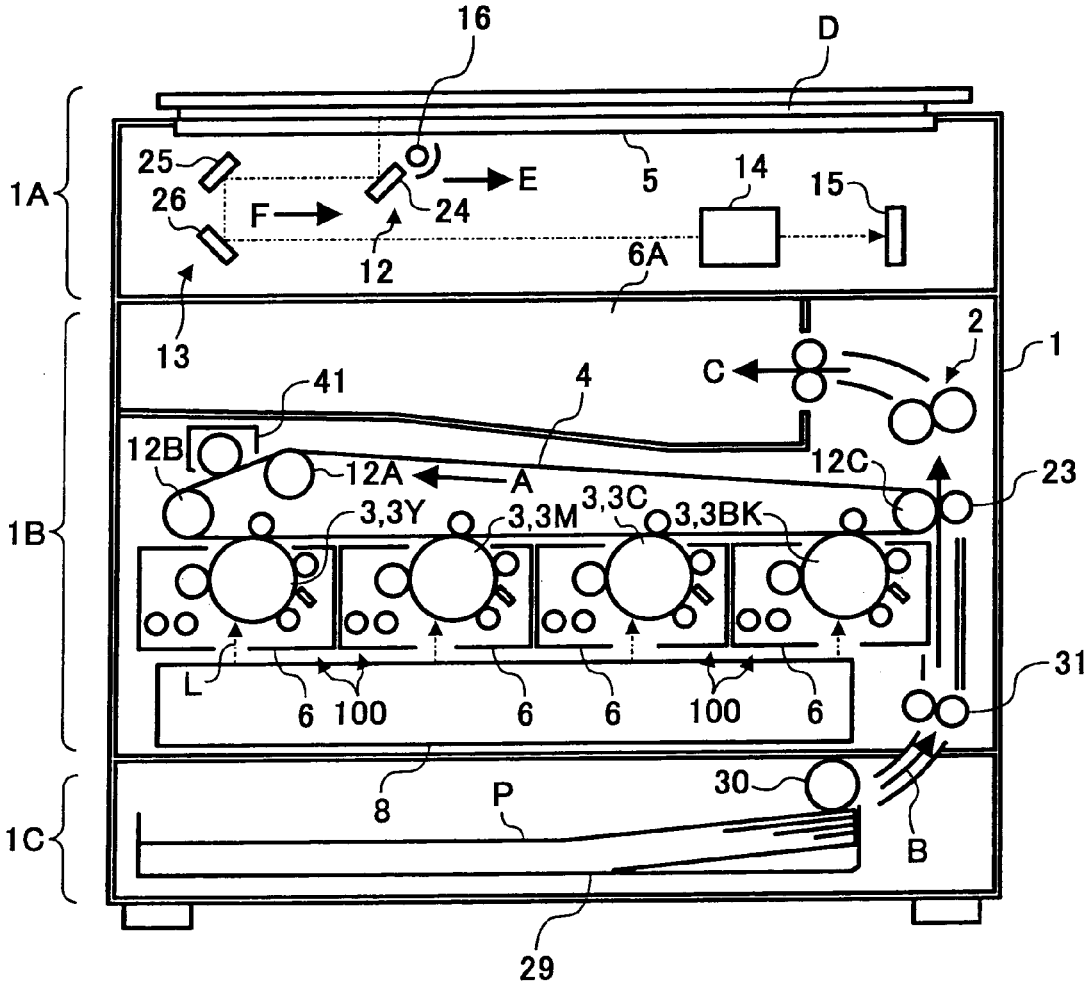
FIG. 1 is a schematic cross section illustrating an example of an image forming apparatus configured as a copier according to a preferred embodiment of the present invention.

Referring now to the drawings, wherein like reference numerals designate identical or corresponding parts throughout the several views, preferred embodiment of the present invention are described.

FIG. 1 is a schematic cross section illustrating an example of an image forming apparatus configured as a copier according to a preferred embodiment of the present invention. The image forming apparatus includes an image reading part 1A, and an image forming part 1B located below the image reading part 1A, and a sheet feeding part 1C located below the image forming part 1B. The image reading part 1A includes a contact glass 5, and a first moving member 12, a second moving member 13, an image forming lens 14, and a CCD 15, which are arranged below the contact glass 5. The first moving member 12 includes a light source 16 and a first mirror 24, and the second moving member 13 includes second and third mirrors 25 and 26. In a state that an original document D is placed on the contact glass 5, the first and second moving members 12 and 13 move in arrow directions E and F, respectively, and at this time, the original document D is illuminated by light from the light source 16. A reflected light from the original document D is reflected by the first, second and third mirrors 24, 25 and 26, passes the image forming lens 14, and reaches the CCD 15. Thus, an image of the original document D is imaged on the CCD 15, and the image is read by the CCD 15 to be converted to an image signal. The image signal is then digitized and is processed with image processing.

The image forming part 1B includes four image bearing members 3, which are photoconductors formed in drum-like shapes, respectively. Process devices are arranged around respective image bearing members 3, and a yellow toner image, a magenta toner image, a cyan toner image, and a black toner image are formed on the image bearing members 3 by the process devices arranged around the image bearing members 3, respectively. Here, as described above, each of the image forming members 3 is configured as a drum-like photoconductor. However, a photoconductor formed in an endless belt may be also used for each of the image bearing members 3. When necessary, respective image bearing members 3 are denoted by reference symbols 3Y, 3M, 3C, and 3BK, and referred to as the first, second, third, and fourth image bearing members, respectively.

In the image forming apparatus in this example, as illustrated in FIG. 2 through FIG. 5 also, the process devices arranged around each of the image bearing members 3 are integrated to form a process unit 6. Further, each image bearing member 3 and a support member 27 which is described later are integrated to form an image bearing member unit 28, and a process cartridge 100 is constituted by the process unit 6 and the image bearing member unit 28. Description with respect to these configurations will be made later in details.

As illustrated in FIG. 1, an intermediary transfer member 4 as an example of a transfer member is arranged to oppose the first through fourth image bearing members 3Y, 3M, 3C and 3BK. The intermediary transfer member 4 in this example is formed in an endless belt. The intermediary transfer member 4 is spanned around a plurality of support rollers 12A, 12B and 12C, and is driven to move in an arrow direction A.

Figure 2:
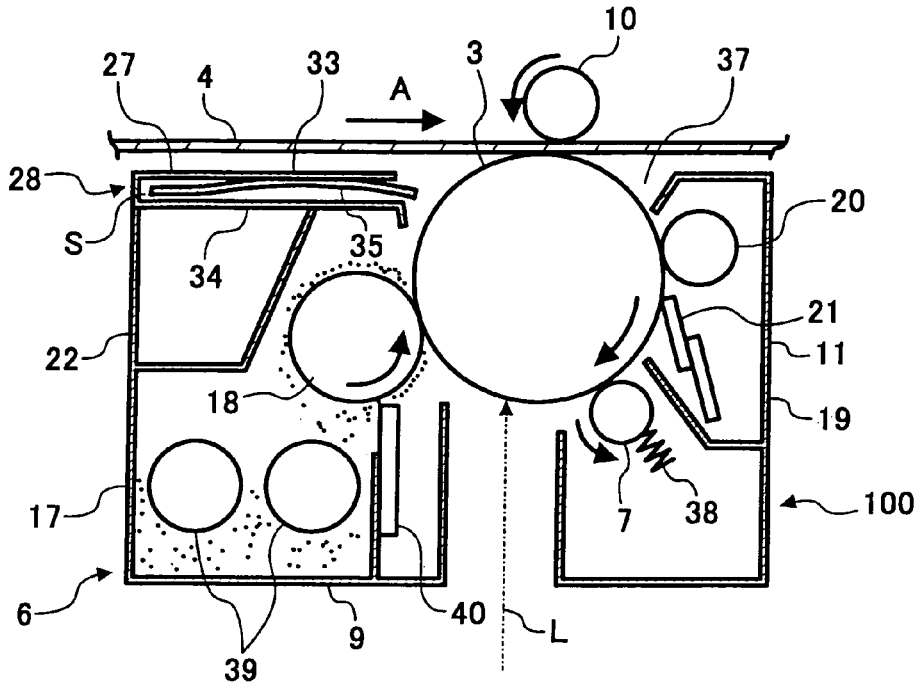
FIG. 2 is an enlarged cross section of a process cartridge including an image bearing member unit and a process unit, of the image forming apparatus.

Configurations of the image bearing members 3Y, 3M, 3C and 3BK and the process devices around respective image bearing members 3, and respective operations of forming toner images on the image bearing members 3Y, 3M, 3C and 3BK by the process devices are substantially the same. Therefore, description will be made only with respect to the first image bearing member 3Y and the process devices arranged around the first image bearing member 3Y. FIG. 2 is an enlarged diagram of the first image bearing member 3Y and the process devices arranged around the first image bearing member 3Y. The image bearing member 3Y is driven to rotate in a clockwise direction in FIG. 1 and FIG. 2, and at this time, the surface of the image bearing member 3Y is uniformly charged by a charging roller 7 to a predetermined polarity. The charging roller 7 is rotatably supported by a case 22 of the process unit 6, and is pressed against a surface of the image bearing member 3Y by a pressure spring 38.

As illustrated in FIG. 1, an exposure device 8 is arranged below the image bearing members 3. A laser beam L, which has been modulated according to a signal processed with image processing as described above, is emitted from the exposure device 8, and as illustrated in FIG. 2, the laser beam L illuminates a charged surface of the image bearing member 3Y, which has been charged by the charging roller 7. Thereby, an electrostatic latent image is formed on the image bearing member 3Y, and the electrostatic latent image is visualized to be a yellow toner image by a development device 9. The development device 9 includes a development case 17 constituted by a part of the case 22 of the process unit 6, and a development roller 18 and a stirring screw 39, which are supported by the development case 17 and are driven to rotate. The electrostatic latent image is visualized as a toner image with dry-type developer born by the development roller 18, the amount of which having been regulated, while being conveyed by the developing roller 18, by a regulating blade 40.

A first transfer device 10, constituted for example by a transfer roller, is arranged in a position almost opposing the image bearing member 3Y to sandwich the intermediary transfer member 4 by the image bearing member 3Y and the first transfer device 10. With a function of the first transfer device 10, the yellow toner image on the image bearing member 3Y is transferred onto the intermediary transfer member 4. A cleaning device 11 removes the toner that has not been transferred onto the intermediary transfer member 4 and that has remained on the first image bearing member 3Y. The cleaning device 11 includes a cleaning case 19 constituted by a part of the case 22 and a part of the support member 27, and a cleaning brush 20 and a cleaning blade 21 which are supported by the cleaning case 19. Residual toner on the image bearing member 3Y is removed by a cooperative operation of the cleaning brush 20 and the cleaning blade 21, and thereby the surface of the image bearing member 3Y is cleaned.

In a similar manner, a magenta toner image, a cyan toner image, and a black toner image are formed on the second, third, and fourth image bearing members 3M, 3C, and 3BK, respectively, and these toner images are sequentially transferred onto the intermediary transfer member 4, onto which the yellow toner image has been previously transferred, while being superimposed one upon another on the intermediary transfer member 4. Thus, a full-color toner image constituted of superimposed toner images of four colors is formed on the intermediary transfer member 4.

The sheet feeding part 1C illustrated in FIG. 1 includes a sheet feed cassette 29 and a sheet feed roller 30. The sheet feed cassette 29 accommodates a recording member P as a final transfer member, such as a transfer sheet and a resin film sheet. A recording member P at the top of stacked recording members P in the sheet feed cassette 29 is fed out in an arrow direction B with rotation of the sheet feed roller 30, and is conveyed to a pair of registration rollers 31. Further, a second transfer device 23, which is constituted for example by a transfer roller, is arranged in a position opposing the support roller 12C, sandwiching the intermediary transfer member 4 by the second transfer device 23 and the support roller 12C. The recording member P fed out with rotation of the pair of registration rollers 31 in a predetermined timing passes a transfer area between the second transfer device 23 and the intermediary transfer member 4, and at this time the full-color toner image formed on the intermediary transfer member 4 is transferred onto the recording member P by a function of the second transfer device 23. The recording member P carrying the transferred toner image passes a fixing device 2, and at this time the toner image is fixed to the recording member P by functions of heat and pressure. Thereby, a full-color image is formed on the recording member P. The recording member P passed the fixing device 2 is discharged in a direction indicated by an arrow C to a sheet discharge part 6A. Residual toner on the intermediary transfer member 4, remaining on the intermediary transfer member 4 after the toner image has been transferred, is removed by a cleaning device 41.

In the image forming apparatus illustrated in FIG. 1, toner images formed on the image bearing members 3 are transferred onto the intermediary transfer member 4, respectively, while being superimposed one upon another and thereby forming a full color toner image on the intermediary transfer member 4, and then the full-color toner image constituted of superimposed toner images is transferred onto a recording member P as a final transfer member. However, the image forming apparatus may be configured omitting the intermediary transfer member 4 such that the toner images on the image bearing members 3 are directly transferred onto a recording member P while being superimposed one upon another and thereby forming a full-color toner image on the recording member P. The full-color toner image constituted of superimposed toner images is then fixed to the recording member P by the fixing device 2, and thereby a full-color image is formed on the recording member P.

As illustrated in FIG. 2, the charging roller 7, the development device 9, and the cleaning device 11, serving as process devices, are arranged around the image bearing member 3Y. As described earlier, these process devices are integrated to constitute the process unit 6. Process devices arranged around each of the image bearing members 3M, 3C and 3BK are integrated in a similar manner, so that four process units 6 are provided in the image forming apparatus. Further, in this example, the process unit 6 is constituted by a plurality of process devices. However, the number of process devices constituting the process unit 6 may be appropriately selected. For example, the process unit 6 may be constituted by one process device. Thus, a process unit may be constituted by at least one process device.

Figure 5:
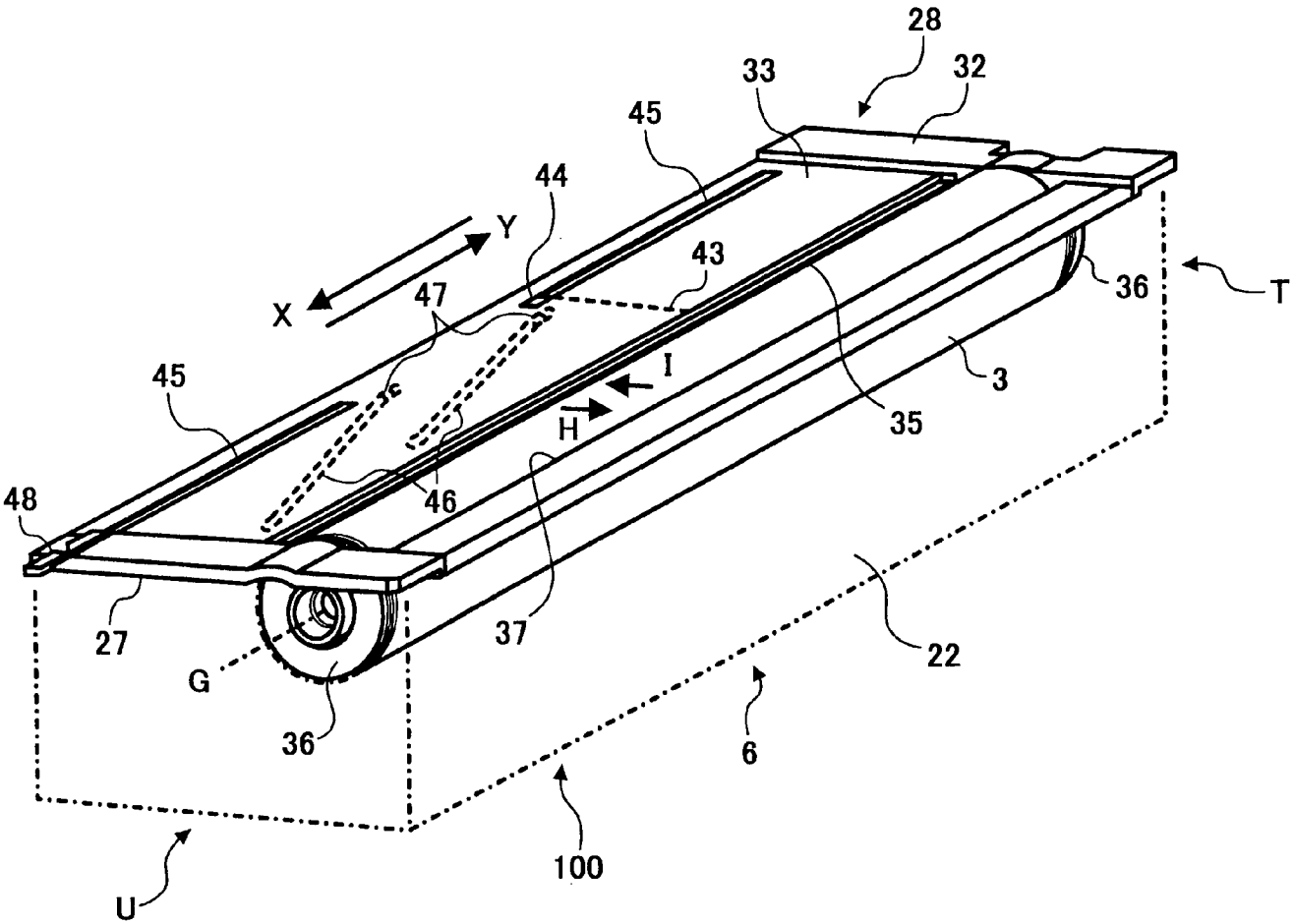
FIG. 5 is a perspective view of the image bearing member unit when the shutter is in an opened position.
Figure 6:
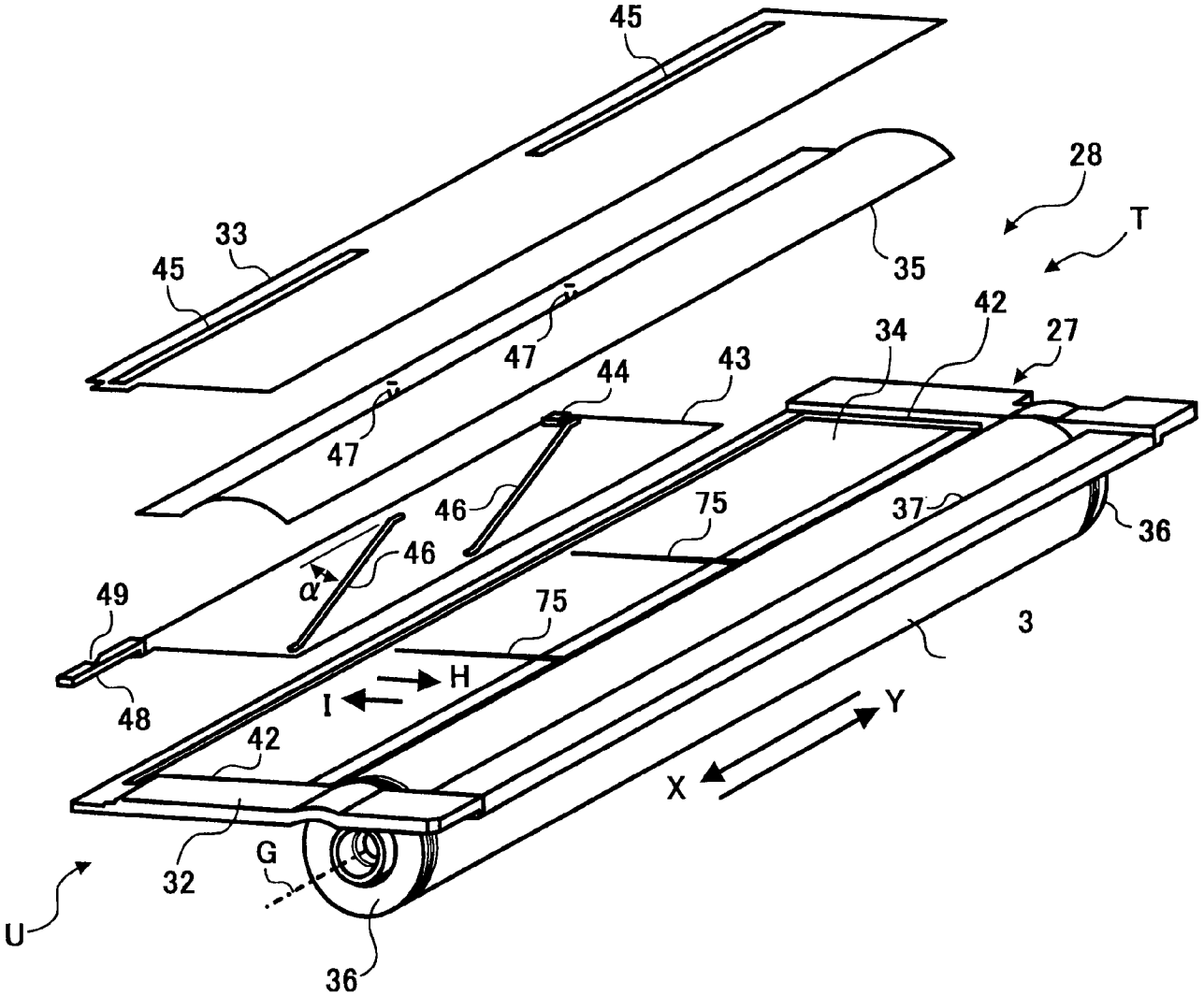
FIG. 6 is an exploded perspective view of the image bearing member unit.

Each image bearing member 3 is rotatably supported by the support member 27 as illustrated in FIG. 5 and in FIG. 6 also, and the image bearing member unit 28 is constituted by the image bearing member 3 and the support member 27 as described above. The support member 27 of the image bearing member unit 28 includes a support member main body 32 and a cover 33 detachably fixed to the support member main body 32. A housing space S (FIG. 2) is formed by the cover 33 and a support member main body part 34 opposing the cover 33, wherein a shutter 35 described later is housed. Axis parts at longitudinal end parts of the image bearing member 3 formed in a drum-like shape are rotatably supported by a pair of bearing parts 36 of the support member main body 32, respectively. An opening 37 is formed in the support member 27, and as illustrated in FIG. 2 the image bearing member 3 protrudes through the opening 27 to contact the intermediary transfer member 4.

In FIG. 5, with respect to the process unit 6, only the case 22 thereof is illustrated in a dot-dashed line. The process unit 6 and the image bearing member unit 28 are assembled with each other in a detachable manner. For example, by sliding the image bearing member unit 28 in an axial direction G of the image bearing member 3, the image bearing member unit 28 can be separated from the process unit 6. The process cartridge 100 is constituted, as described earlier, by the process unit 6 configured as described above and the image bearing member unit 28.

Figure 4:
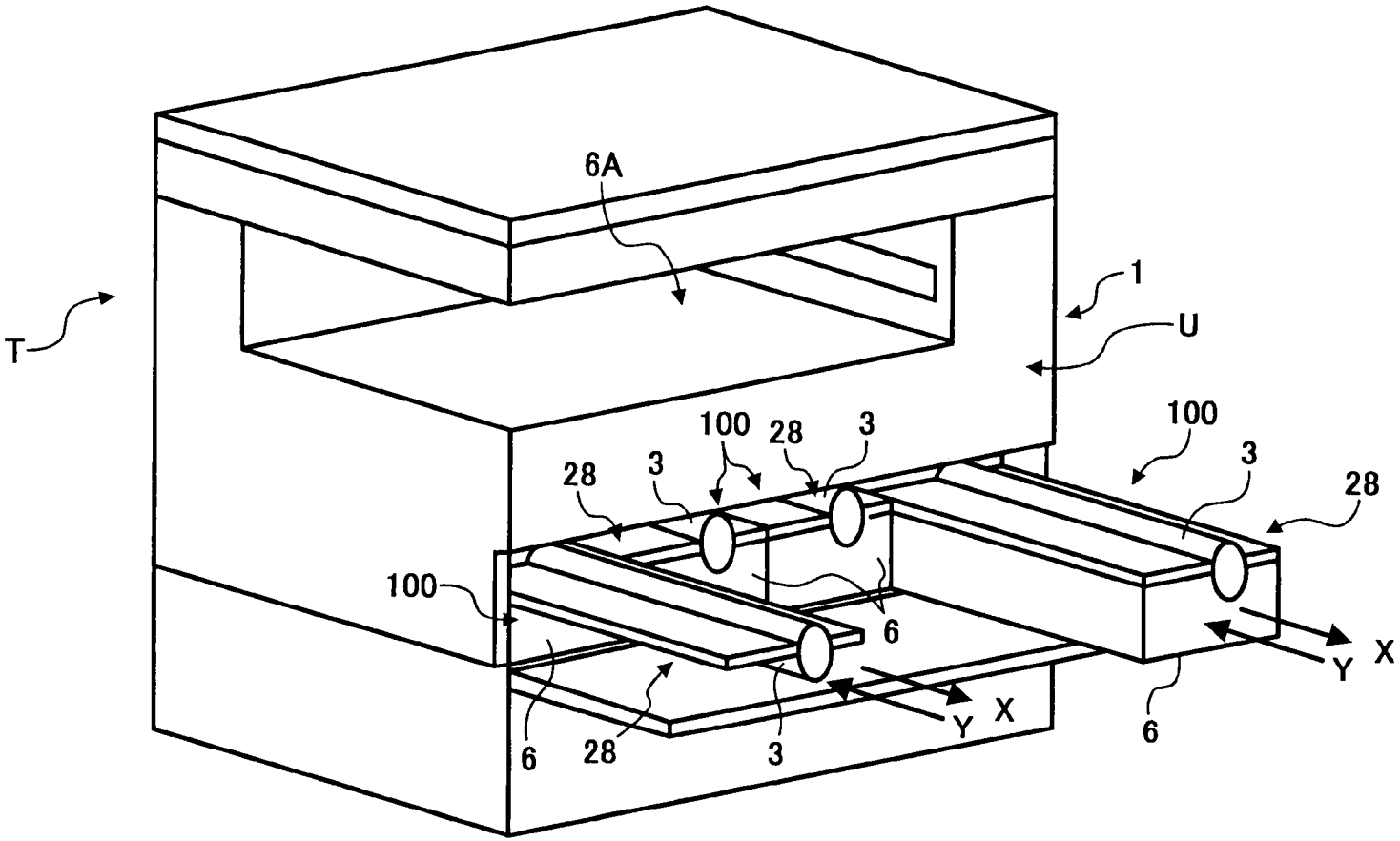
FIG. 4 is a perspective view illustrating an appearance of the image forming apparatus and a state that the image bearing member unit and the process unit are drawn out of or pushed into the main body of the image forming apparatus.

FIG. 4 is a perspective view illustrating an appearance of the image forming apparatus and a state that each image bearing member unit 28 and each process unit 6 are drawn out of or pushed into a main body 1 of the image forming apparatus. A symbol T indicates the backside of the main body 1 and a symbol U indicates the front side of the main body 1. Each image bearing member unit 28 and each process unit 6 are supported by guide rails (not illustrated) to be drawn out and to be pushed back, while being guided by the guide rails, in the direction of the front side U of the main body 1 indicated by an arrow X and in the direction of the backside T of the main body 1 indicated by an arrow Y, respectively, relative to the main body 1 of the image forming apparatus. In this example, the image bearing member unit 28 and the process unit 6 are drawn out in the axial direction of the image bearing member 3. The image bearing member unit 28 and the process unit 6 may be drawn out and pushed back together in the state that the image bearing member 28 and the process unit 6 are integrated as the process cartridge 100, in the direction of the front side U of the main body 1, indicated by the arrow X, to be taken out of the main body 1, and in the direction of the backside T of the main body 1, indicated by the arrow Y, to be set in a predetermined position inside of the main body 1. Further, it is possible to draw out only the image bearing member unit 28 in the direction of the front side U of the main body 1 while leaving the process unit 6 inside of the main body 1, and to push back the image bearing member unit 28 in the direction of the backside T of the main body 1 to be set in the main body 1. Furthermore, it is possible to draw out and push back only the process unit 6 relative to the main body 1 while leaving the image bearing member unit 28 inside of the main body 1. Thus, the image bearing member unit 28 and the process unit 6 can be individually attached to and detached from the main body 1 of the image forming apparatus. Therefore, repairing, checking and replacing the image bearing member unit 28 and the process unit 6 are relatively easy.

When drawing the image bearing member unit 28 and the process unit 6 set inside of the main body 1 of the image forming apparatus out of the main body 1, prior to starting an operation of drawing the image bearing member unit 28 and the process unit 6, the image bearing member unit 28 and the process unit 6 are moved downward a little bit so that the image bearing member 3 and the intermediary transfer member 4 are separated from each other and at the same time the process unit 6 is moved downward a little bit relative to the image bearing member unit 28. Thereby, when drawing the image bearing member unit 28, the process unit 6, or the process cartridge 100 in which the image bearing member unit 28 and the process unit 6 are assembled with each other, in the direction of the front side U of the main body 1, it never occurs that the image bearing member 3 and the intermediary transfer member 4 slide in contact with each other, or that the development roller 18, the charging roller 7 or the cleaning blade 21 of the process unit 6 slide in contact with the image bearing member 3, or that the shutter 35 which operates as described later contacts the intermediary transfer member 4, so that these units and devices are prevented from being damaged. When inserting the process unit 6 and the image bearing member unit 28 into the main body 1 to be set, the process unit 6 and the image bearing member unit 28 are inserted into the main body in the state that the process unit 6 and the image bearing member unit 28 are separated from each other. Subsequently, the process unit 6, the image bearing member unit 28, and the intermediary transfer member 4 come close to each other in an up-and-down direction, so that the image bearing member 3 contacts the intermediary transfer member 4 as illustrated in FIG. 2.

In the following description, the side of the image bearing member unit 28, where parts of the image bearing member unit 28, which are placed at the backside T of the main body 1 of the image forming apparatus when the image bearing member unit 28 is set in the main body 1 of the image forming apparatus, are located, is referred to as the backside of the image baring member unit 28, and the side of the image bearing member unit 28, where parts of the image bearing member unit 28, which are placed at the front side U of the main body 1 when the image bearing member unit 28 is set in the main body 1 of the image forming apparatus, are located, is referred to as the front side of the image bearing member unit 28.

As described above, in the image forming apparatus in this example, the image bearing member unit 28 is assembled with the process unit 6 including at least one process device used for forming a toner image on the image bearing member 3, in a freely detachable manner relative to the process unit 6, and the image bearing member unit 28 and the process unit 6 constitute the process cartridge 100. However, the image bearing member unit 28 and the process unit 6 may be differently configured in an appropriate manner. For example, by integrally forming the support member 27 of the image bearing member unit 28 and the case 22 of the process unit 6, the image bearing member unit 28 and the process unit 6 illustrated in FIG. 2 may be integrated to be the process cartridge 100 in which the image bearing member unit 28 and the process unit 6 cannot be separated from each other. Thus, an image bearing member unit and a process cartridge of the present invention may be configured in various manners. However, in any case, an image bearing member unit of the present invention includes an image bearing member on which a toner image is formed and a support member to support the image bearing member, and is configured to be drawn out of and put into the main body of an image forming apparatus. Further, a process cartridge of the present invention includes the above-described image bearing member unit and at least a process device used for forming a toner image on the image bearing member of the image bearing member unit, and is configured to be attached to the main body of an image forming apparatus in a detachable manner. It is preferable that the process cartridge is configured, as in the process cartridge 100 of this example, such that the image bearing member unit is detachable relative to a part of the process cartridge (in this example the process unit 6).

Figure 3:
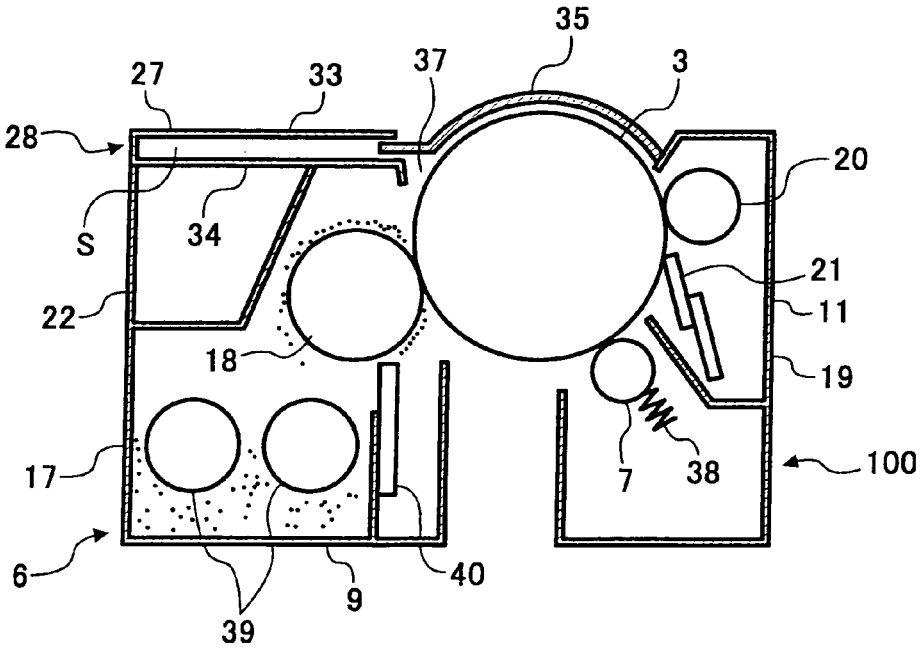
FIG. 3 is a cross section illustrating a state of the process cartridge when the process cartridge has been taken out of the main body of the image forming apparatus and a shutter of the image bearing member unit is in a closed position.

FIG. 2 and FIG. 5 illustrate states of the image bearing member unit 28 and the process unit 6 when these units are set in predetermined positions inside of the main body 1 of the image forming apparatus, and FIG. 3 illustrates states of the image bearing member unit 28 and the process unit 6 when these units have been taken out of the main body 1 of the image forming apparatus. In the image forming apparatus in this example, the shutter 35 is provided to the image bearing member unit 28 to cover and uncover the image bearing member 3 protruding through the opening 37 formed in the support member 27. When the image bearing member unit 28 has been taken out of the main body 1 of the image forming apparatus, if the image bearing member 3 protruding through the opening 37 formed in the support member 27 is directly exposed to light, the image bearing member 3 may be deteriorated. Further, if the image bearing member 3 is touched by a hand of a worker, the image bearing member 3 may be damaged or deteriorated. Therefore, in the image forming apparatus in this example, the shutter 35 is provided to the image bearing member unit 28 to protect the image bearing member 3 of the image bearing member unit 28 when the image bearing member unit 28 has been taken out of the main body 1 of the image forming apparatus. The shutter 35 is constituted by a thin plate member, which is made of, for example, resin such as polycarbonate, or metal.

Figure 7:
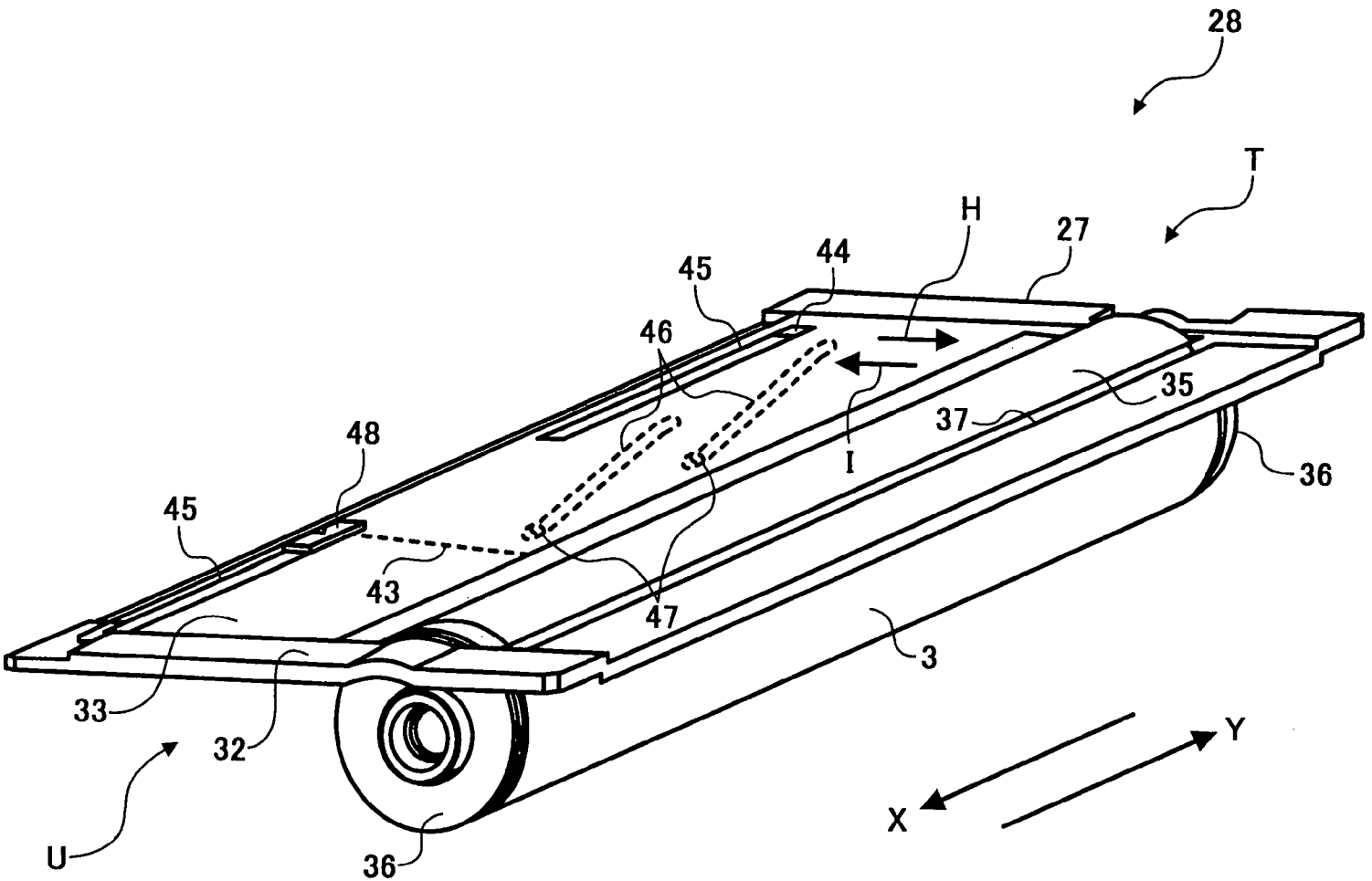
FIG. 7 is a perspective view of the image bearing member unit when the shutter is in the closed position.

As illustrated in FIG. 2 and FIG. 5, when the image bearing member unit 28 is loaded in a predetermined position inside of the main body 1 of the image forming apparatus, the shutter 35 is housed in the housing space S and is located in an opened position of the shutter 35 wherein the shutter 35 does not cover the image bearing member 3 protruding through the opening 37. Thereby, a toner image can be formed on the image bearing member 3 and the toner image can be transferred onto the intermediary transfer member 4, without any trouble. When the image bearing member unit 28 has been taken out of the main body 1 of the image forming apparatus, as illustrated in FIG. 3 and FIG. 7, the shutter 35 is drawn out of the housing space S in an arrow direction H (FIG. 7), and is located in a closed position wherein the shutter 35 covers the image bearing member 3 protruding through the opening 37 and the opening 37 of the support member 27 is closed. Thereby, the image bearing member 3 is prevented from being directly exposed to the external light. Further, it is prevented that a hand of a worker touches the image bearing member 3. Thus, the image bearing member 3 of the image bearing member unit 28 which has been taken out of the main body 1 of the image forming apparatus can be effectively protected. When the image bearing member unit 28 is set in a predetermined position inside of the main body 1 after repairing and/or checking work to the image bearing member unit 28 have been performed, the shutter 35 moves to an arrow direction I to be loaded in the housing space S, and at this time the image bearing member 3 protruding through the opening 37 is uncovered.

When the shutter 35 moves between the opened position and the closed position as described above, the shutter 35 moves in the arrow directions H and I which are substantially perpendicular to the directions X and Y in which the image bearing member unit 28 is drawn out of and put into the main body 1 of the image forming apparatus. That is, the shutter 35 does not rotate between the opened position and the closed position, but instead moves almost in the same plane between the opened position and the closed position. Thus, the shutter 35 is assembled with the support member 27 to move in the directions H and I, which are substantially perpendicular to the directions X and Y in which the image bearing member unit 28 is drawn out of and put into the main body 1 of the image forming apparatus, so that the shutter 35 is located in the closed position wherein the shutter 35 covers the image bearing member 3 when the image bearing member unit 28 has been taken out of the main body 1 of the image forming apparatus and is located in the opened position wherein the shutter 35 does not cover the image bearing member 3 when the image bearing member unit 28 has been set in a predetermined position inside of the main body 1.

Further, as illustrated in FIG. 6, a guide part 42 formed in a shape like a step is provided to the support member 27, and the shutter 35 is guided by the guide part 42 to move in the directions H and I substantially perpendicular to the directions X and Y in which the image bearing member unit 28 is drawn out of and put into the main body 1. In the example illustrated in FIG. 6, the directions H and I in which the shutter 35 are operated to move are directions substantially perpendicular to the axial direction G of the image bearing member 3 formed in a drum-like shape. Thereby, an operating stroke of the shutter 35 that is necessary for covering and uncovering the image bearing member 3 protruding through the opening 37 by the shutter 35 can be made relatively small.

Further, as described later, the shutter 35 is configured to move to the opened position and to the closed position in conjunction with an attaching and detaching operation of the image bearing member unit 28 relative to the main body 1 of the image forming apparatus.

As described above, the shutter 35 is configured to move almost in the same plane in the directions H and I, which are substantially perpendicular to the directions X and Y in which the image bearing member unit 28 is drawn out of and put into the main body 1 of the image forming apparatus, to be brought in the closed position or the opened position. Thereby, an operation space of the shutter 35 can be made relatively small as compared with a case wherein the shutter 35 is rotated. Furthermore, even if other elements are near the image bearing member unit 28, the shutter 35 can move between the opened position and the closed position without interfering with such elements. In the image forming apparatus of the above-described example, the intermediary transfer member 4 is located immediately above the image bearing member unit 28. However, the shutter 35 can be operated without interfering with the intermediary transfer member 4.

In the example illustrated in figure, when the shutter 35 is located in the closed position, the shutter 35 covers an upper part of the circumferential surface of the image bearing member 3, and when the shutter 35 is located in the opened position, the upper part of the circumferential surface of the image bearing member 3 is uncovered. However, it is possible to configure the shutter 35 such that when the shutter 35 is located in the closed position, the shutter 35 covers other parts of the circumferential surface of the image bearing member 3, for example, a right or left side part or a lower part of the circumferential surface of the image bearing member 3, or a plurality of parts among the upper part, the left side part, the right side part and the lower part of the circumferential surface of the image bearing member 3, or the whole part of the circumferential surface of the image bearing member 3. That is, the shutter 35 may be configured to cover at least a part of the circumferential surface of an image bearing member when the shutter 35 is located in the closed position.

Now, a mechanism to move the shutter 35 to the opened or closed position in conjunction with an operation of attaching or detaching the image bearing member unit 28 to or from the main body 1 of the image forming apparatus is described.

In the example illustrated in FIG. 5 through FIG. 7, as illustrated in FIG. 6, a guide member 43, which is constituted by for example a thin plate member, is arranged between the shutter 35 and the support member main body part 34 of the support member 27. A guide protrusion 44 formed in the guide member 43 and a root part of an engaging part 48 described later are slidably engaged with guide slots 45 formed in the cover 33, respectively. These guide slots 45 extend in directions substantially parallel to the directions X and Y in which the image bearing member unit 28 is drawn out of and put into the main body 1 of the image forming apparatus. Thereby, the guide member 43 is assembled with the support member 27 such that the guide member 43 moves in directions substantially parallel to the directions X and Y in which the image bearing member unit 28 is drawn out of and put into the main body 1 of the image forming apparatus. Alternatively, it may be configured such that guide slots are formed in the guide member 43, and guide protrusions, which engage with the guide slots, are formed at the side of the support member 27.

Two guide slots 46 extending in directions slanted relative to the directions X and Y in which the image bearing member unit 28 is drawn out of and put into the main body 1 of the image forming apparatus are formed in the guide member 43, and guide protrusions 47 provided to the shutter 35 are slidably engaged with the guide slots 46. An angle $\alpha$ formed by each of the guide slots 46 and the directions X and Y is greater than 0 and smaller than 90°. Further, two guide grooves 75 are formed in the support member main body part 34 of the support member 27, extending in directions substantially perpendicular to the directions X and Y in which the image bearing member unit 28 is drawn out of and put into the main body 1. The guide protrusions 47 penetrating through the guide slots 46 are slidably engaged with the guide groove 75, respectively.

Figure 8:
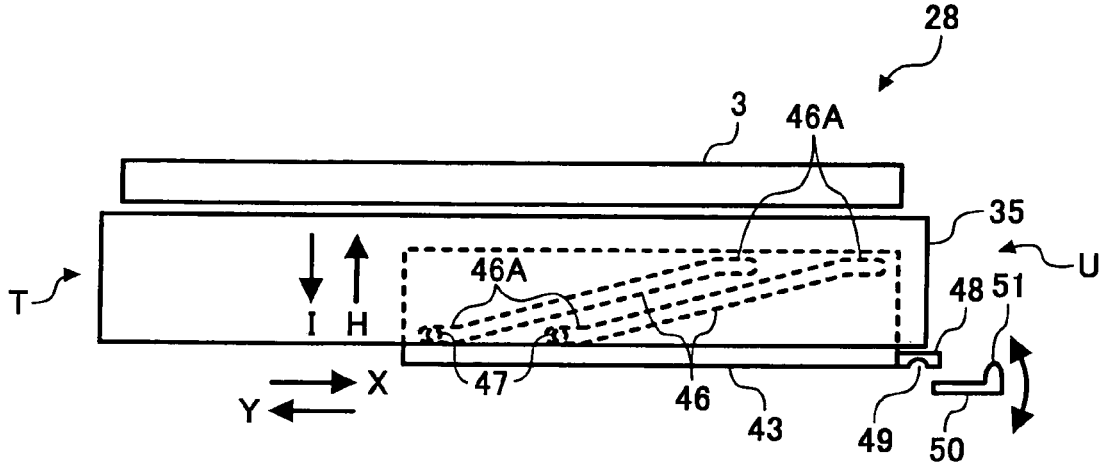
FIG. 8 is a diagram for explaining a positional relation among a guide member, the shutter, and an image bearing member of the image bearing member unit when the image bearing member unit is set in the main body of the image forming apparatus and the shutter is in the opened position.
Figure 9:
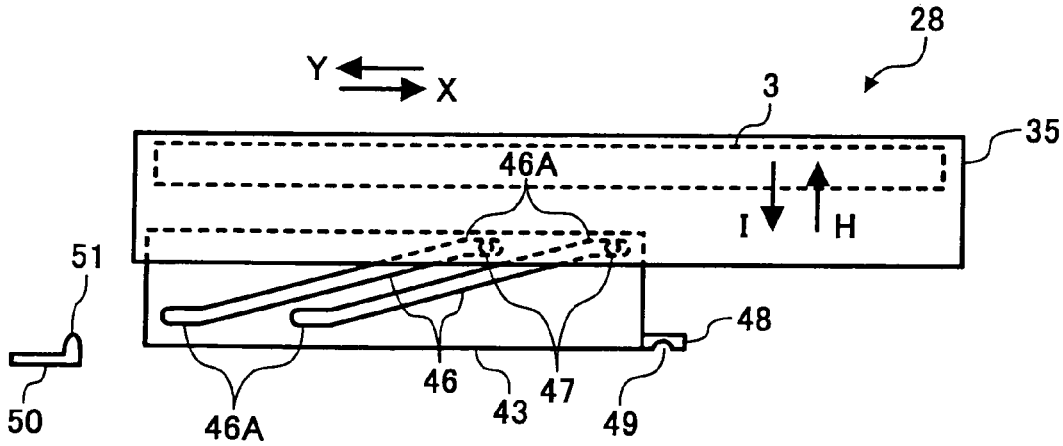
FIG. 9 is a diagram for explaining a positional relation among the guide member, the shutter, and the image bearing member when the image bearing member unit has been drawn out of the main body of the image forming apparatus in the direction of the front side of the main body and the shutter is in the closed position.

FIG. 5 illustrates the image bearing member unit 28 when the image bearing member unit 28 is set in the predetermined position inside of the main body 1 of the image forming apparatus, and FIG. 8 is a diagram for explaining a positional relation among the guide member 43, the shutter 35, and the image bearing member 3 at this time. Similarly, FIG. 9 is a diagram for explaining a positional relation among the guide member 43, the shutter 35, and the image bearing member 3 when the image bearing member unit 28 has been drawn out of the main body 1 toward the front side U of the main body 1. In the states of the image bearing member unit 28 illustrated in FIG. 5 and FIG. 8, the guide protrusion 44 and the engaging part 48 are located at end parts of the guide slots 45 at the front side U (FIG. 5), and the guide protrusions 47 are located at end parts of the guide slots 46 at the back side T (FIG. 5 and FIG. 8).

Further, the above-described engaging part 48 is provided to a part of the guide member 43 at the front side U. In this example, an engaging groove 49 (FIG. 6) is formed in the engaging part 48. If a user or a service personnel starts to draw the image bearing member unit 28 in the state illustrated in FIG. 5 and FIG. 8 in the direction X of the front side U, the whole part of the image bearing member unit 28 including the guide member 43 starts to move in the direction X. When the image bearing member unit 28 has moved by a certain distance, the engaging groove 49 of the engaging part 48 provided to the guide member 43 engages with a counterpart engaging part 50 provided inside of the main body 1. The counterpart engaging part 50 is formed in an arm-like shape and is deformable in directions indicated by arrows in FIG. 8. When the engaging part 48 hits a tip end pin 51 of the counterpart engaging part 50, the counterpart engaging part 50 is elastically deformed, and subsequently the counterpart engaging part 50 elastically returns to its original state so that the tip end pin 51 is engaged with the engaging groove 49. Thereby, the guide member 43 is stopped relative the main body 1. On the other hand, other parts of the image bearing member unit 28 continue to move in the direction X of the front side U, so that the guide member 43, which has been stopped, relatively moves in the direction Y of the backside T relative to the support member 27 and the shutter 35. Thereby, the guide protrusions 47 provided to the shutter 35 slidably move in the guide slots 46 while being guided by the guide slots 46. The guide protrusions 47 finally reach parts of the guide slots 46 at the front side U as illustrated in FIG. 7 and FIG. 9, and the guide protrusion 44 contacts an end part of the guide hole 45 at the backside T. Thereby, the guide member 43 is drawn by the support member 27 in the direction X of the front side U, so that the guide groove 49 is disengaged from the tip end pin 51 of the counterpart engaging part 50. The guide member 43 moves again in the direction X of the front side U together with the support member 27, so that the whole part of the image bearing member unit 28 is drawn out of the main body 1 of the image forming apparatus. FIG. 7 and FIG. 9 illustrate states of the image bearing member unit 28 at this time. The counterpart engaging part 50 may be provided directly to the main body 1 of the image forming apparatus or to a frame (not shown) supporting the intermediary transfer member 4.

As described above, the guide member 43 relatively moves in the direction of the backside T relative to the support member 27, and the guide protrusions 47 slidably move in the guide slots 46 that slantingly extend. Accordingly, the shutter 35 moves toward a position above the image bearing member 3 as indicated by an arrow H, and stops upon reaching the closed position wherein the shutter 35 covers the upper part of the image bearing member 3. When the image bearing member unit 28 is pushed in the direction Y of the backside T, an operation opposite the one described above is performed. The shutter 35 moves in an arrow direction I to reach the opened position illustrated in FIG. 5 and FIG. 8, wherein the upper part of the image bearing member 3 is uncovered. Thus, the guide protrusions 47 provided to the shutter 35 are slidably engaged with the guide slots 46 formed in the guide member 43 such that the shutter 35 moves to the closed and opened positions when the guide member 43 moves in a direction substantially parallel to the directions X and Y in which the image bearing member unit 28 is drawn out of and put into the main body 1 of the image forming apparatus. Thereby, the shutter 35 can be automatically operated to move between the opened and closed positions in conjunction with an operation of attaching and detaching the image bearing member unit 28 to and from the main body 1 of the image forming apparatus.

Furthermore, in the image forming apparatus of this example, the engaging part 48, which causes the guide member 43 to be stopped relative to the main body 1 when drawing and putting the image bearing member unit 28 out of and into the main body 1 in cooperation with the counterpart engaging part 50 located inside of the main body 1, is provided to the guide member 43, and by a cooperating operation between the engaging part 48 and the counterpart engaging part 50, the guide member 43 is stopped relative to the main body 1, and the support member 27, the image bearing member 3, and the shutter 35 are moved in the directions X and Y in which the image bearing member unit 28 is drawn out of and put into the main body 1, and thereby the shutter 35 is moved to the opened and closed positions. Therefore, the shutter 35 can be operated to move between the opened and closed positions relatively reliably.

In the illustrated example, two guide slots 46 are provided. However, the number of guide slots may be one. By providing two guide slots 46 to the guide member 43 and by slidably engaging the guide protrusions 47 with the guide slots 46 respectively, the shutter 35 can be operated more reliably.

Further, as illustrated in FIG. 8 and FIG. 9, parts of the guide slots 46, where the guide protrusions 47 engage with the guide slots 46 when the shutter 35 are located in the opened and closed positions, and parts near such parts of the guide slots 46 (respectively denoted by reference symbols 46A in FIG. 8 and FIG. 9) extend in directions substantially parallel to the directions X and Y in which the image bearing member unit 28 is drawn out of and put into the main body 1. Thereby, friction given to the shutter 35 when the shutter 35 starts to operate can be decreased, so that the shutter 35 can start operating relatively smoothly.

Further, in the image forming apparatus of this example, the engaging part 48 including the engaging groove 49 and the counterpart engaging part 50 including the tip end pin 51 which engages with the engaging groove 49 are used. Instead of mechanically engaging the engaging part 48 and the counterpart engaging part 50 with each other, it may be configured such that the engaging part 48 is held with a magnetic force relative to the counterpart engaging part 50 by constituting the engaging part 48 and the counterpart engaging part 50 by a combination of a magnet and a magnetic member or by magnets. Thereby, the guide member 43 is stopped relative to the main body 1 of the image forming apparatus and the shutter 35 is operated to move to the opened and closed positions substantially in the same manner as described above.

Figure 10:
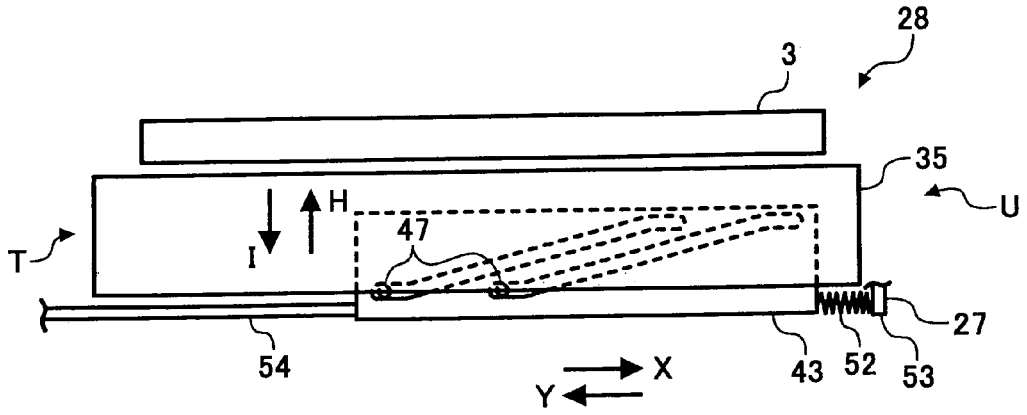
FIG. 10 is a diagram of another image bearing member unit having another mechanism for moving the shutter to the closed and opened positions, explaining a positional relation among the guide member, the shutter, and the image bearing member of the image bearing member unit when the image bearing member unit is set in the main body of the image forming apparatus and the shutter is in the opened position.
Figure 11:
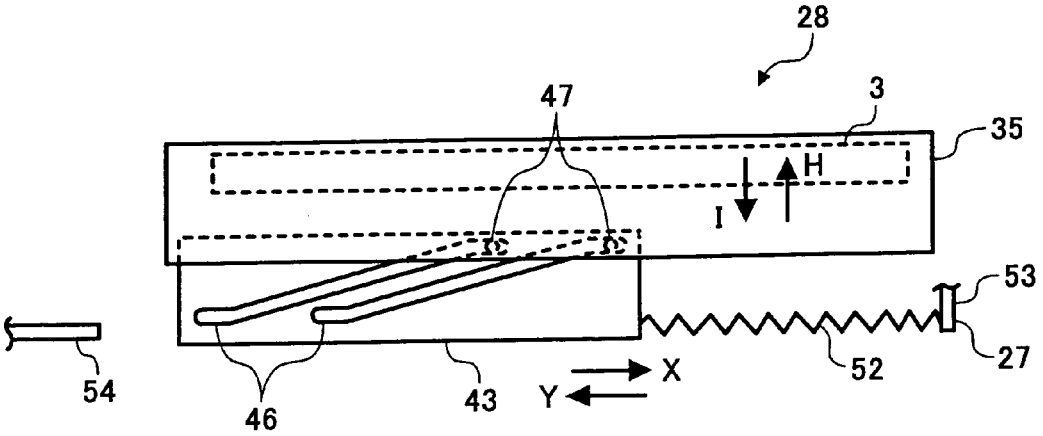
FIG. 11 is a diagram for explaining a positional relation among the guide member, the shutter, and the image bearing member of the another image bearing member unit having another mechanism for moving the shutter to the closed and opened positions, when the another image bearing member unit has been drawn out of the main body of the image forming apparatus and the shutter is in the closed position.

Furthermore, instead of providing the above-described engaging part 48 and the counterpart engaging part 50, as illustrated in FIG. 10 and FIG. 11, a compressed spring 52 as an example of a pressing member may be provided to contact the guide member 43 at one end thereof and to contact a spring receiver 53, which is provided to the support member 27 in a protruding manner, at the other end thereof. The guide member 43 is pressed by the compressed spring 52 in a direction substantially parallel to the direction Y in which the image bearing member unit 28 is put into the main body 1. As illustrated in FIG. 11, when the image bearing member unit 28 has been drawn out of the main body 1, the guide member 43 is pressed by the compressed spring 52 to the backmost position in the direction Y in which the image bearing member unit 28 is put into the main body 1, relative to the support member 27. Thereby, the shutter 35 is held in the closed position wherein the shutter 35 covers the upper part of the image bearing member 3, substantially in the same manner as in the case illustrated in FIG. 9.

A stopper 54 is provided inside of the main body 1, and if the image bearing member unit 28 is moved in the direction Y of the backside T, as illustrated in FIG. 10 the guide member 43 hits the stopper 54 to be stopped relative to the main body 1. When the image bearing member unit 28 is further pushed in the direction Y of the backside T, the stopped guide member 43 is relatively moved in the direction X of the front side U relative to the shutter 35, so that the shutter 35 moves toward the opened position. As illustrated in FIG. 10, when the image bearing member unit 28 is set in the predetermined position inside of the main body 1, as in the case illustrated in FIG. 8 the shutter 35 is located in the opened position and the upper part of the image bearing member 3 is uncovered. Configuration of other parts of the image bearing member unit 28 illustrated in FIG. 10 and FIG. 11 is substantially the same as the one of the image bearing member unit 28 previously described.

As described above, a pressing member to press the guide member 43 in the direction substantially parallel to the direction in which the image bearing member unit 28 is pushed relative to the main body 1 of the image forming apparatus is provided, and when the image bearing member unit 28 has been taken out of the main body 1, by the function of the pressing member, the guide member 43 is pressed to the most backside position in the direction Y in which the image bearing member unit 28 is pushed relative to the support member 27 so that the shutter 35 is held in the closed position, and when the image bearing member unit 28 is pushed into the main body 1, the guide member 43 is caused to be stopped relative to the main body 1, while resisting against the function of the pressing member, by the stopper 54 provided at the side of the main body 1, and thereby the shutter 35 is moved to the opened position. With this configuration also, the shutter 35 can be operated to be moved to the closed and opened positions in conjunction with an operation of attaching and detaching the image bearing member unit 28 to and from the main body 1. The stopper 54 is provided directly to the main body 1 of the image forming apparatus in this example, however, may be provided to a frame supporting the intermediary transfer member 4.

It has been confirmed by experiments performed using the image bearing member unit 28, in which the shutter 35 and the guide member 43, made by polycarbonate in 0.4 mm thickness, are housed in the housing space S having the depth of 1.5 mm in the up-and-down direction, that the shutter 35 can be operated to move to the opened and closed positions without any problem.

Now, another mechanism to move the shutter 35 to the closed or opened position in conjunction with an operation of attaching and detaching the image bearing member unit 28 to and from the main body 1 of the image forming apparatus is described with reference to FIG. 12 and FIG. 13.

Figure 12:
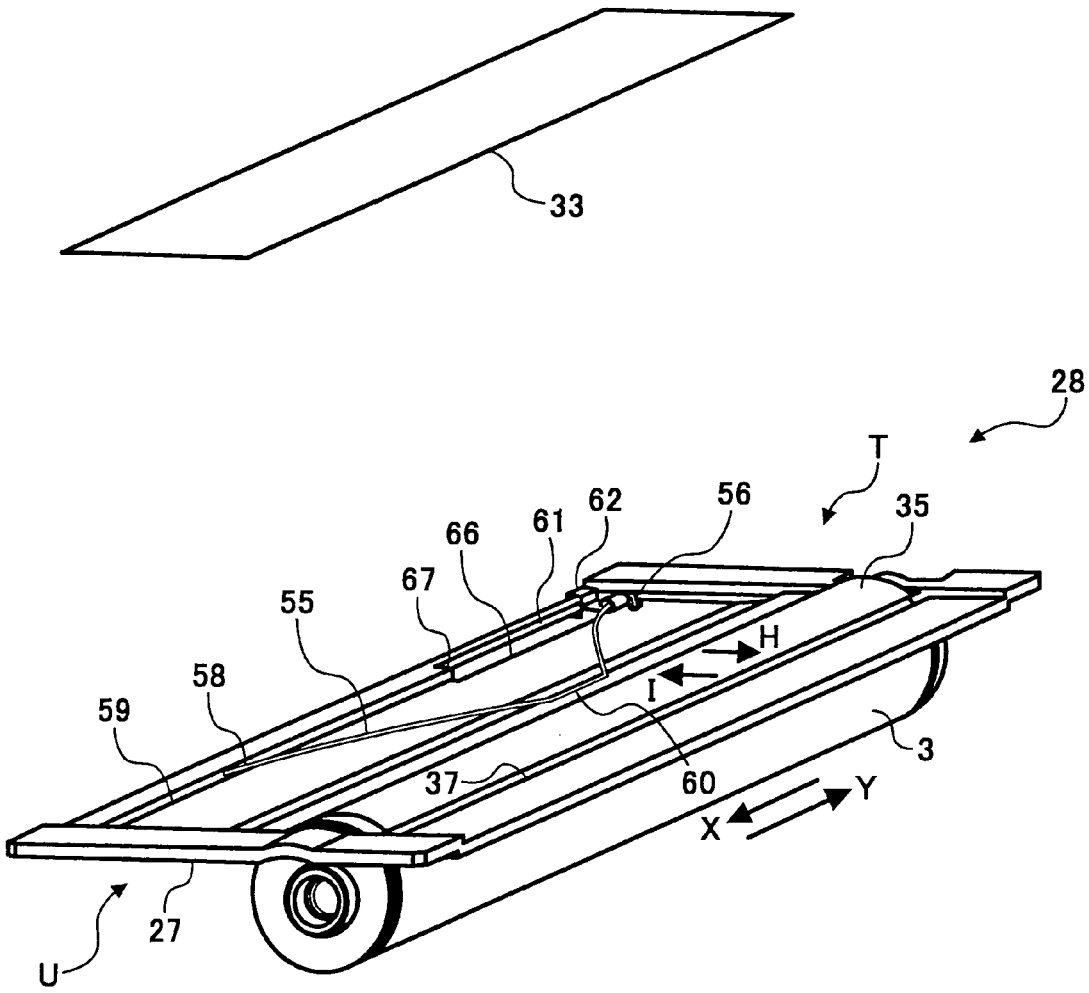
FIG. 12 is a perspective view of another image bearing member unit in a state that a cover has been removed from a support member.
Figure 13:
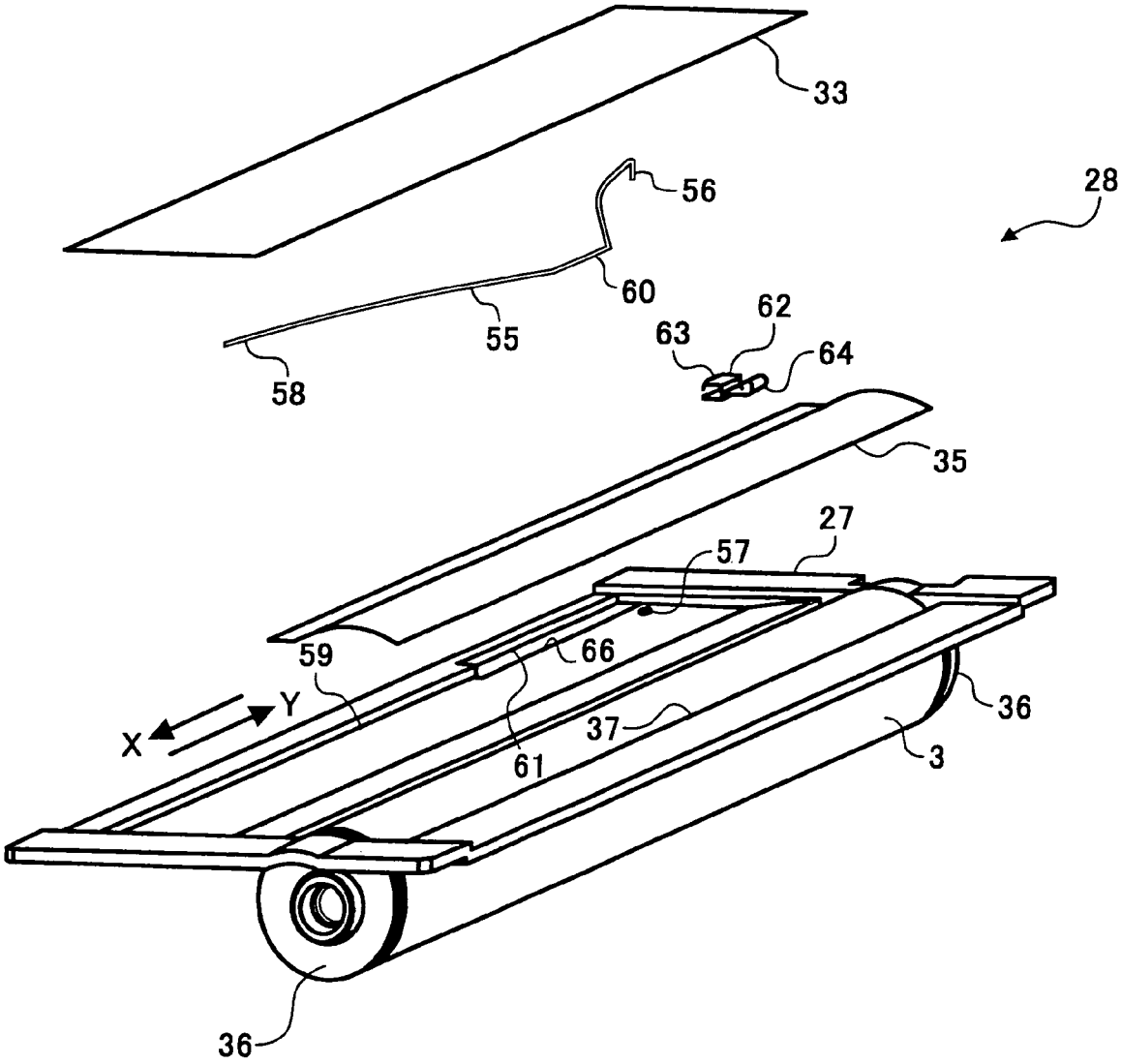
FIG. 13 is an exploded perspective view of the another image bearing member unit of FIG. 12.

In the example illustrated in FIG. 12 and FIG. 13, one end side 56 of a wire spring 55 is engaged with an engaging hole 57 formed in the support member 27, and thereby the wire spring 55 is fixed to the support member 27. A guide surface 59 is formed in the support member 27 extending in a direction substantially parallel to the directions X and Y in which the image bearing member unit 28 is drawn out of and put into the main body 1 of the image forming apparatus. The other end side 58 of the wire spring 55 is in contact with the support member 27 to freely slide. Thus, the other end side 58 of the wire spring 55 contacts the support member 27 to freely slide in directions substantially parallel to the directions X and Y in which the image bearing member unit 28 is drawn out of and put into the main body 1. The wire spring 55 is engaged with or fixed by welding or by an adhesive to the shutter 35 at a middle part 60 thereof between the one end side 56 and the other end side 58. The middle part 60 of the wire spring 55 fixed to the shutter 35 protrudes from a position of the one end part 56 and the other end part 58 in the direction in which the shutter 35 moves when the shutter 35 moves to the closed position, i.e., in the arrow direction H.

Further, a slider 62 is slidably engaged with an edge part 61 of a slot 66 formed in the support member 27 to extend in a direction substantially parallel to the directions X and Y in which the image bearing member unit 28 is drawn out of and put into the main body 1. The slider 62 includes, as illustrated in an enlarged view of FIG. 14, a horseshoe part 63 and a curl part 64 integrally formed with the horseshoe part 63. The horseshoe part 63 is slidably engaged with the edge part 61 of the slot 66, and the wire spring 55 is engaged with and held by the curl part 64 to slide in an axial direction of the curl part 64. Thus, the slider 62 holds the wire spring 55 to slidably move, and is assembled with the support member 27 to slidably move in the directions substantially parallel to the directions X and Y in which the image bearing member unit 28 is drawn out of and put into the main body 1 of the image forming apparatus.

Figure 15:
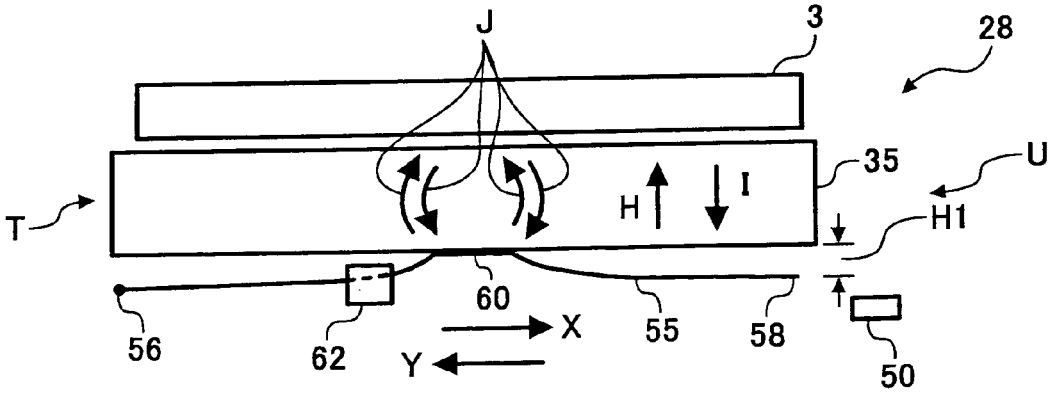
FIG. 15 is a diagram for explaining a positional relation among a spring wire, the slider, the shutter, and the image bearing member when the another image bearing member unit of FIG. 12 is set in a predetermined position inside of the main body of the image forming apparatus.
Figure 16:
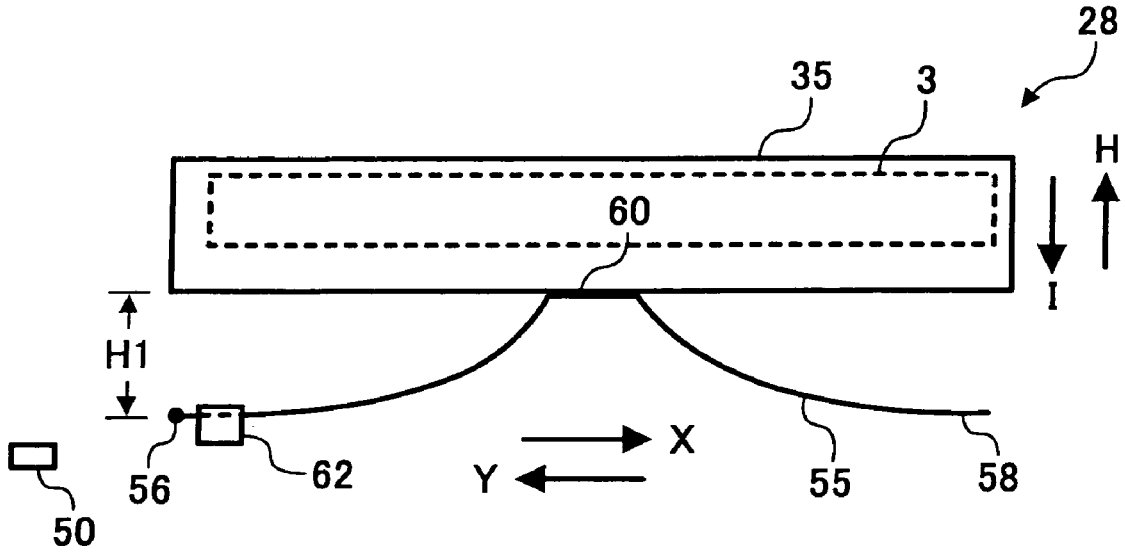
FIG. 16 is a diagram for explaining a positional relation among the spring wire, the slider, the shutter, and the image bearing member when the another image bearing member unit of FIG. 12 has been drawn out of the main body of the image forming apparatus.

FIG. 15 and FIG. 16 illustrate positional relations among the wire spring 55, the slider 62, the shutter 35, and the image bearing member 3 when the image bearing member unit 28 is in the predetermined position inside of the main body 1 and when the image bearing member unit 28 has been taken out of the main body 1, respectively. In these figures, a protruding height of the wire spring 55, i.e., a height of the middle part 60 of the wire spring 55 from the position of the one end part 56 and the other end part 58, is indicated by a reference symbol H1.

In this example also, the counterpart engaging part 50 is arranged inside of the main body 1, and the counterpart engaging part 50 and the slider 62 are engaged with each other. The counterpart engaging part 50 may be configured to include the tip end pin 51 as in the example illustrated in FIG. 8 and FIG. 9 so that the tip end pin 51 is engaged with an engaging groove (not shown) formed in the slider 62. However, in the example illustrated in FIG. 15 and FIG. 16, one of the slider 62 and the counterpart engaging part 50 is constituted by a magnet and the other of the slider 62 and the counterpart engaging part 50 is constituted by a magnetic member. The slider 62 and the counterpart engaging part 50 may be both constituted by magnets.

As illustrated in FIG. 15, when the image bearing member unit 28 is set inside of the main body 1, the slider 62 is engaged with the wire spring 55 at a part near the middle part 60 of the spring wire 55. Thereby, an external force is applied to the wire spring 55 by the slider 52, so that the wire spring 55 is elastically deformed, decreasing the protruding height H1, and the shutter 55 fixed to the wire spring 55 is placed in the opened position retreated from a position above the image bearing member 3. If the image bearing member unit 28 is started to be drawn in the direction X of the front side U at this time, the whole part of the image bearing member unit 28 including the slider 62 moves in the direction of the front side U. Subsequently, when the slider 62 has moved to the position wherein the slider 62 opposes the counterpart engaging part 50, the slider 62 and the counterpart engaging part 50 are connected with each other by a magnetic force, and the slider 62 is stopped to move. Thereafter, the image bearing member unit 28 except the slider 62 moves in the direction X of the front side U, so that the slider 62 relatively moves toward the one end side 56 of the wire spring 55. That is, the slider 62 relatively moves in the direction Y of the backside T relative to the wire spring 55. Thereby, as illustrated in FIG. 16, the wire spring 55 is deformed while being elastically returned, gradually increasing the protruding height H1, and the shutter 35 is moved in the direction H toward the position above the image bearing member 3. Subsequently, when the slider 62 reaches the one end part 56 of the wire spring 55 fixed to the support member 27, an external force is given to the slider 62 via the spring wire 55 in the direction X of the front side U, so that the slider 62 is separated from the counterpart engaging part 50 while resisting against the magnetic force, and the image bearing member unit 28 is drawn out of the main body 1 as illustrated in FIG. 12 and FIG. 16. At this time, the shutter 35 is in the closed position wherein the shutter 35 covers the upper part of the image bearing member 3.

If the image bearing member unit 28 in the state illustrated in FIG. 16 is pushed into the main body 1 and is moved in the direction Y of the backside T, an operation opposite the one described above is performed. That is, the slider 62 is connected with the counterpart engaging part 50 by a magnetic force to be stopped. Subsequently, if the image bearing member unit 28 except the slider 62 is pushed in the direction Y of the backside T, the slider 62 is slidably moved in the direction X of the front side U relative to the wire spring 55. Thereby, the wire spring 55 is elastically deformed, decreasing the protruding height H1, so that the shutter 35 starts to move toward the opened position in the direction I. When the slider 62 reaches the part near the middle part 60 of the wire spring 55, the slider 62 hits a front side end part 67 of the hole 66 illustrated in FIG. 12. Thereby, the slider 62 separates from the counterpart engaging part 50, and the whole part of the image bearing member unit 28 including the slider 62 is set in the predetermined position inside of the main body 1 illustrated in FIG. 15. At this time, the shutter 35 is in the opened position, and the upper part of the image bearing member 3 is uncovered.

As described above, the relative positional relation among the slider 62, the wire spring 55, and the shutter 35 is set such that the slider 62 slidably moves, relative the wire spring 55, in the directions substantially parallel to the directions X and Y in which the image bearing member unit 28 is drawn out of and put into the main body 1, deforming the wire spring 55, and thereby the shutter 35 is moved to the opened or closed position.

In the illustrated example, when the image bearing member unit 28 is drawn out of and put into the main body 1 of the image forming apparatus, the slider 62 is topped relative to the main body 1 by an cooperative operation with the counterpart engaging part 50 located inside of the main body 1, and the shutter 35 is moved to the closed or opened position by stopping the slider 62 relative to the main body 1 and by moving the support member 27, the image bearing member 3, the shutter 35, and the wire spring 55 in the directions X and Y in which the image bearing member unit 28 is drawn out of and put into the main body 1, thereby deforming the wire spring 55, and furthermore, the slider 62 is stopped relative to the main body 1 by holding the slider 62 relative to the counterpart engaging part 50 by a magnetic force. Thus, the shutter 35 is brought into the closed position and the opened position by a relatively simple configuration.

Further, in the illustrated example, the slider 62 is slidably assembled with a part of the wire spring 55 between the one end part 56 of the wire spring 55, that is engaged with the support member 27 of the image bearing member unit 28, and the middle part 60 of the wire spring 55, that is fixed to the shutter 35. Therefore, a problem that the shutter 35 sways in directions indicated by arrows J in FIG. 15 when the slider 62 slidably moves relative to the wire spring 55 is prevented, so that the shutter 35 can be moved in a stable state between the closed and opened positions.

Furthermore, as illustrated in FIG. 16, the part of the wire spring 55, which is slidably assembled with the slider 62, is curved to protrude in the direction I in which the shutter 35 is moved toward the opened position. Therefore, when the slider 62 slidably moves relative to the wire spring 55 toward the middle part 60 of the wire spring 5, the wire spring 55 is deformed always in a constant direction. Thereby also, the problem that the shutter 35 sways in the arrow directions J can be prevented.

Figure 14:
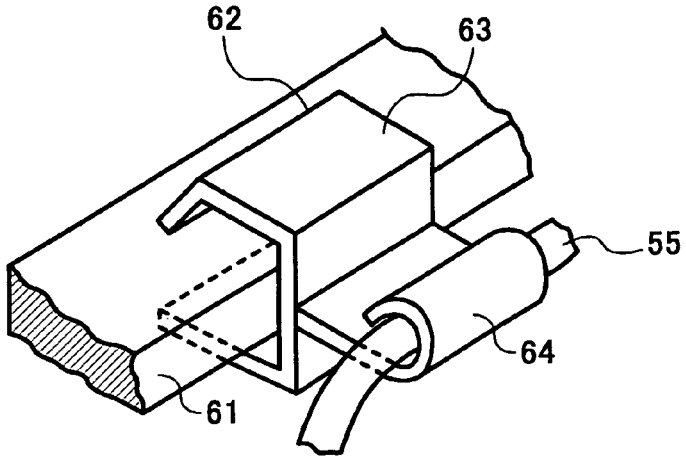
FIG. 14 is an enlarged perspective view of a slider of the another image bearing member unit of FIG. 12.

Furthermore, because a guide part of the slider 62 that holds the wire spring 55, i.e., the curl part 64 illustrated in FIG. 14, extends substantially in parallel to the directions in which the slider 62 slidably moves, when the slider 62 relatively moves toward the middle part 60 of the wire spring 55, parts of the wire spring 55 at both sides of the middle part 60 can be symmetrically deformed. With such configuration also, the shutter 35 can be prevented from being swayed in the arrow directions J.

Figure 17:
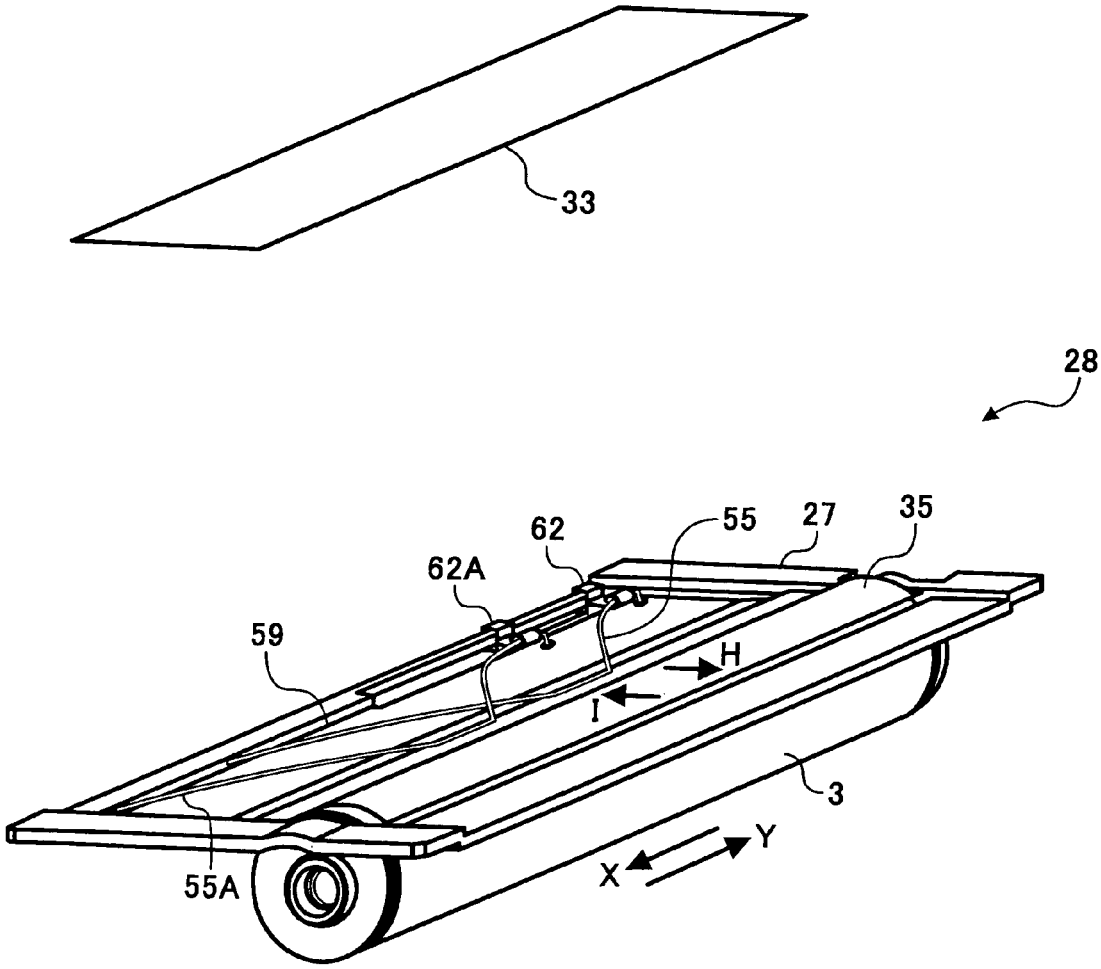
FIG. 17 is a perspective view of another image bearing member unit in which two pieces of spring wires are provided.
Figure 18:
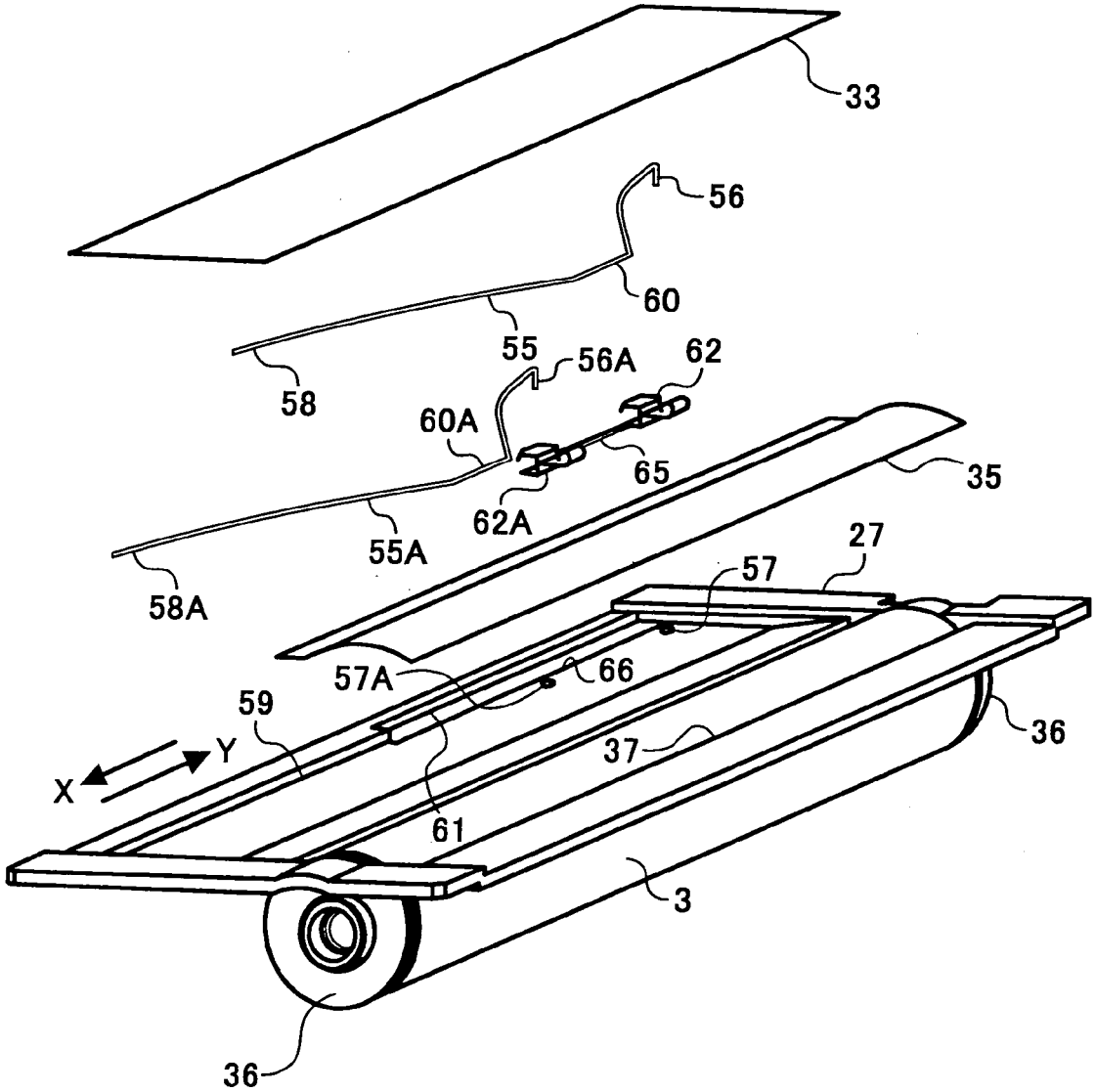
FIG. 18 is an exploded perspective view of the another image bearing member unit of FIG. 17.

In the example illustrated in FIG. 12 through FIG. 16, one piece of the wire spring 55 and one piece of the slider 62 are provided. However, plural pieces of the wire spring 55 and the slider 62 may be provided, respectively. FIG. 17 and FIG. 18 illustrate an example in which an additional wire spring 55A is provided in addition to the wire spring 55 and in which an additional slider 62A is slidably assembled with the additional wire spring 55A. In the illustrated example, the slider 62 and the additional slider 62A are integrally connected with each other by a connect member 65. The operations of the additional wire spring 55A and the additional slider 62A are substantially the same as those of the wire spring 55 and the slider 62. By regulating movement of the shutter 35 using a plurality of springs, the shutter 35 can be operated in a more stable state. In FIG. 18, parts of the additional wire spring 55A corresponding to those parts of the wire spring 55 and other parts relating to the additional wire spring 55A corresponding to those other parts relating to the wire spring 55 are denoted by respective like reference symbols affixed by A.

In each of the examples of the image bearing member unit 28 described above, when the shutter 35 is located in the closed position, if the shutter 35 touches a surface of the image bearing member 3, the surface of the image bearing member 3 may be damaged. In order to prevent such a problem, it is preferable to provide a regulating device to regulate the position of a part of the shutter 35 opposing the image bearing member 3 when the shutter 35 is located in the closed position such that when the shutter 35 is in the closed position, the part of the shutter 35 opposing the image bearing member 3 does not contact an image forming area surface of the image bearing member 3.

Figure 19:
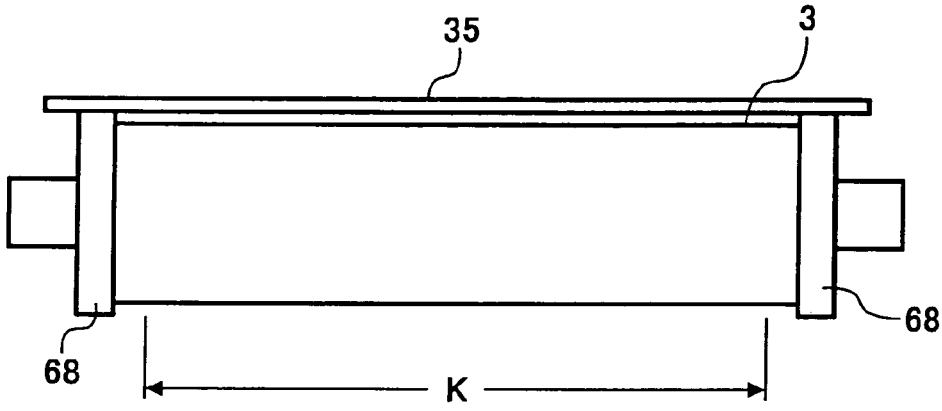
FIG. 19 is a diagram illustrating a state that the shutter in the closed position is placed on flanges of the image bearing member.
Figure 20:
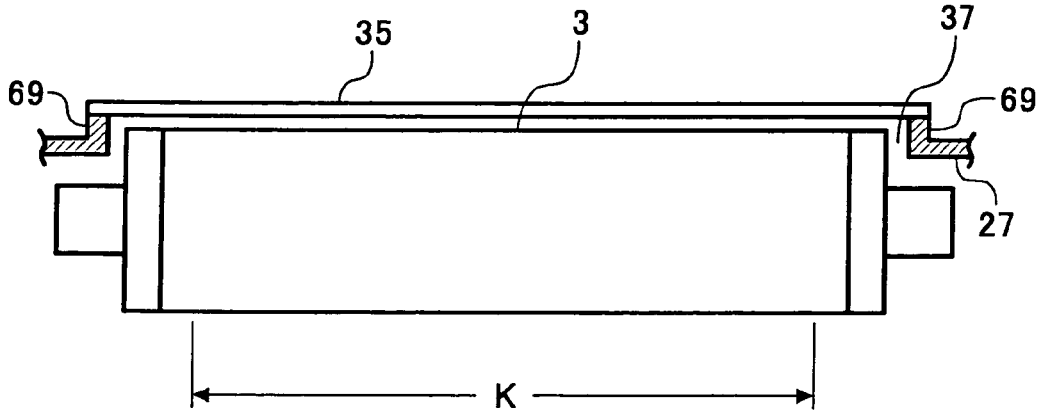
FIG. 20 is a diagram illustrating a state that the shutter in the closed position is placed on regulating protrusion parts of the support member.
Figure 21:
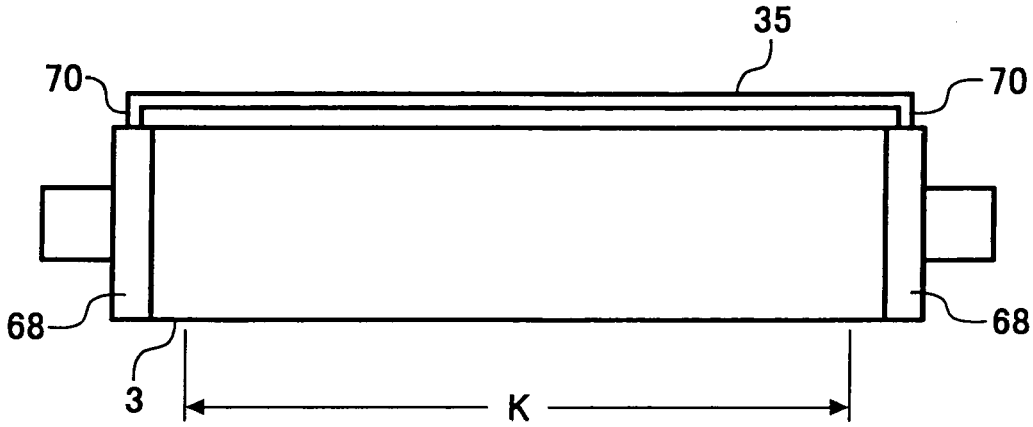
FIG. 21 is a diagram illustrating a state that regulating protrusion parts of the shutter in the closed position are placed on flanges of the image bearing member.

FIG. 19, FIG. 20 and FIG. 21 illustrate exemplary configurations of the regulating device. In these figures, a reference symbol K denotes an image forming area surface of the image bearing member 3 on which a toner image is formed.

In the example illustrated in FIG. 19, the image bearing member 3 formed in a drum-like shape includes flanges 68 located at both end parts thereof in its longitudinal direction, and the flanges 68 protrude toward the outside of the image bearing member 3 in its radial direction more than the image forming area surface K of the image bearing member 3. When the shutter 35 is located in the closed position, the shutter 35 is placed on these flanges 68, and thereby the shutter 35 is prevented from contacting the image forming area surface K of the image bearing member 3. Thus, in this example, the above-described regulating device is constituted by the flanges 68 of the image bearing member 3 protruding outwardly more than the image forming area surface K of the image bearing member 3.

In the example illustrated in FIG. 20, regulating protrusion parts 69 are formed protruding upward at parts of the support member 27 near the opening 37. The shutter 35 in the closed position is placed on the regulating protrusion parts 69, and thereby the shutter 35 is prevented from contacting the image forming are surface K of the image bearing member 3. Thus, in this example, the above-described regulating device is constituted by the regulating protrusion parts 69 formed in the support member 27.

Further, in the example illustrated in FIG. 21, regulating protrusion parts 70 are formed in the shutter 35 itself. When the shutter 35 is located in the closed position, the regulating protrusion parts 70 are brought into contact with parts of the image bearing member 3 other than the image forming area surface K, in the illustrated example, the flanges 68 of the image bearing member 3. Thus, in this example, the regulating device is constituted by the regulating protrusion parts 70 that are formed in the shutter 35 to contact parts of the image bearing member 3 other than the image forming area surface K.

Furthermore, as illustrated in FIG. 3, if the part of the shutter 3 opposing the image forming area surface K (see FIG. 19 through FIG. 21) of the image bearing member 3 when the shutter 35 is located in the closed position is formed in a curved shape almost along the image forming area surface K, the image bearing member 3 is more securely protected by the shutter 35.

Figure 22:
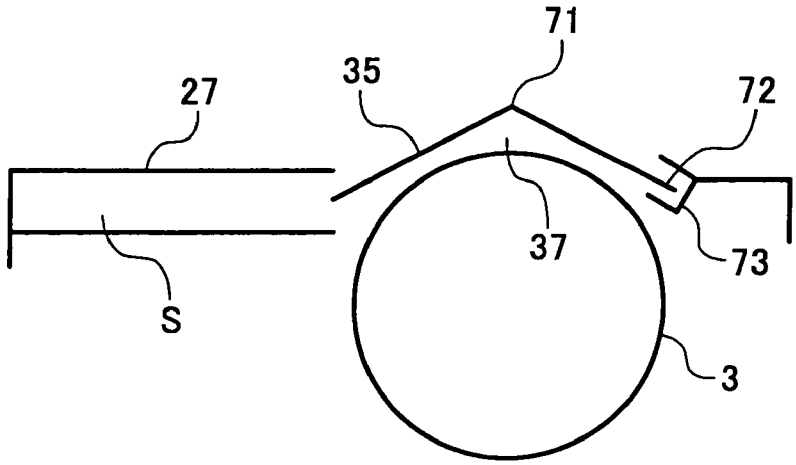
FIG. 22 is a diagram illustrating a state that the shutter in the closed position has been bent at a bending part thereof.
Figure 23:
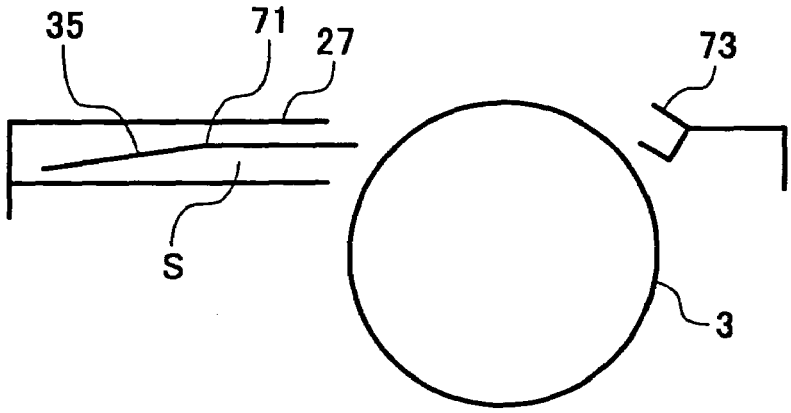
FIG. 23 is a diagram illustrating a state that the shutter illustrated in FIG. 22 is in the opened position.

Furthermore, as illustrated in FIG. 22, if the part of the shutter 35 opposing the image forming area surface K of the image bearing member 3 when the shutter 35 is located in the closed position is configured to be bent at a bending part 71 thereof that is parallel to the axial direction of the image bearing member 3, as in the case in which the shutter 35 is curved as illustrated in FIG. 3, the image bearing member 3 can be securely protected by the shutter 35. FIG. 23 illustrates a state that the shutter 35 illustrated in FIG. 22 is located in the opened position and is housed in the housing space S. Thus, the shutter 35 in this example also can be housed in the housing space S, which is relatively small in the width in the up-and-down direction.

The shutter 35 that is formed in a curved shape or configured to be bent as described above may be used in the image bearing member unit 28 of any of the above-described examples. However, it is particularly preferable that the shutter 35 having such configuration is used in conjunction with the regulating device described above with reference to FIG. 19 through FIG. 21.

Furthermore, in the image bearing member unit 28 according to any of the above-described examples, as illustrated in FIG. 22, a receiving part 73 may be provided to engage with a tip end part 72 of the shutter 35 when the shutter 35 is located in the closed position so that a gap is prevented from being formed between the tip end part 72 of the shutter 35 and an edge of the support member 27 at the side of the opening 37 formed in the support member 27. Thereby, penetration of light through the opening 37 onto the image bearing member 3 can be more securely prevented and deterioration of the image bearing member 3 can be effectively suppressed.

The shutter 35 may be formed by a molding method, such as injection molding or plastic molding. However, when molding the shutter 35, as exaggeratedly illustrated in FIG. 24, a flash part 74 may be formed at an edge part of the shutter 35. If the flash part 74 touches a surface of the image bearing member 3, the surface of the image bearing member 3 may be damaged. Accordingly, the shutter 35 may be arranged such that when the shutter 35 is located in the closed position, the flash part 74 formed at an edge part of the shutter 35 when the shutter 35 has been molded is located at the side separated from a surface of the image bearing member 3. Thereby, it may be prevented that the flash part 74 of the shutter 35 touches a surface of the image bearing member 3.

Figure 24:
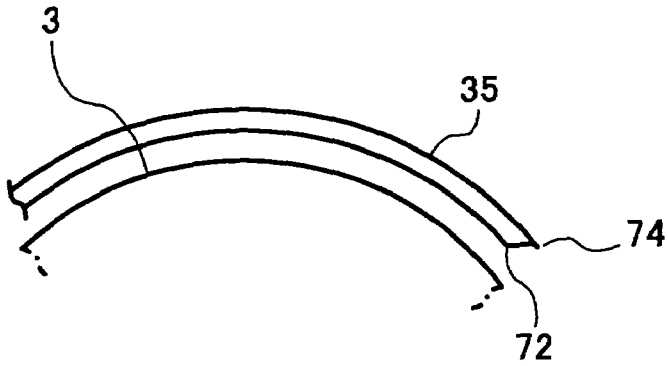
FIG. 24 is a diagram for explaining a flash formed in the shutter.

Further, as illustrated in FIG. 24 also, if a tip end part corner 72 of the shutter 35 opposing a surface of the image bearing member 3 when the shutter 35 is located in the closed position is formed in a round shape, a possibility that a surface of the image bearing member 3 is damaged can be more securely avoided. The tip end part corner 72 of the shutter 35 is preferably finished to be round. When finishing the tip end part corner 72, the flash part 74 may be removed.

Furthermore, if at least the surface of the shutter 35 facing the image bearing member 3 has a conductive property, by grounding a conductive part of the shutter 35, it can be prevented that the shutter 35 is charged to adversely affect the image bearing member 3, and thereby the image bearing member 3 is prevented from being deteriorated. For example, after the shutter 35 has been obtained by molding, a conductive coating material may be coated on a surface of the shutter 35 at the side opposing the image bearing member 3 when the shutter 35 is located in the closed position. The whole part of the shutter 35 may be made of a conductive material.

Furthermore, the shutter 35 and the support member 27 may be made of a same material. Thereby, when recycling the image bearing member unit 28, it is not necessary to disassemble the shutter 35 and the support member 27. The shutter 35 and the support member 27 can be processed together for recycling by melting, etc., and the number of processes of recycling can be decreased.

In the image forming apparatus including the above-described image bearing member unit 28, a detect device (not shown), e.g., a photo-sensor, may be provided to detect if the shutter 35 remains in the closed position when the image bearing member unit 28 has been set in the predetermined position inside of the main body 1 of the image forming apparatus. If the detect device has detected that the shutter 35 remains in the closed position even when the image bearing member unit 28 has been set in the in the predetermined position inside of the main body 1, a notice informing thereof may be displayed on a display of the image forming apparatus. Thereby, a trouble can be prevented from occurring in advance.

Figure 25:
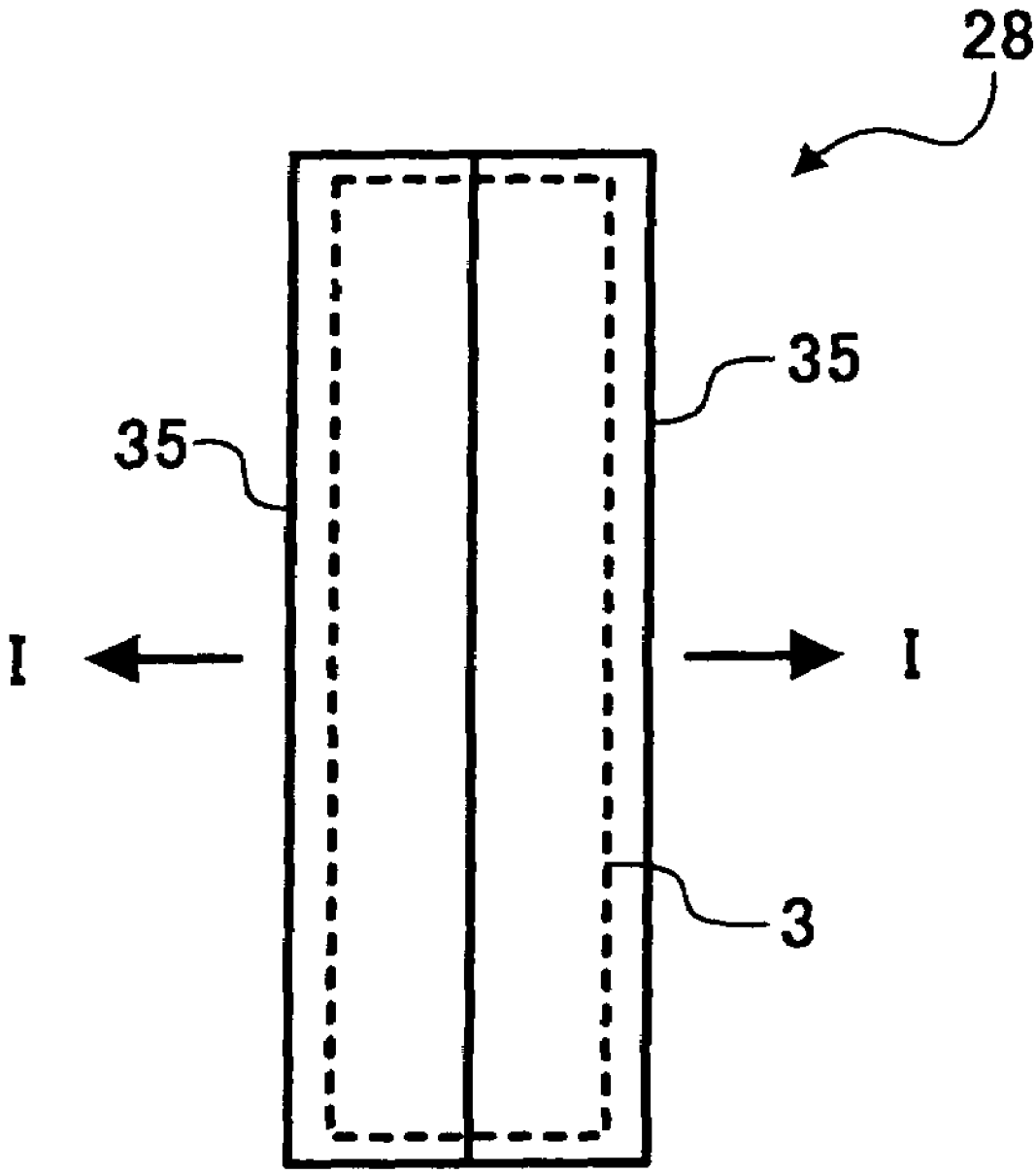
FIG. 25 is a schematic plane view illustrating a state that the image bearing member is covered by two shutters.

In the above-described examples, the image bearing member unit 28 is configured such that one piece of the shutter 35 covers the upper part of the image bearing member 3. However, the image bearing member unit 28 may be configured such that the image bearing member 3 is covered by a plurality of shutters. For example, as illustrated in FIG. 25, when the image bearing member unit 28 has been taken out of the main body 1 of the image forming apparatus, two shutters 35 cover the upper part of the image bearing member 3, and when the image bearing member unit 28 is set inside of the main body 1, the shutters 35 retreat in directions I respectively, so that the upper part of the image bearing member 3 is uncovered. These shutters 35 can be operated with the mechanisms described above.

Figure 26:
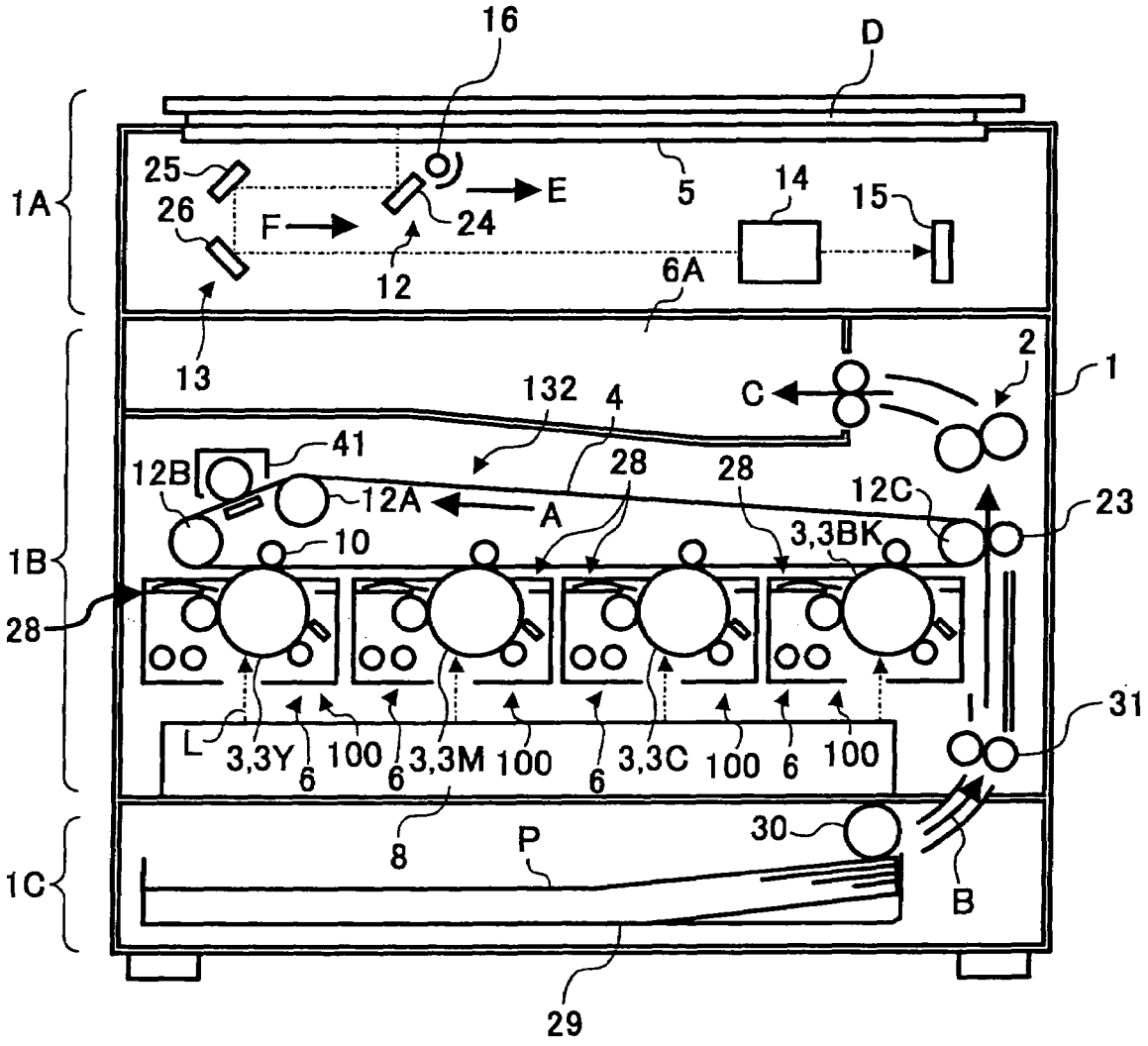
FIG. 26 is a schematic cross section illustrating an example of an image forming apparatus configured as a copier according to another preferred embodiment of the present invention.

FIG. 26 is a schematic cross section illustrating an example of an image forming apparatus configured as a copier according to another preferred embodiment of the present invention. In FIG. 26, parts identical or corresponding to those of the image forming apparatus of the previous embodiment are denoted by the same reference symbols, and description thereof is omitted.

In the image forming apparatus of this example, the intermediary transfer member 4 spanned around the support rollers 12A, 12B and 12C, a unit case (not shown in FIG. 26) housing the intermediary transfer member 4, the cleaning device 41 attached to the unit case, and a plurality of the first transfer devices 10 rotatably supported by the unit case are integrated to constitute an intermediary transfer member unit 132 in FIG. 26. The support rollers 12A, 12B and 12C are also rotatably supported by the unit case.

Figure 27:
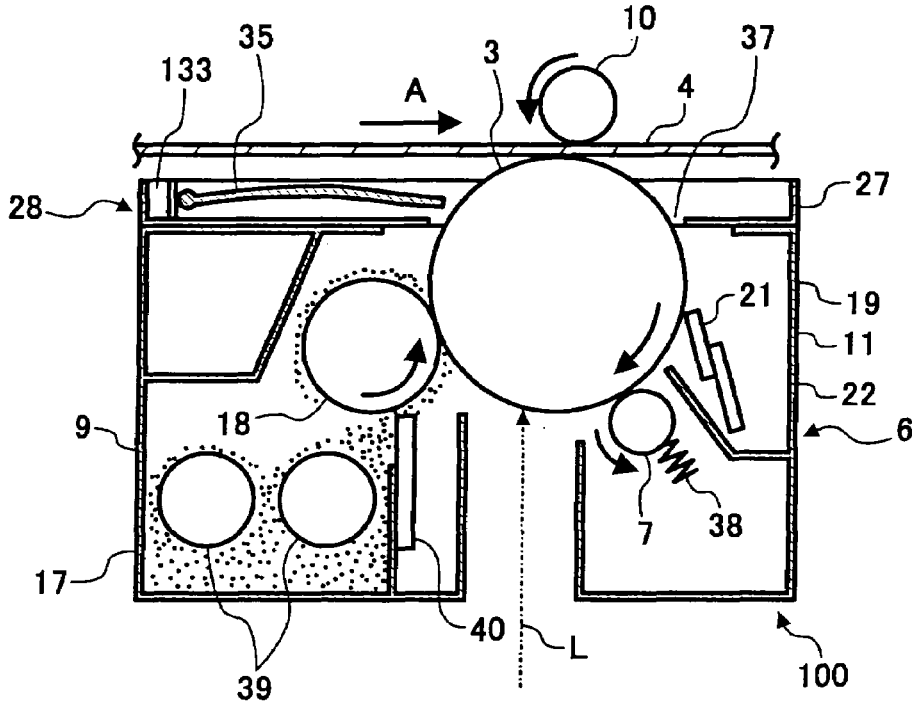
FIG. 27 is an enlarged cross section of a process cartridge including an image bearing member unit and a process unit, of the image forming apparatus of FIG. 26.
Figure 28:
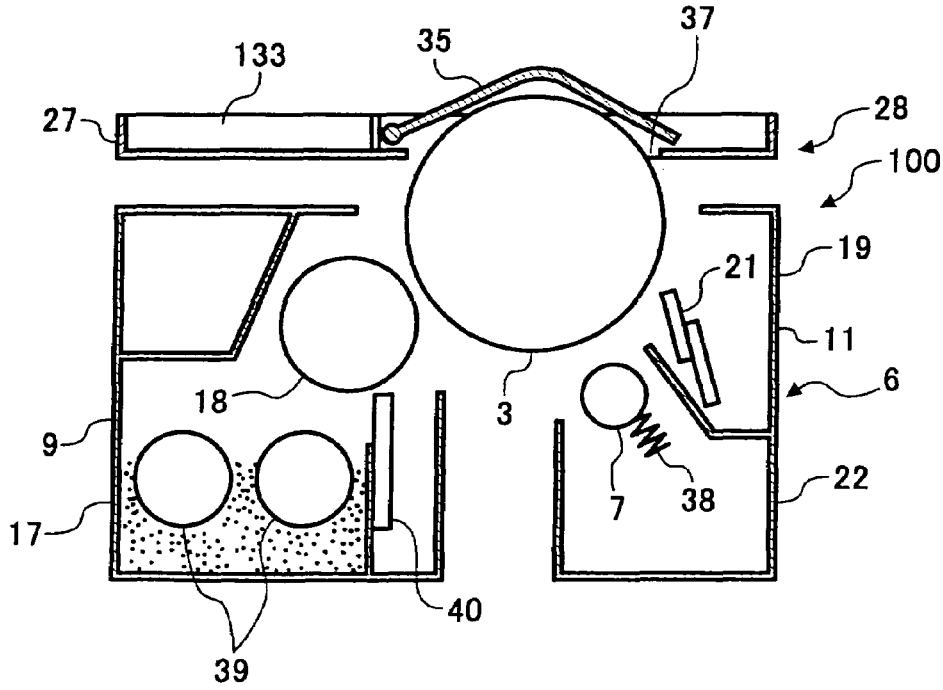
FIG. 28 is a cross section illustrating a state of the process cartridge when the process cartridge has been taken out of the main body of the image forming apparatus and a shutter of the image bearing member unit is in a closed position.

In the image forming apparatus in this example also, as illustrated in FIG. 27 and FIG. 28, the charging roller 7, the development device 9, and the cleaning device 11, serving as process devices, are arranged around the image bearing member 3Y, and these process devices are integrated to constitute the process unit 6. The cleaning device 11 in this example includes, as illustrated in figures, the cleaning case 19 and the cleaning blade 21 supported by the cleaning case 19. The process devices arranged around each of the image bearing members 3M, 3C and 3BK are integrated in a similar manner, so that four pieces of the process unit 6 are provided in the image forming apparatus.

Further, each image bearing member 3 is integrated with the support member 27 to form the image bearing member unit 28. The process unit 6 and the image bearing member unit 28 are assembled with each other in a detachable manner, and the process cartridge 100 is constituted of these units.

Figure 30:
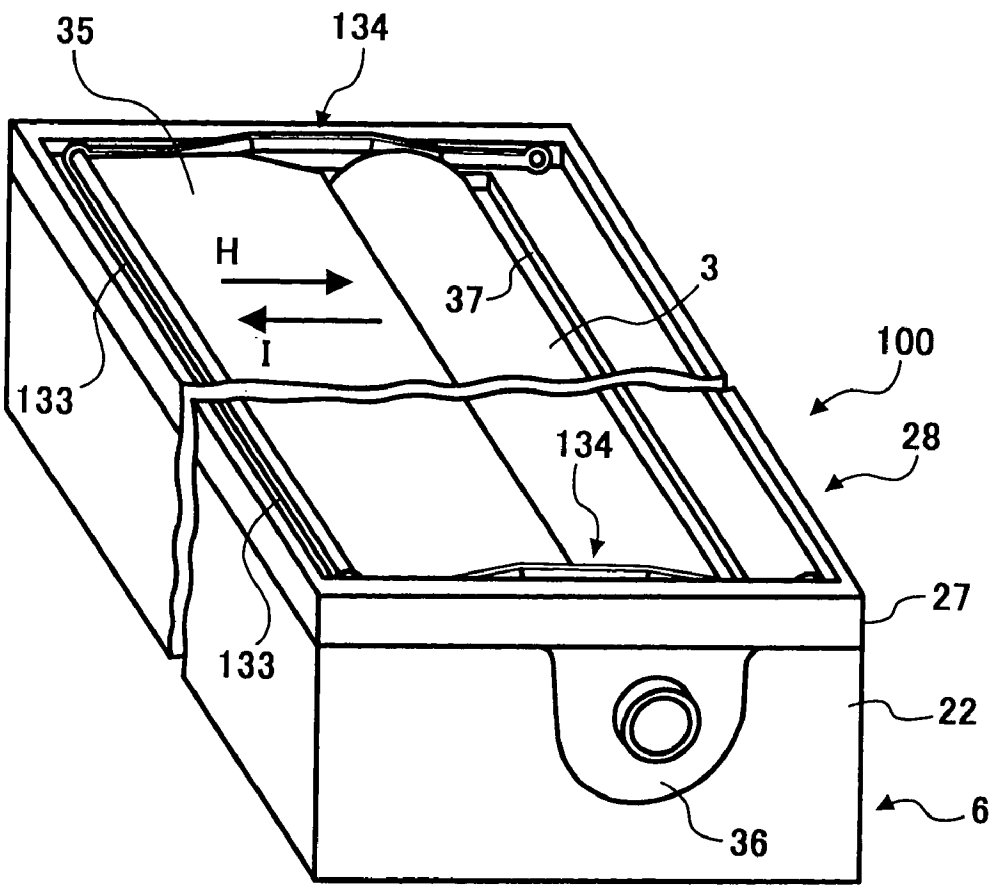
FIG. 30 is a perspective view of the image bearing member unit when the shutter is in an opened position.
Figure 31:
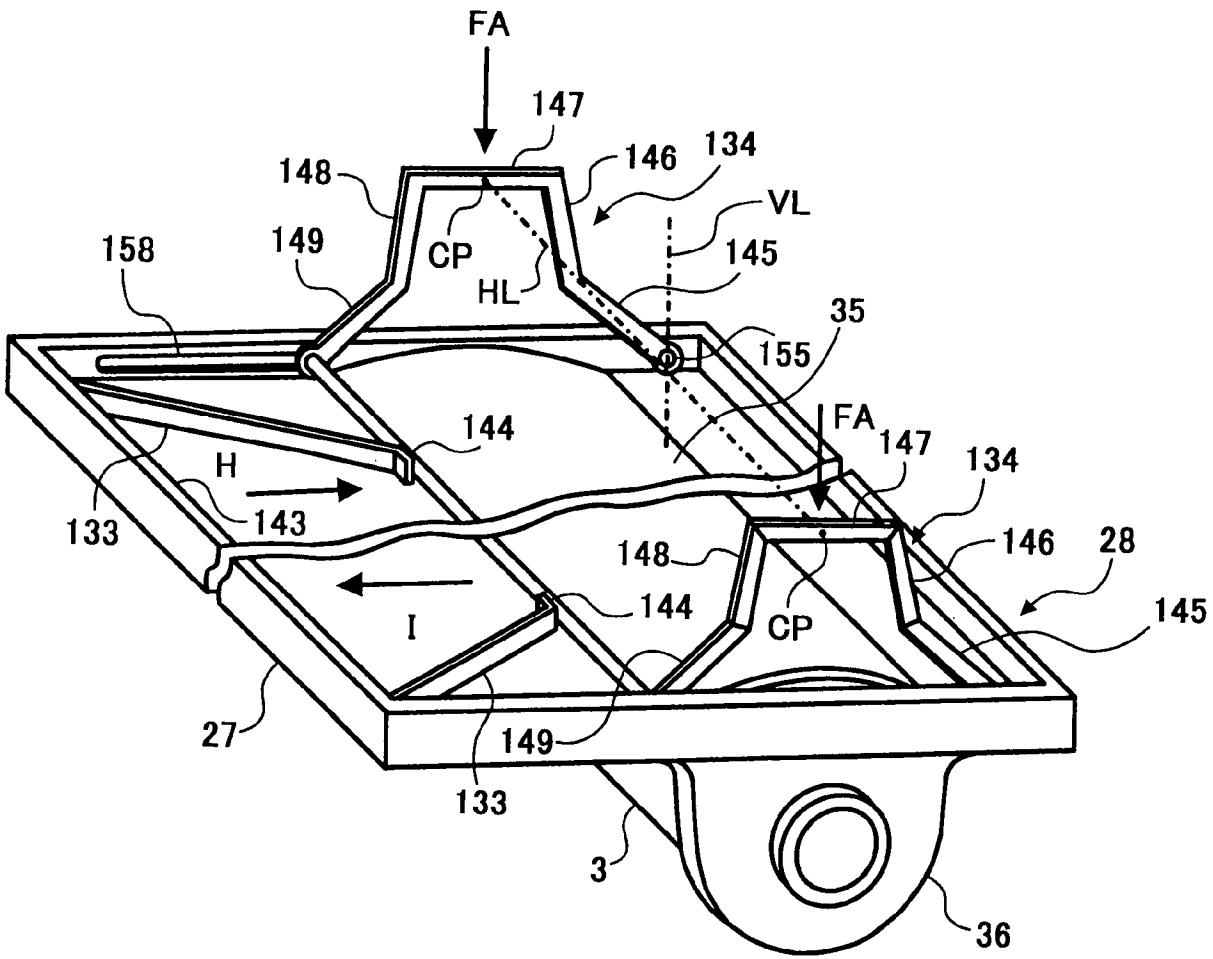
FIG. 31 is a perspective view of the image bearing member unit when the shutter is in the closed position.

Each image bearing member 3 is rotatably supported by the support member 27 as in the previous embodiment. As illustrated in FIG. 30 and FIG. 31, axis parts at longitudinal end parts of the image bearing member 3 formed in a drum-like shape are rotatably supported by the pair of bearing parts 36 (only one of the pair is illustrated) of the support member 27, respectively. The opening 37 is formed in the support member 27, and as illustrated in FIG. 27 the image bearing member 3 protrudes through the opening 27 to contact the intermediary transfer member 4.

Figure 29:
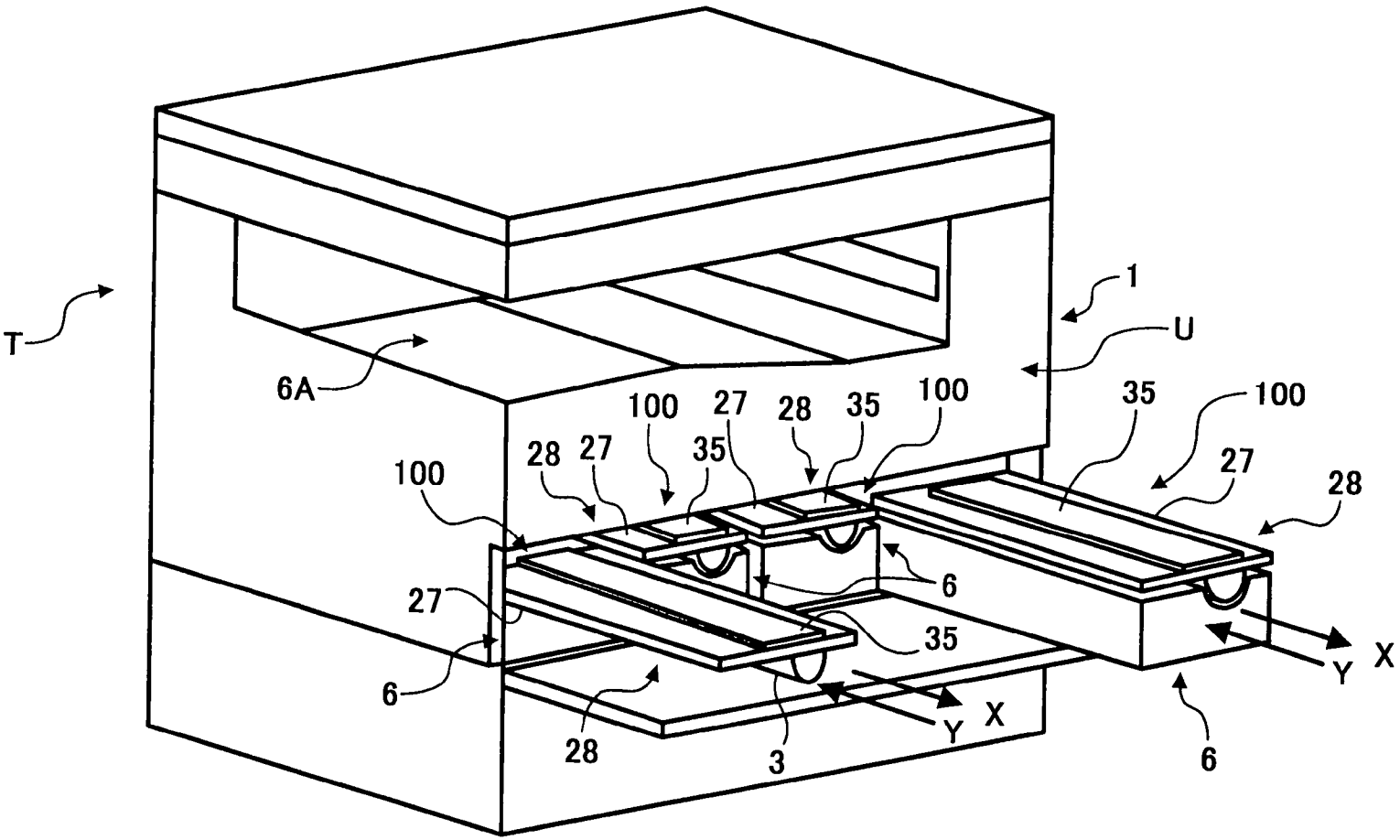
FIG. 29 is a perspective view illustrating an appearance of the image forming apparatus of FIG. 26 and a state that the image bearing member unit and the process unit are drawn out of or pushed into the main body of the image forming apparatus.

FIG. 29 is a perspective view illustrating an appearance of the image forming apparatus and a state that each image bearing member unit 28 and each process unit 6 are drawn out of or pushed into the main body 1 of the image forming apparatus. Each image bearing member unit 28 and each process unit 6 are supported by guide rails (described later) to be drawn out and to be pushed back, while being guided by the guide rails, in the direction of the front side U of the main body 1 indicated by the arrow X and in the direction of the backside T of the main body 1 indicated by the arrow Y, respectively, relative to the main body 1 of the image forming apparatus. In this example also, as in the previous embodiment, each image bearing member unit 28 and each process unit 6 are drawn out in the axial direction of the image bearing member 3. Further, the image bearing member unit 28 and the process unit 6 may be drawn out and be pushed back together in the state that the image bearing member unit 28 and the process unit 6 are integrated as the process cartridge 100, in the direction of the front side U of the main body 1, indicated by the arrow X, to be taken out of the main body 1, and in the direction of the backside T of the main body 1, indicated by the arrow Y, to be set in predetermined positions inside of the main body 1. Furthermore, it is possible to draw out only the image bearing member unit 28 in the direction of the front side U of the main body 1 while leaving the process unit 6 inside of the main body 1, and to push back the image bearing member unit 28 in the direction of the backside T of the main body 1 to be set in the main body 1. Furthermore, it is possible to draw out and push back only the process unit 6 relative to the main body 1 while leaving the image bearing member unit 28 inside of the main body 1. Thus, as in the previous embodiment, the image bearing member unit 28 and the process unit 6 can be individually attached to and detached from the main body 1 of the image forming apparatus. Therefore, repairing, checking and replacing the image bearing member unit 28 and the process unit 6 are relatively easy.

Figure 34:
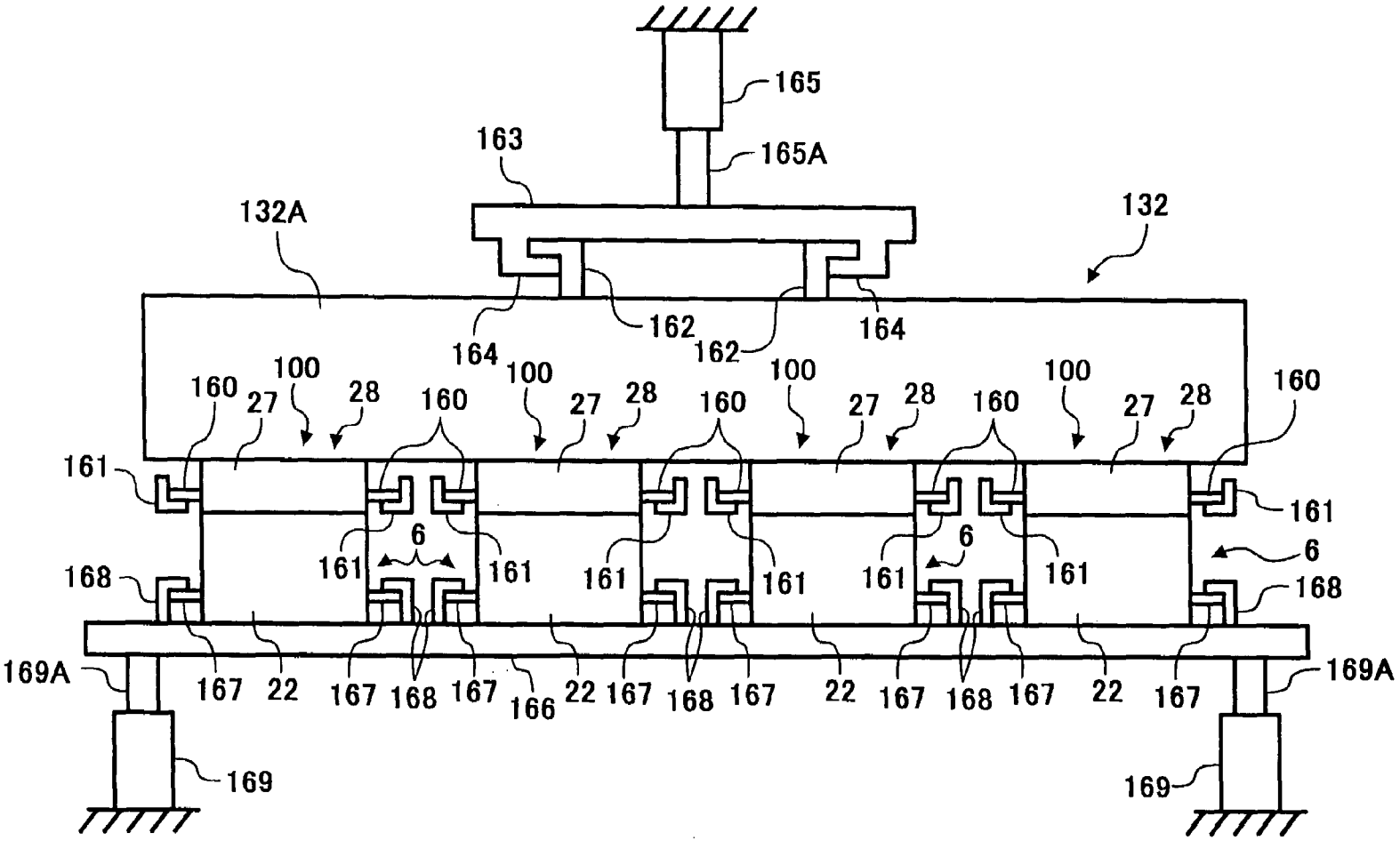
FIG. 34 is a schematic diagram illustrating a state of an intermediary transfer member unit, the image bearing member unit, and a process unit of the image forming apparatus of FIG. 26 when these units are set inside of the main body of the image forming apparatus.
Figure 35:
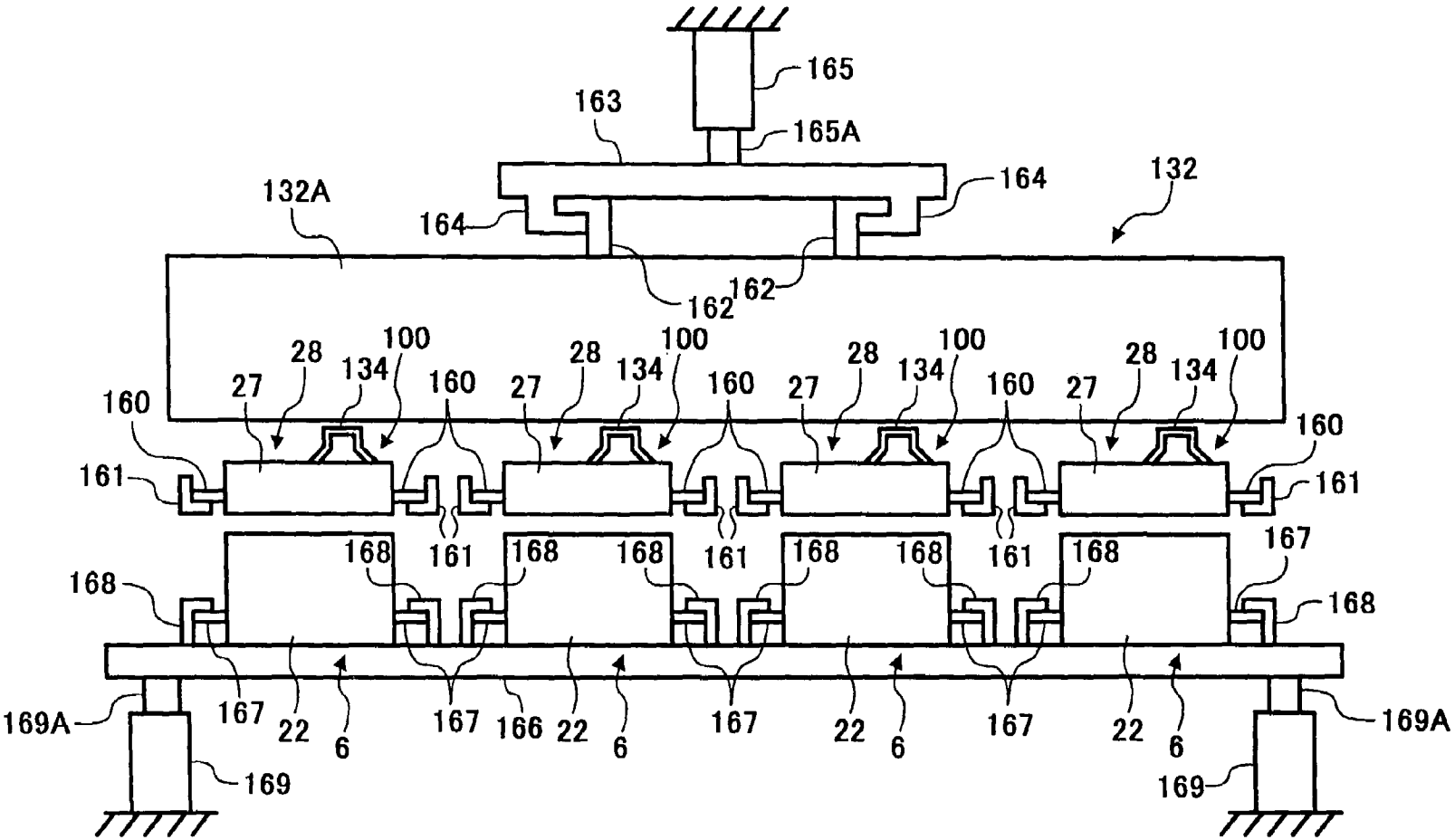
FIG. 35 is a schematic diagram illustrating a state that the intermediary transfer member unit, the image bearing member unit and the process unit of the image forming apparatus of FIG. 26 are separated from each other in the up-and-down direction.

FIG. 34 and FIG. 35 are schematic diagrams illustrating the intermediary transfer member unit 132, the image bearing member units 28, and the process units 6 which are arranged inside of the main body 1 of the image forming apparatus, viewed from the front side of the main body 1. FIG. 34 illustrates a state that the image bearing member 3 of each image bearing member unit 28 contacts the intermediary transfer member 4 and the image bearing member unit 28 and the process unit 6 are assembled with each other, as illustrated in FIG. 26.

As illustrated in FIGS. 34 and 35, a guide member 160 provided to the support member 27 of each image bearing member unit 28 in a protruding manner is slidably supported by a guide rail 161 fixed to the main body 1 of the image forming apparatus.

A guide member 162, provided to the unit case 132A of the intermediary transfer member unit 132 in a protruding manner, is slidably supported by a guide rail 164 of a guide member 163, which is supported by the main body 1 to move in the up-and-down direction. A solenoid 165 is arranged above the guide member 163, and a bottom end of a plunger 165A of the solenoid 165 is fixed to the guide member 163.

Further, a guide plate 166 is provided below the process units 6, supported by the main body 1 to move in the up-and-down direction. A guide member 167 provided to the cover 22 of each process unit 6 in a protruding manner is slidably engaged with a guide rail 168 fixed to the guide plate 166. A plurality of solenoids 169 are arranged below the guide plate 166, and tip ends of plungers 169A of the solenoids 169 are fixed to the guide plate 166. Holes (not illustrated) are formed in the guide plate 166 so that laser light emitted from the exposure device 8 illustrated in FIG. 26 passes through.

When drawing each image bearing member unit 28 and each process unit 6 set inside of the main body 1 of the image forming apparatus out of the main body 1, prior to an operation of drawing these units, the solenoid 165 is operated, and the guide member 163 and the intermediary transfer member unit 132 are raised upward as illustrated in FIG. 35. Further, the solenoids 169 are operated, and the guide plate 166 and each process unit 6 are moved downward as illustrated in FIG. 35. Thereby, the intermediary transfer member unit 132, each image bearing member unit 28, and each process unit 6 are separated from each other in the up-and-down direction. In this state, each image bearing member unit 28 and each process unit 6 can be drawn, while being guided by the guide rails 161 and 168, respectively, in the direction of the front side of the main body 1 which is perpendicular to the surface of paper of FIG. 35. In a similar manner, the intermediary transfer member unit 132 can be drawn out while being guided by the guide rails 164 in the direction of the front side of the main body 1. When each image bearing member unit 28 and each process unit 6 are drawn out of the main body 1 in the direction of the front side of the main body 1, it never occurs that the image bearing member 3 and the intermediary transfer member 4 slidably contact each other, that the development roller 18, the charging roller 7, and the cleaning blade 21 of the process unit 6 slidably contact the image bearing member 3, or that the shutter 35 which operates as described later contacts the intermediary transfer member 4, so that the image bearing member 3 and the intermediary transfer member 4 are prevented from being damaged. FIG. 28 illustrates the image bearing member unit 28 and the process unit 6 when drawn out of the main body 1 in the front side direction of the main body 1 in the state that the image bearing member unit 28 and the process unit 6 are separated from each other in the up-and-down direction.

When inserting the intermediary transfer member unit 132, each process unit 6, and each image bearing member unit 28 into the main body 1 of the image forming apparatus to be set inside of the main body 1, these units are inserted into the main body 1 in the state that these units are separated from each other in the up-and-down direction. After these units have been placed inside of the main body 1 as illustrated in FIG. 35, by an operation of the solenoids 165 and 169, the intermediary transfer member unit 132 is moved downward and each process unit 6 is moved upward. Thereby, as illustrated in FIG. 27 and FIG. 34, the process unit 6 is assembled with the image bearing member unit 28, and the intermediary transfer member 4 of the intermediary transfer member unit 132 is brought into contact with the image bearing member 3 of each image bearing member unit 28.

As described above, in the image forming apparatus in this example also, the image bearing member unit 28 is assembled with the process unit 6, which includes at least one process device used for forming a toner image on the image bearing member 3, in a freely detachable manner relative to the process unit 6, and the image bearing member unit 28 and process unit 6 constitute the process cartridge 100. However, the image bearing member unit 28 and the process cartridge 100 may be differently configured in an appropriate manner as in the previous embodiment. For example, by integrally forming the support member 27 of the image bearing member unit 28 and the case 22 of the process unit 6, the image bearing member unit 28 and the process unit 6 illustrated in FIG. 27 may be integrated to be the process cartridge 100 in which the image bearing member unit 28 and the process unit 6 cannot be separated from each other. Thus, an image bearing member unit and a process cartridge of in this embodiment also may be configured in various manners. However, in any case, an image bearing member unit of the present invention includes an image bearing member on which a toner image is formed and a support member to support the image bearing member, and is configured to be drawn out of and put into the main body of an image forming apparatus, as in the previous embodiment. Further, a process cartridge in this embodiment includes the above-described image bearing member unit and at least a process device used for forming a toner image on the image bearing member of the image bearing member unit, and is configured to be attached to the main body of an image forming apparatus in a detachable manner, as in the previous embodiment. It is preferable that the process cartridge is configured, as in the process cartridge 100 of this example, such that the image bearing member unit is detachable relative to a part of the process cartridge (in this example the process unit 6).

FIG. 27 and FIG. 30 illustrate states of the image bearing member unit 28 and the process unit 6 when these units are set in predetermined positions inside of the main body 1 of the image forming apparatus, and FIG. 28 illustrates states of the image bearing member unit 28 and the process unit 6 when these units have been taken out of the main body 1 of the image forming apparatus. When the image bearing member unit 28 has been taken out of the main body 1 of the image forming apparatus, if the image bearing member 3 is directly exposed to light, the image bearing member 3 may be deteriorated. Further, if the image bearing member 3 is touched by a hand of a worker, the image bearing member 3 may be damaged or deteriorated. Therefore, in the image forming apparatus in this example also, the shutter 35 is provided to the image bearing member unit 28 to cover and uncover the image bearing member 3. The shutter 35 is constituted by a thin plate member, which is made of, for example, resin such as polycarbonate, or metal.

As illustrated in FIG. 27 and FIG. 30, when the image bearing member unit 28 is loaded in the predetermined position inside of the main body 1 of the image forming apparatus, the shutter 35 is located in the opened position of the shutter 35 wherein the shutter 35 does not cover the image bearing member 3 protruding through the opening 37 and the upper part of the image bearing member 3 is exposed. Thereby, a toner image can be formed on the image bearing member 3 and the toner image can be transferred onto the intermediary transfer member 4, without any trouble. When the image bearing member unit 28 has been taken out of the main body 1 of the image forming apparatus, as illustrated in FIG. 28 and FIG. 31, the shutter 35 is located in the closed position wherein the shutter 35 covers the image bearing member 3 protruding through the opening 37 and the opening 37 is closed by the shutter 35. Thereby, the image bearing member 3 is prevented from being directly exposed to the external light. Further, it is prevented that a hand of a worker touches the image bearing member 3. Thus, the image bearing member 3 of the image bearing member unit 28 which has been taken out of the main body 1 of the image forming apparatus can be effectively protected. When the image bearing member unit 28 has been set in the predetermined position inside of the main body 1 after performing repairing and/or checking work to the image bearing member unit 28, the shutter 35 operates to move to the opened position illustrated in FIG. 27 and FIG. 30 and at this time the image bearing member 3 is uncovered.

As described above, the shutter 35 is assembled with the support member 27 to move between the opened position wherein the shutter 35 does not cover the image bearing member 3 protruding through the opening 37 formed in the support member 27 and the closed position wherein the shutter 35 covers the image bearing member 3. When the shutter 35 is operated to move between the opened and closed positions, the shutter 35 moves in the directions H and I (FIG. 30 and FIG. 31) that are substantially perpendicular to the directions in which the image bearing member unit 28 is drawn out of and put into the main body 1 of the image forming apparatus.

Figure 32:
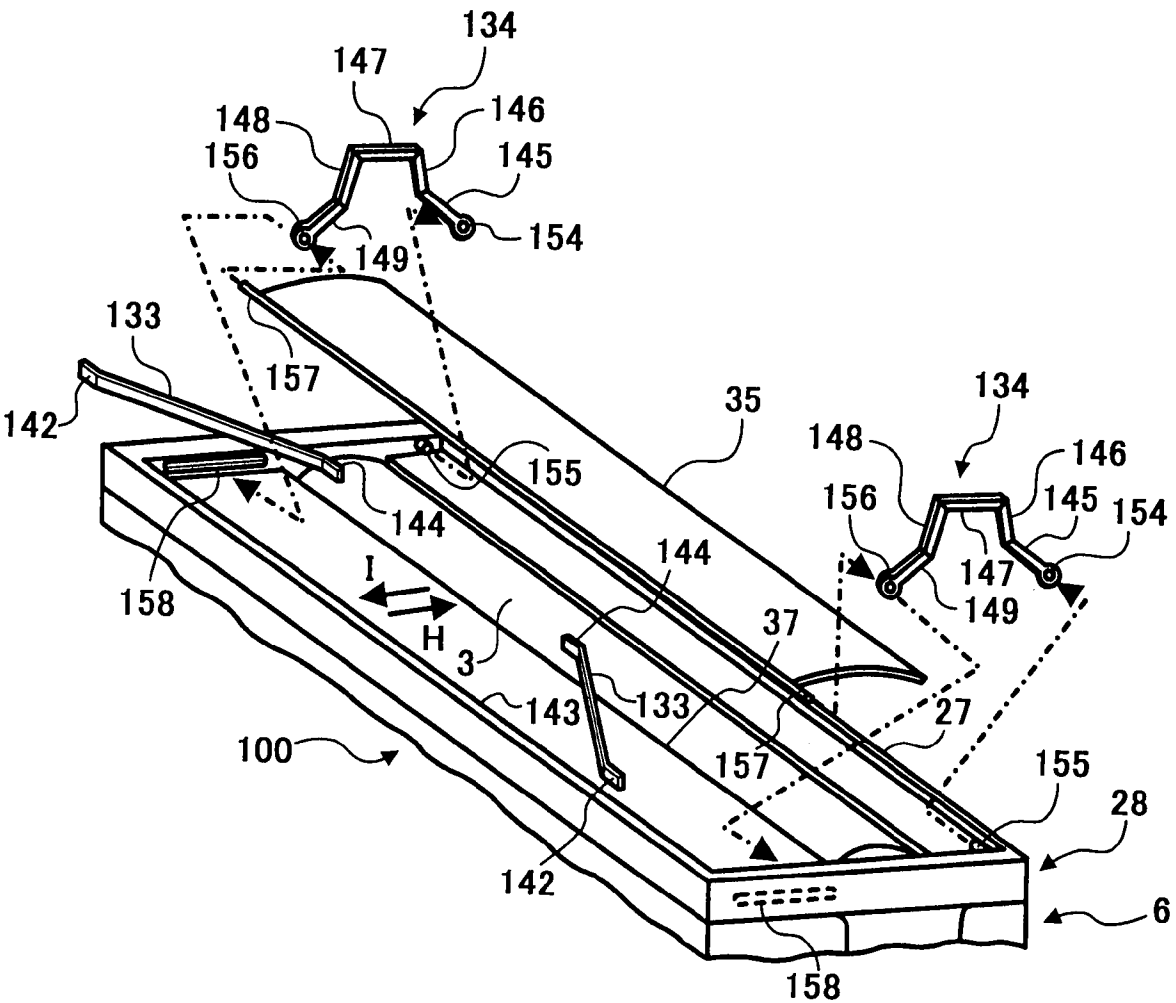
FIG. 32 is an exploded perspective view of the image bearing member unit.

In the image bearing member unit 28 in this example, a pair of pressing members 133 illustrated in FIG. 30 and FIG. 31 and a pair of shutter opening/closing regulation devices 134 (not illustrated in FIG. 27, FIG. 28 and FIG. 29) are provided such that the shutter 35 moves between the opened and closed positions as described above. FIG. 32 illustrates the pair of pressing members 133, the pair of shutter opening/closing regulation devices 134, and the shutter 35, which have been separated from the support member 27.

As illustrated in FIG. 32, the pair of the pressing members 133 in this example is constituted of plate springs. One end 142 of each pressing member 133 is pressed against a spring receiving surface 143 of the support member 27 to contact the spring receiving surface 143 and the other end 143 thereof is pressed against the shutter 35 to contact the shutter 35. Thereby, the pair of pressing members 133 presses the shutter 35 in the direction indicated by the arrow H toward the closed position.

Figure 33A:
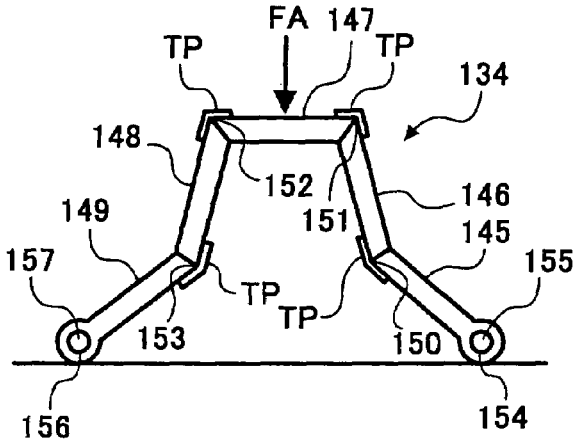
FIG. 33A, FIG. 33B and FIG. 33C are diagrams for explaining an operation of a shutter opening/closing regulation device of the image bearing member unit.
Figure 33B:
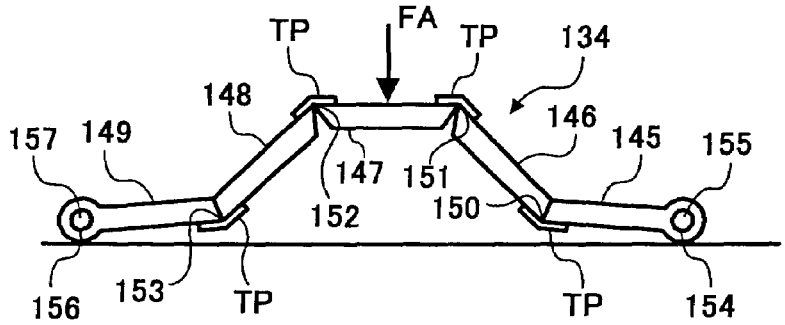
Figure 33C:
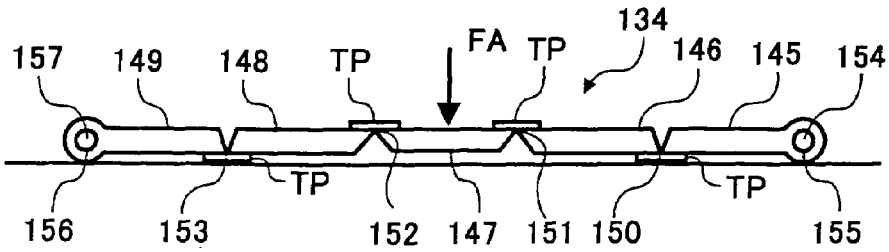

The pair of shutter opening/closing regulation devices 134 is arranged at the front side and the backside of the support member 27, and each shutter opening/closing regulation device 134 includes a plurality of arms rotatably connected with each other. Each shutter opening/closing regulation device 134 includes five arms 145, 146, 147, 148 and 149, and as illustrated in FIG. 33A, FIG. 33B and FIG. 33C, the arms 145, 146, 147, 148 and 149 are connected with each other by elastic adhesive tapes TP such that the shutter opening/closing regulation device 134 freely bends at joint parts 150, 151, 152 and 153 of the shutter opening/closing regulation device 134. Instead of connecting the arms 145, 146, 147, 148 and 149 with each other by the elastic adhesive tapes TP, these arms may be integrally molded using resin such as polypropylene, and the joint parts 150, 151, 152 and 153 may be constituted of a thin integrated hinge. It may be sufficient if at least two arms are provided to each shutter opening/opening regulating device 134.

As illustrated in FIG. 32, holes 154 are formed at base parts of the arms 145 of the pair of shutter opening/closing regulation devices 134, respectively. The holes 145 rotatably engage with pins 155 located at front side and backside parts of the support member 27, respectively. Further, holes 156 are formed at base parts of the arms 149, and shutter pins 157, arranged at the front side and the backside of the end part of the shutter 35 against which the pair of pressing members 133 is pressed, are rotatably engaged with the holes 156, respectively. Furthermore, the shutter pins 157 slidably engage with elongated guide slots 158 formed at front side and backside parts of the support member 27. Each guide slot 158 linearly extends in a direction substantially parallel to the arrow directions H and I in which the shutter 35 moves toward the opened and closed positions.

Thus, each shutter opening/closing regulation device 134 includes a plurality of arms rotatably connected with each other, i.e., the arms 145 through 149, and the arm 145 among the plurality of arms is rotatably connected with the support member 27, the arm 149 among the plurality of arms is rotatably connected with the shutter 35, and the shutter 35 is slidably assembled with the support member 27 so that the shutter 35 moves between the opened and closed positions. When the shutter 35 is located in the closed position illustrated in FIG. 31, each shutter opening/closing regulation device 134 is located in the first position wherein the shutter opening/closing regulation device 134 protrudes upward. That is, the shutter 35 is located in the closed position wherein the shutter 35 is pressed in the arrow direction H by the pair of pressing members 133 and thereby a gap between the pin 155 of the support member 27 and the shutter pin 157 is decreased. As a result, each shutter opening/closing regulation device 134 constituted of a plurality of arms protrudes upward. FIG. 33A illustrates a state of the shutter opening/closing regulation device 134 at this time.

On the other hand, as illustrated in FIG. 31 and FIG. 33A, if an external force FA is applied to the arm 147 at the center of the shutter opening/closing regulation device 134, the force FA is transmitted to the arms 145 and 149. At this time, the base part of the arm 145 is connected with the pin 155 that is fixed, and the base part of the arm 149 is connected with the shutter pin 157 that freely slides relative to the support member 27. Therefore, the base part of the arm 149 moves in the arrow direction I together with the shutter pin 157 of the shutter 35, the whole part of the shutter opening/closing regulation device 134 is pressed downward to be expanded as illustrated in FIG. 30, FIG. 33B and FIG. 33C, so that the shutter opening/closing regulation device 134 is located in the second position wherein the height of the shutter opening/closing regulation device 134 is lower than when located in the first position, and the shutter 35 is moved to the opened position. By releasing the external force FA applied to the arm 147 of each shutter opening/closing regulation device 134, the shutter 35 is pressed in the arrow direction H by the pair of pressing members 133, and thereby the shutter 35 moves to the closed position illustrated in FIG. 31 and each shutter opening/closing regulation device 134 is placed in the first position illustrated in FIG. 31 and FIG. 33A.

As described above, the pair of shutter opening/closing regulation devices 134 is connected with the shutter 35 and the support member 27 such that when the shutter 35 is located in the closed position, the pair of shutter opening/closing regulation devices 134 is in the first position protruding upward and when the shutter 35 is located in the opened position, the pair of shutter opening/closing regulation devices 134 is in the second position wherein the height of the pair of shutter opening/closing regulation devices 134 is lower than when the pair of shutter opening/closing regulation devices 134 is in the first position.

When the image bearing member unit 28 configured as described above has been drawn out of the main body 1 of the image forming apparatus as illustrated in FIG. 28 and FIG. 31, because a member pressing the pair of shutter opening/closing regulation devices 134 downward does not exist, the pair of shutter opening/closing regulation devices 134 is located in the first position protruding upward and the shutter 35 is located in the closed position wherein the shutter 35 covers the image bearing member 3. Thereby, the image bearing member 3 can be protected. When the image bearing member unit 28 in the state that the shutter 35 is located in the closed position is pushed into the main body 1 of the image forming apparatus, as described above with reference to FIG. 34 and FIG. 35, the solenoids 165 and 169 operate, and thereby the image bearing member unit 28 and the process unit 6 are assembled with each other, and the intermediary transfer member unit 132 moves downward. At this time, the unit case 132A of the intermediary transfer member unit 132 hits the pair of shutter opening/closing regulation devices 134 and presses the pair of the shutter opening/closing regulation devices 134 downward. Thereby, the pair of shutter opening/closing regulation devices 134 is brought into the second position, and the shutter 35 is moved to the opened position so that the upper part of the image bearing member 3 is exposed. After inserting the image bearing member unit 28 into the main body 1, by raising the image bearing member unit 28 so that the pair of shutter opening/closing regulation devices 134 hits the unit case 132A of the intermediary transfer member unit 132, the pair of shutter opening/closing regulation devices 134 may be pressed downward. That is, by relatively moving the image bearing member unit 28 upward relative to the intermediary transfer member unit 132, the pair of shutter opening/closing regulation devices 134 is pressed downward. Further, by pressing the pair of shutter opening/closing regulation devices 134 downward by a member other than the unit case 132A of the intermediary transfer member unit 132, the shutter 35 can be brought into the opened position. Namely, after the image bearing member unit 28 in the state that the shutter 35 is located in the closed position has been placed inside of the main body 1 of the image forming apparatus, by moving the image bearing member unit 28 upward relative to another member (in the illustrated example, the unit case 132A of the intermediary transfer member unit 132) so that the pair of shutter opening/closing regulation devices 134 is pressed downward by the another member, the pair of shutter opening/closing regulation devices 134 is brought into the second position and the shutter 35 is operated to move to the opened position.

As described above, the shutter 35 is opened after the image bearing member unit 28 has been placed inside of the main body 1 of the image forming apparatus. Therefore, a trouble that the external light launches onto the image bearing member 3 when inserting or drawing the image bearing member unit 28 into or out of the main body 1 of the image forming apparatus can be prevented.

As described above, it may be sufficient if at least two arms are provided to each shutter opening/closing regulation device 134. However, by providing at least fours arms to each shutter opening/closing regulation device 134 so that joint parts between respective arms are plural, the external force FA applied to the shutter opening/closing regulation device 134 can be relatively easily distributed in leftward and rightward directions. Thereby, the shutter opening/closing regulation device 134 can be easily pressed to expand.

Further, by making the number of arms and the shapes of the arms of each shutter opening/closing regulation device 134 such that the shutter opening/closing regulation device 134 is symmetrical as in the illustrated example, the shutter opening/closing regulation device 134 can be assembled directed in either direction, so that assembling work of the shutter opening/closing regulation device 134 is relatively easy. In the example illustrated in FIG. 32, the arm 149 can be connected with the pin 155 and the arm 145 can be connected with the shutter pin 157.

Further, by arranging a plurality of the pressing members 133 to be in point or line symmetry with each other as in the illustrated example, assembling work thereof can be facilitated. For example, in FIG. 31, the pressing member 133 at the backside can be arranged at the front side and the pressing member 133 at the front side can be arranged at the backside.

Furthermore, the pair of shutter opening/closing regulation devices 134 can be configured to serve as handles of the image bearing member unit 28. Thereby, the image bearing member unit 28 can be carried by grabbing the pair of shutter opening/closing regulation devices 134 serving as handles of the image bearing member unit 28, and it is not necessary to provide another handle to the image bearing member unit 28. When two shutter opening/closing regulation devices 134 are provided separated from each other as in the illustrated example, as illustrated in FIG. 31, in the state that the shutter 35 is located in the closed position, by configuring the two shutter opening/closing regulation devices 134 such that a vertical line VL passing the center of gravity of the image bearing member unit 28 passes between the two shutter opening/closing regulation devices 134 and intersects with a ling HL connecting substantially center parts CP of the two shutter opening/closing regulation devices 134, when raising the image bearing member unit 28 by grabbing the two shutter opening/closing regulation devices 134, the image bearing member unit 28 can be held in a stable state, and the image bearing member unit 28 can be easily carried. The vertical line VL and the line HL can be set in the above-described relation by providing a plumb (not illustrated) to the image bearing member unit 28 or by adjusting the attaching position of the two shutter opening/closing regulation devices 134 relative to the support member 27.

Furthermore, by making the number of arms of each shutter opening/closing regulation device 134 to an odd number and by configuring the shutter opening/closing regulation device 134 such that the arm 147 located in the center position of the arms is substantially in a horizontal posture when the image bearing member unit 28 has taken a horizontal posture, when the pair of shutter opening/closing regulation devices 134 are grabbed by hands, the image bearing member unit 28 can be held in a more stable state and the image bearing member unit 28 can be carried relatively easily.

Furthermore, by making the color of the pair of shutter opening/closing regulation devices 134 different from those of other parts of the image bearing member unit 28, a user or service personnel can easily recognize the pair of shutter opening/closing regulation devices 134 configured to serve as the handles for carrying the image bearing member unit 28, so that carrying the image bearing member unit 28 can be further facilitated.

Furthermore, by providing an anti-slip member or a slip stopper to each shutter opening/closing regulation device 134, a trouble of erroneously dropping the image bearing member unit 28 when carrying the image bearing member unit 28 can be prevented.

The present invention may be applied not only to copiers, but also to other image forming apparatuses, such as printers, facsimile apparatuses, and multi-function apparatuses. The present invention can be also applied to image bearing member units and process cartridges used in such image forming apparatuses. The present invention can be also applied to an image forming apparatus in which only one image bearing member unit is provided to the main body of the image forming apparatus.

Numerous additional modifications and variations of eh present invention are possible in light of the above teachings. It is therefore to be understood that within the scope of the appended claims, the present invention can be practiced otherwise than as specifically described herein.

What is claimed is:

1. An image bearing member unit comprising:

an image bearing member on which a toner image is formed; and a support member supporting the image bearing member such that the image bearing member protrudes through an opening formed in the support member, the support member including a shutter housing space for housing a shutter when the shutter is in an opened position, wherein the image bearing member unit is configured to be drawn out of and put into a main body of an image forming apparatus, wherein the image bearing member unit further comprises the shutter assembled with the support member to move in directions, substantially perpendicular to directions in which the image bearing member unit is drawn out of and put into the main body of the image forming apparatus, to be located, when the image bearing member unit has been drawn out of the main body of the image forming apparatus, in a closed position wherein the shutter covers the image bearing member protruding through the opening formed in the support member, and to be located, when the image bearing member unit has been set in a predetermined position inside of the main body of the image forming apparatus, in the opened position wherein the shutter does not cover the image bearing member protruding through the opening formed in the support member, and wherein the shutter moves to the closed position and to the opened position in conjunction with operations of attaching and detaching the image bearing member unit to and from the main body of the image forming apparatus.

2. The image bearing member unit according to claim 1, wherein the support member includes a guide part to guide the shutter to move in the directions substantially perpendicular to the directions in which the image bearing member unit is drawn out of and put into the main body of the image forming apparatus.

3. The image bearing member unit according to claim 1, further comprising:

a guide member assembled with the support member to move in directions substantially parallel to the directions in which the image bearing member unit is drawn out of and put into the main body of the image forming apparatus, wherein a guide protrusion part is provided to the shutter to protrude and a guide slot is formed in the guide member, and the guide protrusion part provided to the shutter is slidably engaged with the guide slot formed in the guide member such that the shutter moves to the closed position or the opened position by relative movement of the guide member relative to the support member in the directions substantially parallel to the directions in which the image bearing member unit is drawn out of and put into the main body of the image forming apparatus.

4. The image bearing member unit according to claim 3, wherein the guide slot extends in a direction slanted relative to the directions in which the image bearing member unit is drawn out of and put into the main body of the image forming apparatus.

5. The image bearing member unit according to claim 3, wherein plural pieces of the guide protrusion part are provided to the shutter and plural pieces of the guide slot are formed in the guide member, and the plural pieces of the guide protrusion part provided to the shutter are slidably engaged with the plural pieces of the guide slot formed in the guide member, respectively.

6. The image bearing member unit according to claim 4, wherein parts of the guide slot where the guide protrusion part is engaged with the guide slot when the shutter is in the closed position and the opened position, respectively, and respective neighboring parts thereof extend in a direction substantially parallel to the directions in which the image bearing member unit is drawn out of and put into the main body of the image forming apparatus.

7. The image bearing member unit according to claim 3, wherein an engaging part is provided to the guide member to stop the guide member relative to the main body of the image forming apparatus in cooperation with a counterpart engaging part located inside of the main body of the image forming apparatus when the image bearing member unit is drawn out of and put into the main body of the image forming apparatus, and wherein the shutter is moved to the closed position or the opened position by stopping the guide member relative to the main body of the image forming apparatus with a cooperative operation of the engaging part provided to the guide member and the counterpart engaging part located inside of the main body of the image forming apparatus and by moving the support member, the image bearing member unit and the shutter in the directions in which the image bearing member unit is drawn out of and put into the main body of the image forming apparatus.

8. The image bearing member unit according to claim 7, wherein the guide member is stopped relative to the main body of the image forming apparatus by holding the engaging part to the counterpart engaging part with a magnetic force.

9. The image bearing member unit according to claim 3, wherein a pressing member is provided to press the guide member in a direction substantially parallel to a direction in which the image bearing member unit is pushed to be put into the main body of the image forming apparatus, and wherein when the image bearing member unit has been taken out of the main body of the image forming apparatus, by an operation of the pressing member, the guide member is pressed to a most backside position relative to the support member in the direction in which the image bearing member unit is pushed to be put into the main body of the image forming apparatus, so that the shutter is held in the closed position, and when the image bearing member unit is pushed to be put into the main body of the image forming apparatus, by a stopper provided at the side of the main body of the image forming apparatus, the guide member is stopped relative to the main body while resisting against the operation of the pressing member, so that the shutter is moved to the opened position.

10. The image bearing member unit according to claim 1, further comprising:

at least one wire spring fixed to the support member at one end thereof and contacting the support member at the other end thereof to slide in directions substantially parallel to the directions in which the image bearing member unit is drawn out and put into the main body of the image forming apparatus; and a slider slidably holding the at least one wire spring and assembled with the support member to slide in directions substantially parallel to the directions in which the image bearing member unit is drawn out and put into the main body of the image forming apparatus, wherein a middle part of the at least one wire spring between the one end and the other end thereof is fixed to the shutter, and the middle part of the at least one wire spring fixed to the shutter protrudes from a position of the one end and the other end of the at least one wire spring in a direction in which the shutter moves when the shutter moves to the closed position, and wherein a positional relation among the slider, the at least one wire spring and the shutter is set such that the slider slides relative to the at least one wire spring in the directions substantially parallel to the directions in which the image bearing member unit is drawn out and put into the main body of the image forming apparatus to deform the at least one wire spring and thereby the shutter is moved to the closed position or the opened position.

11. The image bearing member unit according to claim 10, wherein the slider is configured to stop relative to the main body of the image forming apparatus when the image bearing member unit is drawn out of and put into the main body of the image forming apparatus by a cooperative operation with a counterpart engaging part located inside of the main body of the image forming apparatus, and wherein the shutter is moved to the closed position or the opened position by stopping the slider relative to the main body of the image forming apparatus and by moving the support member, the shutter, and the at least one wire spring in the directions in which the image bearing member unit is drawn out of and put into the main body of the image forming apparatus to deform the at least one wire spring.

12. The image bearing member unit according to claim 11, wherein the slider is stopped relative to the main body of the image forming apparatus by holding the slider relative to the counterpart engaging part by a magnetic force.

13. The image bearing member unit according to claim 10, wherein the slider is slidably assembled with a part of the at least one wire spring between the one end thereof fixed to the support member and the middle part thereof fixed to the shutter.

14. The image bearing member unit according to claim 10, wherein the part of the at least one wire spring with which the slider is slidably assembled is curved to protrude in the direction in which the shutter moves to the opened position.

15. The image bearing member unit according to claim 10, wherein a guide part of the slider holding the at least one wire spring extends in a direction substantially parallel to the directions in which the slider slides.

16. The image bearing member unit according to claim 1, further comprising:

a regulating device to regulate a position of a part of the shutter opposing the image bearing member when the shutter is located in the closed position such that when the shutter is located in the closed position the part of the shutter opposing the image bearing member does not contact an image forming area surface of the image bearing member.

17. The image bearing member unit according to claim 16, wherein the regulating device includes a flange of the image bearing member, protruding toward the outside from a position of the image forming area surface of the image bearing member.

18. The image bearing member unit according to claim 16, wherein the regulating device includes a regulating protrusion formed in the support member.

19. The image bearing member unit according to claim 16, wherein the regulating device includes a regulating protrusion part formed in the shutter to contact a part of the image bearing member other than the image forming area surface thereof.

20. The image bearing member unit according to claim 1, wherein a part of the shutter, opposing the image forming area surface of the image bearing member when the image bearing member unit is in the closed position, is formed in a shape curved substantially along the image forming area surface of the image bearing member.

21. The image bearing member unit according to claim 1, wherein a part of the shutter, opposing the image forming area surface of the image bearing member when the image bearing member unit is in the closed position, is bent at a bending part thereof provided along an axial line of the image bearing member.

22. The image bearing member unit according to claim 1, wherein a receiving part is provided to the support member to engage with a tip end part of the shutter when the shutter is in the closed position, so that a gap is prevented from being formed between the tip end of the shutter and an edge of the support member at the side of the opening formed in the support member.

23. The image bearing member unit according to claim 1, wherein the shutter is arranged such that when the shutter is in the closed position, a flash formed at an edge part of the shutter when the shutter has been molded is located at a side separated from a surface of the image bearing member.

24. The image bearing member unit according to claim 1, wherein a tip end part corner of the shutter, opposing a surface of the image bearing member when the shutter is in the closed position, is formed in a round shape.

25. The image bearing member unit according to claim 1, wherein at least a surface of the shutter, opposing the image bearing member, is conductive.

26. The image bearing member unit according to claim 1, wherein the shutter and the support member are made of a same material.

27. A process cartridge comprising:

an image bearing member unit including an image bearing member and a support member supporting the image bearing member such that the image bearing member protrudes through an opening formed in the support member, the support member including a shutter housing space for housing a shutter when the shutter is in an opened position; and at least one process device configured to form a toner image on the image bearing member of the image bearing member unit, wherein the image bearing member unit is configured to be drawn out of and put into a main body of an image forming apparatus, wherein the image bearing member unit further includes the shutter assembled with the support member to move in directions, substantially perpendicular to directions in which the image bearing member unit is drawn out of and put into the main body of the image forming apparatus, to be located, when the image bearing member unit has been drawn out of the main body of the image forming apparatus, in a closed position wherein the shutter covers the image bearing member protruding through the opening formed in the support member, and to be located, when the image bearing member unit has been set in a predetermined position inside of the main body of the image forming apparatus, in the opened position wherein the shutter does not cover the image bearing member protruding through the opening formed in the support member, and wherein the shutter of the image bearing member unit moves to the closed position and to the opened position in conjunction with operations of attaching and detaching the image bearing member unit to and from the main body of the image forming apparatus.

28. The process cartridge according to claim 27, wherein the support member of the image bearing member unit includes a guide part to guide the shutter to move in the directions substantially perpendicular to the directions in which the image bearing member unit is drawn out of and put into the main body of the image forming apparatus.

29. The process cartridge according to claim 27, wherein the image bearing member unit further includes a guide member assembled with the support member to move in directions substantially parallel to the directions in which the image bearing member unit is drawn out of and put into the main body of the image forming apparatus, wherein a guide protrusion part is provided to the shutter to protrude and a guide slot is formed in the guide member, and the guide protrusion part provided to the shutter is slidably engaged with the guide slot formed in the guide member such that the shutter moves to the closed position or the opened position by relative movement of the guide member relative to the support member in the directions substantially parallel to the directions in which the image bearing member unit is drawn out of and put into the main body of the image forming apparatus.

30. The process cartridge according to claim 29, wherein the guide slot formed in the guide member extends in a direction slanted relative to the directions in which the image bearing member unit is drawn out of and put into the main body of the image forming apparatus.

31. The process cartridge according to claim 29, wherein plural pieces of the guide protrusion part are provided to the shutter and plural pieces of the guide slot are formed in the guide member, and the plural pieces of the guide protrusion part provided to the shutter are slidably engaged with the plural pieces of the guide slot formed in the guide member, respectively.

32. The process cartridge according to claim 30, wherein parts of the guide slot formed in the guide member, where the guide protrusion part provided to the shutter is engaged with the guide slot when the shutter is in the closed position and the opened position, respectively, and respective neighboring parts thereof extend in a direction substantially parallel to the directions in which the image bearing member unit is drawn out of and put into the main body of the image forming apparatus.

33. The process cartridge according to claim 29, wherein an engaging part is provided to the guide member to stop the guide member relative to the main body of the image forming apparatus in cooperation with a counterpart engaging part located inside of the main body of the image forming apparatus when the image bearing member unit is drawn out of and put into the main body of the image forming apparatus, and the shutter is moved to the closed position or the opened position by stopping the guide member relative to the main body of the image forming apparatus with a cooperative operation of the engaging part provided to the guide member and the counterpart engaging part located inside of the main body of the image forming apparatus and by moving the support member, the image bearing member unit and the shutter in the directions in which the image bearing member unit is drawn out of and put into the main body of the image forming apparatus.

34. The process cartridge according to claim 33, wherein the guide member is stopped relative to the main body of the image forming apparatus by holding the engaging part to the counterpart engaging part with a magnetic force.

35. The process cartridge according to claim 29 wherein a pressing member is provided to press the guide member in a direction substantially parallel to a direction in which the image bearing member unit is pushed to be put into the main body of the image forming apparatus, and when the image bearing member unit has been taken out of the main body of the image forming apparatus, by an operation of the pressing member, the guide member is pressed to a most backside position relative to the support member in the direction in which the image bearing member unit is pushed to be put into the main body of the image forming apparatus, so that the shutter is held in the closed position, and when the image bearing member unit is pushed to be put into the main body of the image forming apparatus, by a stopper provided at the side of the main body of the image forming apparatus, the guide member is stopped relative to the main body while resisting against the operation of the pressing member, so that the shutter is moved to the opened position.

36. The process cartridge according to claim 27, wherein the image bearing member unit further includes at least one wire spring fixed to the support member at one end thereof and contacting the support member at the other end thereof to slide in directions substantially parallel to the directions in which the image bearing member unit is drawn out and put into the main body of the image forming apparatus, and a slider slidably holding the at least one wire spring and assembled with the support member to slide in directions substantially parallel to the directions in which the image bearing member unit is drawn out and put into the main body of the image forming apparatus, and wherein a middle part of the at least one wire spring between the one end and the other end thereof is fixed to the shutter, the middle part of the at least one wire spring fixed to the shutter protrudes from positions of the one end and the other end of the at least one wire spring in a direction in which the shutter moves when the shutter moves to the closed position, and a positional relation among the slider, the at least one wire spring and the shutter is set such that the slider slides relative to the at least one wire spring in the directions substantially parallel to the directions in which the image bearing member unit is drawn out and put into the main body of the image forming apparatus to deform the at least one wire spring and thereby the shutter is moved to the closed position or the opened position.

37. The process cartridge according to claim 36, wherein the slider of the image bearing member unit is configured to stop relative to the main body of the image forming apparatus when the image bearing member unit is drawn out of and put into the main body of the image forming apparatus by a cooperative operation with a counterpart engaging part located inside of the main body of the image forming apparatus, and wherein the shutter is moved to the closed position or the opened position by stopping the slider relative to the main body of the image forming apparatus and by moving the support member, the shutter, and the at least one wire spring in the directions in which the image bearing member unit is drawn out of and put into the main body of the image forming apparatus to deform the at least one wire spring.

38. The process cartridge according to claim 37, wherein the slider is stopped relative to the main body of the image forming apparatus by holding the slider relative to the counterpart engaging part by a magnetic force.

39. The process cartridge according to claim 36, wherein the slider is slidably assembled with a part of the at least one wire spring between the one end thereof fixed to the support member and the middle part thereof fixed to the shutter.

40. The process cartridge according to claim 36, wherein the part of the at least one wire spring with which the slider is slidably assembled is curved to protrude in the direction in which the shutter moves to the opened position.

41. The process cartridge according to claim 36, wherein a guide part of the slider holding the at least one wire spring extends in a direction substantially parallel to the directions in which the slider slides.

42. The process cartridge according to claim 27, wherein the image bearing member unit further includes a regulating device to regulate a position of a part of the shutter opposing the image bearing member when the shutter is located in the closed position such that when the shutter is located in the closed position the part of the shutter opposing the image bearing member does not contact an image forming area surface of the image bearing member.

43. The process cartridge according to claim 42, wherein the regulating device of the image bearing member unit includes a flange of the image bearing member, protruding toward the outside from a position of the image forming area surface of the image bearing member.

44. The process cartridge according to claim 42, wherein the regulating device of the image bearing member unit includes a regulating protrusion formed in the support member.

45. The process cartridge according to claim 42, wherein the regulating device of the image bearing member unit includes a regulating protrusion part formed in the shutter to contact a part of the image bearing member other than the image forming area surface thereof.

46. The process cartridge according to claim 27, wherein a part of the shutter, opposing the image forming area surface of the image bearing member when the image bearing member unit is in the closed position, is formed in a shape curved substantially along the image forming area surface of the image bearing member.

47. The process cartridge according to claim 27, wherein a part of the shutter, opposing the image forming area surface of the image bearing member when the image bearing member unit is in the closed position, is bent at a bending part thereof provided along an axial line of the image bearing member.

48. The process cartridge according to claim 27, wherein a receiving part is provided to the support member to engage with a tip end part of the shutter when the shutter is in the closed position, so that a gap is prevented from being formed between the tip end of the shutter and an edge of the support member at the side of the opening formed in the support member.

49. The process cartridge according to claim 27, wherein the shutter is arranged such that when the shutter is in the closed position, a flash formed at an edge part of the shutter when the shutter has been molded is located at a side separated from a surface of the image bearing member.

50. The process cartridge according to claim 27, wherein a tip end part corner of the shutter, opposing a surface of the image bearing member when the shutter is in the closed position, is formed in a round shape.

51. The process cartridge according to claim 27, wherein at least a surface of the shutter, opposing the image bearing member, is conductive.

52. The process cartridge according to claim 27, wherein the shutter and the support member are made of a same material.

53. The process cartridge according to claim 27, wherein the image bearing member unit is detachable relative to a part of the process cartridge.

54. An image forming apparatus comprising:

a main body;

an image bearing member unit including an image bearing member and a support member supporting the image bearing member such that the image bearing member protrudes through an opening formed in the support member, the support member including a shutter housing space for housing a shutter when the shutter is in an opened position; and at least one process device configured to form a toner image on the image bearing member of the image bearing member unit, wherein the image bearing member unit is configured to be drawn out of and put into the main body, wherein the image bearing member unit further includes the shutter assembled with the support member to move in directions, substantially perpendicular to directions in which the image bearing member unit is drawn out of and put into the main body, to be located, when the image bearing member unit has been drawn out of the main body, in a closed position wherein the shutter covers the image bearing member protruding through the opening formed in the support member, and to be located, when the image bearing member unit has been set in a predetermined position inside of the main body, in the opened position wherein the shutter does not cover the image bearing member protruding through the opening formed in the support member, and wherein the shutter of the image bearing member unit moves to the closed position and to the opened position in conjunction with operations of attaching and detaching the image bearing member unit to and from the main body.

55. The image forming apparatus according to claim 54, wherein the support member of the image bearing member unit includes a guide part to guide the shutter to move in the directions substantially perpendicular to the directions in which the image bearing member unit is drawn out of and put into the main body.

56. The image forming apparatus according to claim 54, wherein the image bearing member unit further includes a guide member assembled with the support member to move in directions substantially parallel to the directions in which the image bearing member unit is drawn out of and put into the main body, wherein a guide protrusion part is provided to the shutter to protrude and a guide slot is formed in the guide member, and the guide protrusion part provided to the shutter is slidably engaged with the guide slot formed in the guide member such that the shutter moves to the closed position or the opened position by relative movement of the guide member relative to the support member in the directions substantially parallel to the directions in which the image bearing member unit is drawn out of and put into the main body.

57. The image forming apparatus according to claim 56, wherein the guide slot formed in the guide member extends in a direction slanted relative to the directions in which the image bearing member unit is drawn out of and put into the main body.

58. The image forming apparatus according to claim 56, wherein plural pieces of the guide protrusion part are provided to the shutter and plural pieces of the guide slot are formed in the guide member, and the plural pieces of the guide protrusion part provided to the shutter are slidably engaged with the plural pieces of the guide slot formed in the guide member, respectively.

59. The image forming apparatus according to claim 57, wherein parts of the guide slot formed in the guide member, where the guide protrusion part provided to the shutter is engaged with the guide slot when the shutter is in the closed position and the opened position, respectively, and respective neighboring parts thereof extend in a direction substantially parallel to the directions in which the image bearing member unit is drawn out of and put into the main body.

60. The image forming apparatus according to claim 56, wherein an engaging part is provided to the guide member to stop the guide member relative to the main body in cooperation with a counterpart engaging part located inside of the main body when the image bearing member unit is drawn out of and put into the main body, and the shutter is moved to the closed position or the opened position by stopping the guide member relative to the main body with a cooperative operation of the engaging part provided to the guide member and the counterpart engaging part located inside of the main body and by moving the support member, the image bearing member unit and the shutter in the directions in which the image bearing member unit is drawn out of and put into the main body.

61. The image forming apparatus according to claim 60, wherein the guide member is stopped relative to the main body by holding the engaging part to the counterpart engaging part with a magnetic force.

62. The image forming apparatus according to claim 56, wherein a pressing member is provided to press the guide member in a direction substantially parallel to a direction in which the image bearing member unit is pushed to be put into the main body, and when the image bearing member unit has been taken out of the main body, by an operation of the pressing member, the guide member is pressed to a most backside position relative to the support member in the direction in which the image bearing member unit is pushed to be put into the main body, so that the shutter is held in the closed position, and when the image bearing member unit is pushed to be put into the main body, by a stopper provided at the side of the main body, the guide member is stopped relative to the main body while resisting against the operation of the pressing member, so that the shutter is moved to the opened position.

63. The image forming apparatus according to claim 54, wherein the image bearing member unit further includes at least one wire spring fixed to the support member at one end thereof and contacting the support member at the other end thereof to slide in directions substantially parallel to the directions in which the image bearing member unit is drawn out and put into the main body, and a slider slidably holding the at least one wire spring and assembled with the support member to slide in directions substantially parallel to the directions in which the image bearing member unit is drawn out and put into the main body, and wherein a middle part of the at least one wire spring between the one end and the other end thereof is fixed to the shutter, the middle part of the at least one wire spring fixed to the shutter protrudes from positions of the one end and the other end of the at least one wire spring in a direction in which the shutter moves when the shutter moves to the closed position, and a positional relation among the slider, the at least one wire spring and the shutter is set such that the slider slides relative to the at least one wire spring in the directions substantially parallel to the directions in which the image bearing member unit is drawn out and put into the main body to deform the at least one wire spring and thereby the shutter is moved to the closed position or the opened position.

64. The image forming apparatus according to claim 63, wherein the slider of the image bearing member unit is configured to stop relative to the main body when the image bearing member unit is drawn out of and put into the main body by a cooperative operation with a counterpart engaging part located inside of the main body, and wherein the shutter is moved to the closed position or the opened position by stopping the slider relative to the main body and by moving the support member, the shutter, and the at least one wire spring in the directions in which the image bearing member unit is drawn out of and put into the main body to deform the at least one wire spring.

65. The image forming apparatus according to claim 64, wherein the slider is stopped relative to the main body by holding the slider relative to the counterpart engaging part by a magnetic force.

66. The image forming apparatus according to claim 63, wherein the slider is slidably assembled with a part of the at least one wire spring between the one end thereof fixed to the support member and the middle part thereof fixed to the shutter.

67. The image forming apparatus according to claim 63, wherein the part of the at least one wire spring with which the slider is slidably assembled is curved to protrude in the direction in which the shutter moves to the opened position.

68. The image forming apparatus according to claim 63, wherein a guide part of the slider holding the at least one wire spring extends in a direction substantially parallel to the directions in which the slider slides.

69. The image forming apparatus according to claim 54, wherein the image bearing member unit further includes a regulating device to regulate a position of a part of the shutter opposing the image bearing member when the shutter is located in the closed position such that when the shutter is located in the closed position the part of the shutter opposing the image bearing member does not contact an image forming area surface of the image bearing member.

70. The image forming apparatus according to claim 69, wherein the regulating device of the image bearing member unit includes a flange of the image bearing member, protruding toward the outside from a position of the image forming area surface of the image bearing member.

71. The image forming apparatus according to claim 69, wherein the regulating device of the image bearing member unit includes a regulating protrusion formed in the support member.

72. The image forming apparatus according to claim 69, wherein the regulating device of the image bearing member unit includes a regulating protrusion part formed in the shutter to contact a part of the image bearing member other than the image forming area surface thereof.

73. The image forming apparatus according to claim 54, wherein a part of the shutter, opposing the image forming area surface of the image bearing member when the image bearing member unit is in the closed position, is formed in a shape curved substantially along the image forming area surface of the image bearing member.

74. The image forming apparatus according to claim 54, wherein a part of the shutter, opposing the image forming area surface of the image bearing member when the image bearing member unit is in the closed position, is bent at a bending part thereof provided along an axial line of the image bearing member.

75. The image forming apparatus according to claim 54, wherein a receiving part is provided to the support member to engage with a tip end part of the shutter when the shutter is in the closed position, so that a gap is prevented from being formed between the tip end of the shutter and an edge of the support member at the side of the opening formed in the support member.

76. The image forming apparatus according to claim 54, wherein the shutter is arranged such that when the shutter is in the closed position, a flash formed at an edge part of the shutter when the shutter has been molded is located at a side separated from a surface of the image bearing member.

77. The image forming apparatus according to claim 54, wherein a tip end part corner of the shutter, opposing a surface of the image bearing member when the shutter is in the closed position, is formed in a round shape.

78. The image forming apparatus according to claim 54, wherein at least a surface of the shutter, opposing the image bearing member, is conductive.

79. The image forming apparatus according to claim 54, wherein the shutter and the support member are made of a same material.

80. The image forming apparatus according to claim 54, wherein the image bearing member unit and the at least one process device are assembled with each other to form a process cartridge.

81. The image forming apparatus according to claim 80, wherein the image bearing member unit is detachable relative to a part of the process cartridge.

82. The image forming apparatus according to claim 54, further comprising:

a detect device configured to detect if the shutter remains in the closed position when the image bearing member unit has been set in the predetermined position inside of the main body.

83. An image bearing member unit comprising:

an image bearing member on which a toner image is formed;

a support member supporting the image bearing member such that the image bearing member protrudes through an opening formed in the support member;

a shutter assembled with the support member to move between an opened position wherein the shutter does not cover the image bearing member protruding through the opening formed in the support member and a closed position wherein the shutter covers the image bearing member protruding through the opening formed in the support member;

a pressing member pressing the shutter toward the closed position; and a shutter opening/closing regulation device connected with the shutter and the support member to be located, when the shutter is in the closed position, in a first position wherein the shutter opening/closing regulation device protrudes upward, and to be located, when the shutter is in the closed position, in a second position wherein a height of the shutter opening/closing regulation device is lower than that when the shutter opening/closing regulation device is located in the first position, wherein the image bearing member unit is configured to be drawn out and put into a main body of an image forming apparatus, and wherein, after the image bearing member unit in a state that the shutter is located in the closed position has been placed inside of the main body of the image forming apparatus, by moving the image bearing member unit upward relative to a member of the main body other than the image bearing member unit, the shutter opening/closing regulation device is pressed by the member of the main body other than the image bearing member unit downward to be located in the second position, and thereby the shutter is operated to move to the opened position.

84. The image bearing member unit according to claim 83, wherein the shutter opening/closing regulation device includes a plurality of arms rotatably connected with each other, and wherein a first arm of the plurality of arms is rotatably connected with the support member, a second arm of the plurality of arms is rotatably connected with the shutter, and the shutter is slidably assembled with the support member to move between the opened and closed positions.

85. The image bearing member unit according to claim 84, wherein the plurality of arms include at least four arms.

86. The image bearing member unit according to claim 84, wherein a number of the plurality of arms of the shutter opening/closing regulation device and shapes of the plurality of arms of the shutter opening/closing regulation device are set such that the shutter opening/closing regulation device is in a symmetrical shape.

87. The image bearing member unit according to claim 83, wherein the pressing member includes a plurality of springs arranged in point or line symmetry.

88. The image bearing member unit according to claim 83, wherein the shutter opening/closing regulation device is configured to serve as a handle of the image bearing member unit.

89. The image bearing member unit according to claim 88, wherein the image bearing member unit includes two units of the shutter opening/closing regulation device arranged in positions separated from each other, and wherein a vertical line passing a center of gravity of the image bearing member unit intersects with a line connecting substantially center parts of the two units of the shutter opening/closing regulation device.

90. The image bearing member unit according to claim 88, wherein the shutter opening/closing regulation device includes a plurality of arms rotatably connected with each other, and wherein a number of the plurality of arms is an odd number, and when the image bearing member unit is in a horizontal posture, an arm of the plurality of arms located in a center of the plurality of arms is put into a substantially horizontal posture.

91. The image bearing member unit according to claim 88, wherein the shutter opening/closing regulation device is different from other parts of the image bearing member unit in color.

92. The image bearing member unit according to claim 88, wherein the shutter opening/closing regulation device includes a slip stopper.

93. A process cartridge comprising:

an image bearing member unit including;

an image bearing member, a support member supporting the image bearing member such that the image bearing member protrudes through an opening formed in the support member, a shutter assembled with the support member to move between an opened position wherein the shutter does not cover the image bearing member protruding through the opening formed in the support member and a closed position wherein the shutter covers the image bearing member protruding through the opening formed in the support member, a pressing member pressing the shutter toward the closed position, and a shutter opening/closing regulation device connected with the shutter and the support member to be located, when the shutter is in the closed position, in a first position wherein the shutter opening/closing regulation device protrudes upward, and to be located, when the shutter is in the closed position, in a second position wherein a height of the shutter opening/closing regulation device is lower than that when the shutter opening/closing regulation device is located in the first position; and at least one process device for forming a toner image on the image bearing member of the image bearing member unit, wherein the image bearing member unit is configured to be drawn out and put into a main body of an image forming apparatus, and wherein, after the image bearing member unit in a state that the shutter is located in the closed position has been placed inside of the main body of the image forming apparatus, by moving the image bearing member unit upward relative to a member of the main body other than the image bearing member unit, the shutter opening/closing regulation device is pressed by the member of the main body other than the image bearing member unit downward to be located in the second position, and thereby the shutter is operated to move to the opened position.

94. The process cartridge according to claim 93, wherein the shutter opening/closing regulation device includes a plurality of arms rotatably connected with each other, and wherein a first arm of the plurality of arms is rotatably connected with the support member, a second arm of the plurality of arms is rotatably connected with the shutter, and the shutter is slidably assembled with the support member to move between the opened and closed positions.

95. The process cartridge according to claim 94, wherein the plurality of arms include at least four arms.

96. The process cartridge according to claim 94, wherein a number of the plurality of arms of the shutter opening/closing regulation device and shapes of the plurality of arms of the shutter opening/closing regulation device are set such that the shutter opening/closing regulation device is in a symmetrical shape.

97. The process cartridge according to claim 93, wherein the pressing member includes a plurality of springs arranged in point or line symmetry.

98. The process cartridge according to claim 93, wherein the shutter opening/closing regulation device is configured to serve as a handle of the image bearing member unit.

99. The process cartridge according to claim 98, wherein the image bearing member unit includes two units of the shutter opening/closing regulation device arranged in positions separated from each other, and wherein a vertical line passing a center of gravity of the image bearing member unit intersects with a line connecting substantially center parts of the two units of the shutter opening/closing regulation device.

100. The process cartridge according to claim 98, wherein the shutter opening/closing regulation device includes a plurality of arms rotatably connected with each other, and wherein a number of the plurality of arms is an odd number, and when the image bearing member unit is in a horizontal posture, an arm of the plurality of arms located in a center of the plurality of arms is put into a substantially horizontal posture.

101. The process cartridge according to claim 98, wherein the shutter opening/closing regulation device is different from other parts of the image bearing member unit in color.

102. The process cartridge according to claim 98, wherein the shutter opening/closing regulation device includes a slip stopper.

103. The process cartridge according to claim 93, wherein the image bearing member unit is detachable relative to a part of the process cartridge.

104. An image forming apparatus comprising:

a main body;

an image bearing member unit including, an image bearing member, a support member supporting the image bearing member such that the image bearing member protrudes through an opening formed in the support member, a shutter assembled with the support member to move between an opened position wherein the shutter does not cover the image bearing member protruding through the opening formed in the support member and a closed position wherein the shutter covers the image bearing member protruding through the opening formed in the support member, a pressing member pressing the shutter toward the closed position, and a shutter opening/closing regulation device connected with the shutter and the support member to be located, when the shutter is in the closed position, in a first position wherein the shutter opening/closing regulation device protrudes upward, and to be located, when the shutter is in the closed position, in a second position wherein a height of the shutter opening/closing regulation device is lower than that when the shutter opening/closing regulation device is located in the first position; and at least one process device configured to form a toner image on the image bearing member of the image bearing member unit, wherein the image bearing member unit is configured to be drawn out and put into the main body, and wherein, after the image bearing member unit in a state that the shutter is located in the closed position has been placed inside of the main body, by moving the image bearing member unit upward relative to a member of the main body other than the image bearing member unit, the shutter opening/closing regulation device is pressed by the member of the main body other than the image bearing member unit downward to be located in the second position, and thereby the shutter is operated to move to the opened position.

105. The image forming apparatus according to claim 104, wherein the shutter opening/closing regulation device includes a plurality of arms rotatably connected with each other, and wherein a first arm of the plurality of arms is rotatably connected with the support member, a second arm of the plurality of arms is rotatably connected with the shutter, and the shutter is slidably assembled with the support member to move between the opened and closed positions.

106. The image forming apparatus according to claim 105, wherein the plurality of arms include at least four arms.

107. The image forming apparatus according to claim 105, wherein a number of the plurality of arms of the shutter opening/closing regulation device and shapes of the plurality of arms of the shutter opening/closing regulation device are set such that the shutter opening/closing regulation device is in a symmetrical shape.

108. The image forming apparatus according to claim 104, wherein the pressing member includes a plurality of springs arranged in point or line symmetry.

109. The image forming apparatus according to claim 104, wherein the shutter opening/closing regulation device is configured to serve as a handle of the image bearing member unit.

110. The image forming apparatus according to claim 109, wherein the image bearing member unit includes two units of the shutter opening/closing regulation device arranged in positions separated from each other, and wherein a vertical line passing a center of gravity of the image bearing member unit intersects with a line connecting substantially center parts of the two units of the shutter opening/closing regulation device.

111. The image forming apparatus according to claim 109, wherein the shutter opening/closing regulation device includes a plurality of arms rotatably connected with each other, and wherein a number of the plurality of arms is an odd number, and when the image bearing member unit is in a horizontal posture, an arm of the plurality of arms located in a center of the plurality of arms is put into a substantially horizontal posture.

112. The image forming apparatus according to claim 109, wherein the shutter opening/closing regulation device is different from other parts of the image bearing member unit in color.

113. The image forming apparatus according to claim 109, wherein the shutter opening/closing regulation device includes a slip stopper.

114. The image forming apparatus according to claim 104, wherein the image bearing member unit and the at least one process device are assembled with each other to form a process cartridge.

115. The image forming apparatus according to claim 114, wherein the image bearing member unit is detachable relative to a part of the process cartridge.

116. An image bearing member unit comprising:

an image bearing member on which a toner image is formed; and means for supporting the image bearing member such that the image bearing member protrudes through an opening formed in the supporting means, the supporting means including housing means for housing a covering/uncovering means when the covering/uncovering means is in an opened position, wherein the image bearing member unit is configured to be drawn out of and put into a main body of an image forming apparatus, wherein the image bearing member unit further comprises the means for covering and uncovering the image bearing member protruding through the opening formed in the supporting means, the covering/uncovering means being assembled with the supporting means to move in directions, substantially perpendicular to directions in which the image bearing member unit is drawn out of and put into the main body of the image forming apparatus, to be located, when the image bearing member unit has been drawn out of the main body of the image forming apparatus, in a closed position wherein the covering/uncovering means covers the image bearing member protruding through the opening formed in the supporting means, and to be located, when the image bearing member unit has been set in a predetermined position inside of the main body of the image forming apparatus, in the opened position wherein the covering/uncovering means does not cover the image bearing member protruding through the opening formed in the supporting means, and wherein the means for covering and uncovering the image bearing member moves to the closed position and the opened position in conjunction with operations of attaching and detaching the image bearing member unit to and from the main body of the imaging forming apparatus.

117. A process cartridge comprising:

an image bearing member unit including an image bearing member and means for supporting the image bearing member such that the image bearing member protrudes through an opening formed in the supporting means, the supporting means including housing means for housing a covering/uncovering means when the covering/uncovering means is in an opened position; and at least one means for forming a toner image on the image bearing member of the image bearing member unit, wherein the image bearing member unit is configured to be drawn out of and put into a main body of an image forming apparatus, wherein the image bearing member unit further includes the means for covering and uncovering the image bearing member protruding through the opening formed in the supporting means, the covering/uncovering means being assembled with the supporting means to move in directions, substantially perpendicular to directions in which the image bearing member unit is drawn out of and put into the main body of the image forming apparatus, to be located, when the image bearing member unit has been drawn out of the main body of the image forming apparatus, in a closed position wherein the covering/uncovering means covers the image bearing member protruding through the opening formed in the supporting means, and to be located, when the image bearing member unit has been set in a predetermined position inside of the main body of the image forming apparatus, in the opened position wherein the covering/uncovering means does not cover the image bearing member protruding through the opening formed in the supporting means, and wherein the means for covering and uncovering the image bearing member moves to the closed position and the opened position in conjunction with operations of attaching and detaching the image bearing member unit to and from the main body of the imaging forming apparatus.

118. An image forming apparatus comprising:

a main body;

an image bearing member unit including an image bearing member and supporting means for supporting the image bearing member such that the image bearing member protrudes through an opening formed in the supporting means, the supporting means including housing means for housing a covering/uncovering means when the covering/uncovering means is in an opened position; and at least one means for forming a toner image on the image bearing member of the image bearing member unit, wherein the image bearing member unit is configured to be drawn out of and put into the main body, wherein the image bearing member unit further includes the means for covering and uncovering the image bearing member protruding through the opening formed in the supporting means, the covering/uncovering means being assembled with the supporting means to move in directions, substantially perpendicular to directions in which the image bearing member unit is drawn out of and put into the main body, to be located, when the image bearing member unit has been drawn out of the main body, in a closed position wherein the covering/uncovering means covers the image bearing member protruding through the opening formed in the supporting means, and to be located, when the image bearing member unit has been set in a predetermined position inside of the main body, in the opened position wherein the covering/uncovering means does not cover the image bearing member protruding through the opening formed in the supporting means, and wherein the means for covering and uncovering the image bearing member moves to the closed position and the opened position in conjunction with operations of attaching and detaching the image bearing member unit to and from the main body of the imaging forming apparatus.

119. An image bearing member unit comprising:

an image bearing member on which a toner image is formed;

means for supporting the image bearing member such that the image bearing member protrudes through an opening formed in the supporting means;

means for covering and uncovering the image bearing member protruding through the opening formed in the supporting means, the covering/uncovering means being assembled with the supporting means to move between an opened position wherein the covering/uncovering means does not cover the image bearing member protruding through the opening formed in the supporting means and a closed position wherein the covering/uncovering means covers the image bearing member protruding through the opening formed in the supporting means;

means for pressing the covering/uncovering means toward the closed position; and means for regulating the covering/uncovering means connected with the covering/uncovering means and the supporting means to be located, when the covering/uncovering means is in the closed position, in a first position wherein the covering/uncovering means regulating means protrudes upward, and to be located, when the covering/uncovering means is in the closed position, in a second position wherein a height of the covering/uncovering means regulating means is lower than that when the covering/uncovering means regulating means is located in the first position, wherein the image bearing member unit is configured to be drawn out and put into a main body of an image forming apparatus, and wherein, after the image bearing member unit in a state that the covering/uncovering means is located in the closed position has been placed inside of the main body of the image forming apparatus, by moving the image bearing member unit upward relative to a member of the main body other than the image bearing member unit, the covering/uncovering means regulating means is pressed by the member of the main body other than the image bearing member unit downward to be located in the second position, and thereby the covering/uncovering means is operated to move to the opened position.

120. A process cartridge comprising:

an image bearing member unit including;

an image bearing member, means for supporting the image bearing member such that the image bearing member protrudes through an opening formed in the supporting means, means for covering/uncovering the image bearing member protruding through the opening formed in the supporting means, the covering/uncovering means being assembled with the supporting means to move between an opened position wherein the covering/ uncovering means does not cover the image bearing member protruding through the opening formed in the supporting means and a closed position wherein the covering/uncovering means covers the image bearing member protruding through the opening formed in the supporting means, means for pressing the covering/uncovering means toward the closed position, and means for regulating the covering/uncovering means connected with the covering/uncovering means and the supporting means to be located, when the covering/uncovering means is in the closed position, in a first position wherein the covering/uncovering means regulating means protrudes upward, and to be located, when the covering/uncovering means is in the closed position, in a second position wherein a height of the covering/uncovering means regulating means is lower than that when the covering/uncovering means regulating means is located in the first position; and at least one means for forming a toner image on the image bearing member of the image bearing member unit, wherein the image bearing member unit is configured to be drawn out and put into a main body of an image forming apparatus, and wherein, after the image bearing member unit in a state that the covering/uncovering means is located in the closed position has been placed inside of the main body of the image forming apparatus, by moving the image bearing member unit upward relative to a member of the main body other than the image bearing member unit, the covering/uncovering means regulating means is pressed by the member of the main body other than the image bearing member unit downward to be located in the second position, and thereby the covering/uncovering means is operated to move to the opened position.

121. An image forming apparatus comprising:

a main body;

an image bearing member unit including;

an image bearing member, means for supporting the image bearing member such that the image bearing member protrudes through an opening formed in the supporting means, means for covering/uncovering the image bearing member protruding through the opening formed in the supporting means, the covering/uncovering means being assembled with the supporting means to move between an opened position wherein the covering/uncovering means does not cover the image bearing member protruding through the opening formed in the supporting means and a closed position wherein the covering/uncovering means covers the image bearing member protruding through the opening formed in the supporting means, means for pressing the covering/uncovering means toward the closed position, and means for regulating the covering/uncovering means connected with the covering/uncovering means and the supporting means to be located, when the covering/uncovering means is in the closed position, in a first position wherein the covering/uncovering means regulating means protrudes upward, and to be located, when the covering/uncovering means is in the closed position, in a second position wherein a height of the covering/uncovering means regulating means is lower than that when the covering/uncovering means regulating means is located in the first position; and at least one means for forming a toner image on the image bearing member of the image bearing member unit, wherein the image bearing member unit is configured to be drawn out and put into a main body of an image forming apparatus, and wherein, after the image bearing member unit in a state that the covering/uncovering means is located in the closed position has been placed inside of the main body of the image forming apparatus, by moving the image bearing member unit upward relative to a member of the main body other than the image bearing member unit, the covering/uncovering means regulating means is pressed by the member of the main body other than the image bearing member unit downward to be located in the second position, and thereby the covering/uncovering means is operated to move to the opened position.

* * * * *